US007012178B2

(12) United States Patent
Muramatsu

(10) Patent No.: US 7,012,178 B2
(45) Date of Patent: Mar. 14, 2006

(54) COMPACT MUSICAL INSTRUMENT EQUIPPED WITH AUTOMATIC PLAYER

(75) Inventor: Shigeru Muramatsu, Shizuoka (JP)

(73) Assignee: Yamaha Corporation, (JP)

( * ) Notice: Subject to any disclaimer, the term of this patent is extended or adjusted under 35 U.S.C. 154(b) by 248 days.

(21) Appl. No.: 10/361,614

(22) Filed: Feb. 11, 2003

(65) Prior Publication Data

US 2003/0150316 A1 Aug. 14, 2003

(30) Foreign Application Priority Data

| | | |
|---|---|---|
| Feb. 13, 2002 | (JP) | 2002-035403 |
| Mar. 20, 2002 | (JP) | 2002-079132 |
| Mar. 20, 2002 | (JP) | 2002-079133 |
| Mar. 20, 2002 | (JP) | 2002-079134 |
| Mar. 20, 2002 | (JP) | 2002-079151 |

(51) Int. Cl.
*G10F 1/06* (2006.01)

(52) U.S. Cl. ..... 84/97; 84/100

(58) Field of Classification Search ..... 84/100, 84/94.2, 94.1, 95.1, 95.2, 96–99
See application file for complete search history.

(56) References Cited

U.S. PATENT DOCUMENTS

| | | | | |
|---|---|---|---|---|
| 1,978,828 | A * | 10/1934 | Watson | 84/174 |
| 2,478,602 | A * | 8/1949 | Stein | 84/94.1 |
| 4,466,328 | A | 8/1984 | Kitamura | |
| 5,498,833 | A * | 3/1996 | Huang | 84/94.1 |
| 5,962,796 | A * | 10/1999 | Nakamura et al. | 84/97 |
| 5,973,240 | A * | 10/1999 | Isaka | 84/97 |

* cited by examiner

*Primary Examiner*—Kimberly Lockett
(74) *Attorney, Agent, or Firm*—Dickstein, Shapiro, Morin & Oshinsky, L.L.P.

(57) ABSTRACT

A music box includes a daisy reed wheel having reeds radially projecting from a hub for generating tones and solenoid-operated player's fingers arranged around the daisy reed wheel; the tips of the reeds are widely spaced from one another by virtue of the radial arrangement so that large-sized solenoid-operated actuators are used for the player's fingers; this results in the compact music box.

36 Claims, 57 Drawing Sheets

COMPACT MUSICAL INSTRUMENT EQUIPPED WITH AUTOMATIC PLAYER

FIELD OF THE INVENTION

This invention relates to a musical instrument and, more particularly, to a musical instrument equipped with an automatic player such as, for example, a music box.

DESCRIPTION OF THE RELATED ART

A music box is a typical example of the musical instrument with a built-in automatic player. A standard music box is broken down into a tone generator and an automatic player. The tone generator is implemented by an array of plural reeds, and the reeds vibrate for generating tones when the automatic player selectively plucks them. The tones are different in pitches from one another. The plural reeds may be formed into a comb-like reed unit. On the other hand, the automatic player is implemented by a rotational barrel drum. The rotational barrel drum is formed with small projections over the outer surface thereof, and the small projections are fixed to the outer surface. In other words, users can not relocate the small projections. The rotational barrel drum is provided in the close proximity of the array of reeds, and the barrel drum is driven for rotation over a certain angle equal to or less than 360 degrees. While the barrel drum is rotating, the small projections are selectively brought into contact with the reeds, and pluck the reeds. The reeds vibrate for generating the tones. Thus, the automatic player performs a piece of music through the vibrations of the reeds.

Each reed is doubled in another sort of tone generator, and the small projection concurrently plucks the double reed for generating a tone. The vibrating double reed makes the tone richer the tone generated from the single reed. The other features are similar to those of the standard music box. A barrel drum is formed with small projections, and is provided in the close proximity of the set of double reeds. While the barrel drum is rotating, the small projections selectively pluck the double reeds for performing a piece of music. However, the projections are fixed to the outer surface of the barrel drum. This means that the user can not relocate the small projections.

A problem inherent in the prior art standard music boxes is poor flexibility. The barrel drums are designed for particular pieces of music. Even if the user wishes to make the prior art standard music box perform another piece of music, the prior art standard music box can not respond to the user's request. Only one way to respond the user's request is to suggest the user to replace the barrel drum with a new barrel drum designed for the other piece of music.

The poor flexibility is because of the small projections fixed to the outer surface of the barrel drum. If the small projections are easily relocated, the standard music box can selectively play pieces of music without any replacement of the barrel drum. From this viewpoint, several music boxes have been proposed.

One of the music boxes selectively performing pieces of music on demand includes the tone generator, which is also implemented by an array of reeds, and an automatic player with a complex mechanism. The reeds are arranged in a row on a virtual straight line. The automatic player includes a turn-table, plural solenoid-operated actuators, hammers and a controlling circuit. The hammers are provided in association with the reeds for striking the associated reeds, and are rotatably supported by a frame like levers. Although the reeds are quite thin, the hammers are arranged along an arc, and the hammers strike the reeds at the inner ends thereof. This feature is desirable, because the large-sized hammers are arrayed. The large-sized hammers are durable.

The turn-table has an axis of rotation vertical to the array of reeds so that the rotating surface of the turn-table is maintained in parallel to the array of reeds. The solenoid-operated actuators are fixed to the turn-table, and the controlling circuit selectively supplies driving current to the solenoid-operated actuators. The solenoid-operated actuators retract the plungers into the associated solenoids in the absence of the driving current. Even though the turn table is rotated, the plungers do not kick the hammers, and, accordingly, the hammers never strike the reeds.

When the user requests the automatic player to perform a piece of music, the turn-table is driven for rotation, and the controlling circuit starts to selectively supply the driving current to the solenoid-operated actuators. The solenoid-operated actuators sequentially project the plungers in the presence of the driving current, and the plungers kick the associated hammers. Then, the hammers strike the associated reeds, and give rise to vibrations of the reeds. The reeds generate the tones for performing the piece of music.

The user is assumed to request the automatic player to perform another piece of music. The controlling circuit changes the sequence of the solenoid-operated actuators to be energized with the driving current. The controlling circuit starts to supply the driving current to the solenoid-operated actuators, and the hammers strike the reeds in the different order. This results in the other piece of music. This music box is hereinafter referred to as "first prior art music box".

Another music box selectively performing pieces of music on demand is also broken down into the tone generator, which is implemented by an array of reeds, and an automatic player. The reeds are arranged in a single row on a virtual straight line. The automatic player includes a rotational cylinder, pins, solenoid-operated actuators and a controlling circuit. The rotational cylinder has an axis of rotation, which is in parallel to the array of reeds. Through-holes are formed in the cylinder, and the pins are received in the through-holes. The pins are projectable from and retractable into the through-holes. The solenoid-operated actuators are accommodated in the cylinder, and push and pull the associated pins. The controlling circuit is electrically connected to the solenoid-operated actuators, and selectively supplies driving current to the solenoid-operated actuators. The reeds are respectively aligned with the orbits of the pins. While the solenoid-operated actuators are keeping the pins retracted into the through-holes, the reeds are spaced from the outer surface of the cylinder, and any reed is not plucked. When the controlling circuit energizes a solenoid-operated actuator, the solenoid-operated actuator makes the associated pin project from the through-hole, and the pin plucks the associated reed.

A user is assumed to request the automatic player to perform a piece of music, the controlling circuit searches the data storage for a set of pieces of music data, and sequentially supplies the driving current to the solenoid-operated actuators in accordance with the pieces of music data. The solenoid-operated actuators project pins and retract the pins so that the reeds are selectively plucked for generating the tones along the piece of music. If the user requests the automatic player to perform another piece of music, the controlling circuit changes the sequence of the solenoid-operated actuators to be energized, and the pins plucks the reeds in the different order. This music box is hereinafter referred to as "second prior art music box".

Yet another music box selectively performing pieces of music on demand is also broken down into a tone generator and an automatic player. The tone generator is also implemented by an array of reeds. The reeds are arranged in a single row on a virtual straight line. A plurality of driving units form in combination the automatic player together with a controller, and give rise to vibrations in the associated reeds, respectively. Each of the driving unit includes a solenoid-operated actuator, an arm and a variable rod. The arm is rotatably supported by a frame, and is engaged with the solenoid-operated actuator and variable rod at different portions. When the solenoid-operated actuator is energized, the arm is driven for rotation, and pushes down the variable rod. Then, the reed is warped. The variable rod laterally escapes from the reed, and the reed starts to vibrate for generating the tone. The variable rod returns to the initial position, and gets ready to push the reed, again. Thus, the variable rod does not interfere with the vibrations in the associated reed. The sequence of the solenoid-operated actuators to be energized is changeable so that the automatic player selectively performs pieces of music without change of the component parts. This music box is hereinafter referred to as "third prior art music box".

Still another music box selectively performing pieces of music on demand comprises a comb and an automatic player The teeth of the comb are arranged in a single row on a virtual straight line, and are vibratory at different pitches. The automatic player includes star wheels respectively associated with the teeth, a solenoid-operated actuator, a conveyer and a controlling circuit. The solenoid-operated actuator is attached to the conveyer, and the conveyer moves the solenoid-operated actuator in a direction parallel to the row of the teeth. The star wheels are selectively driven for rotation by the solenoid-operated actuator, and pluck the associated teeth for generating the tones. When the user requests the automatic player to perform a piece of music, controlling circuit starts the conveyer quickly to move the solenoid-operated actuator. The controlling circuit sequentially stops the solenoid-operated actuator at the star wheels associated with the teeth to be plucked, and energizes the solenoid-operated actuator. The solenoid-operated actuator gives rise to the rotation of the selected star wheels so that the star wheels pluck the associated teeth for generating the tones. This music box is hereinafter referred to as "fourth prior art music box".

However, the flowing problems are encountered in those prior art music boxes. The first prior art music box is bulky. This is because of the fact that the automatic player requires a lot of rotatably supported hammers equal in number to the reeds for generating the tones. Moreover, it is difficult to concurrently drive more than one hammer for a chord.

The second prior art music box can merely perform several pieces of music. The through-holes formed in the cylinder and the rotating speed set the limit on the pieces of music to be performed. The controller can change the sequence of the pins to be driven from a combination of the through-holes to another combination of the through-hole. Another problem inherent in the second prior art music box is poor design flexibility. The relative position between the array of reeds and the rotational cylinder is hardly changed so that the designer merely modifies the other parts. Yet another problem inherent in the second prior art music box is poor durability. The solenoid-operated actuators and pins are complicatedly accommodated in the narrow inner space defined in the rotational cylinder. The complicated mechanism is liable to have troubles. The users can not cope with the mechanical troubles, and are discarded without repair.

The third prior art music box is also bulky, and the tones are not clear. These problems are derived from the action of the variable rods. When the automatic player generates a tone, the variable rod is pushed downwardly so as to warp the reed. When the variable rod escapes from the warped reed, the reed vibrates. In order to permit the variable rods, which are equal in number to the reeds, to escape from the reeds and return to the initial positions, hollow space is required in the vicinity of the reeds. The hollow space makes the third prior art music box bulky. The vibrations take place at the escape of the variable rod. In other words, the reeds start the vibrations from the warped state. This is unnatural, and the tones are less clear.

The fourth prior art music box is also bulky. The conveyer is required for moving the solenoid-operated actuator along the array of teeth, and a suitable mechanism is further required for making the star wheels to the initial positions. These components occupy wide space, and makes the fourth prior art music box bulky.

SUMMARY OF THE INVENTION

It is therefore an important object of the present invention to provide a compact musical instrument, which is equipped with an automatic player for selectively performing pieces of music.

It is also an important object of the present invention to provide a musical instrument, which is equipped with an automatic player with a simple structure for performing a piece of music.

It is another important object of the present invention to provide a musical instrument, which is equipped with an automatic player for generating clear tones.

In accordance with one aspect of the present invention, there is provided a musical instrument comprising a tone generator having vibratory members radially arranged with respect to a center of the tone generator, and an automatic player selectively generating vibrations of said vibratory members for producing tones different in pitch from one another through the vibrations and including player's fingers arranged in the proximity of outer ends of the vibratory members and a controller connected to the player's fingers for selectively actuating the player's fingers on the basis of pieces of music data variable without changing a physical structure of the controller.

In accordance with another aspect of the present invention, there is provided a musical instrument comprising a tone generator having an array of vibratory members for generating tones different in pitch from one another through vibrations and an automatic player including player's fingers for selectively generating the vibrations in the vibratory members and a controller connected to the player's fingers for selectively actuating the player's fingers on the basis of pieces of music data variable without changing a physical structure of the controller, and each of the player's fingers has a rotary vibration generator rotatably supported by a stationary member in the proximity of associated one of the vibratory members for generating the vibrations through rotation thereof and an actuator connected to the controller and selectively energized by the controller for rotating the rotary vibration generator.

In accordance with yet another aspect of the present invention, there is provided a musical instrument comprising a tone generator having an array of vibratory members for generating tones different in pitch from one another through vibrations and an automatic player including player's fingers for selectively generating the vibrations in the vibratory members and a controller connected to the player's fingers for selectively actuating the player's fingers on the basis of pieces of music data variable without changing a physical structure of the controller, and each of the player's fingers includes a vibration generator moved from a rest position along a first path for generating the vibrations in associated one of the vibratory members and a second path for returning to the rest position, an actuator connected to the controller and moving the vibration generator along the first path and the second path and a route changer connected to the vibration generator for guiding the vibration generator to the second path after generating the vibrations so as to permit the associated vibratory member to freely vibrate without any interference due to the vibration generator passing beside the associated vibratory member along the second path.

BRIEF DESCRIPTION OF THE DRAWINGS

The features and advantages of the musical instrument with the automatic player will be more clearly understood from the following description taken in conjunction with the accompanying drawings, in which.

DESCRIPTION OF THE PREFERRED EMBODIMENTS

First Embodiment

Prototype

Figure 1A:
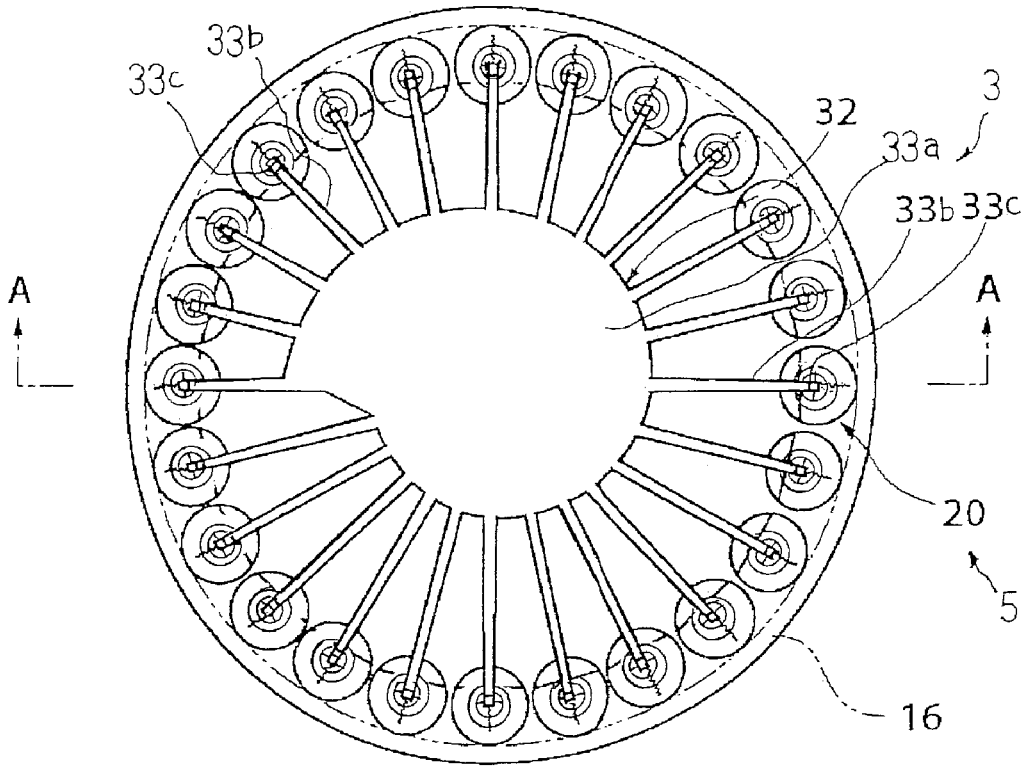
FIG. 1A is a schematic plane view showing the layout of a tone generator and an automatic player incorporated in a music box according to the present invention.
Figure 1B:
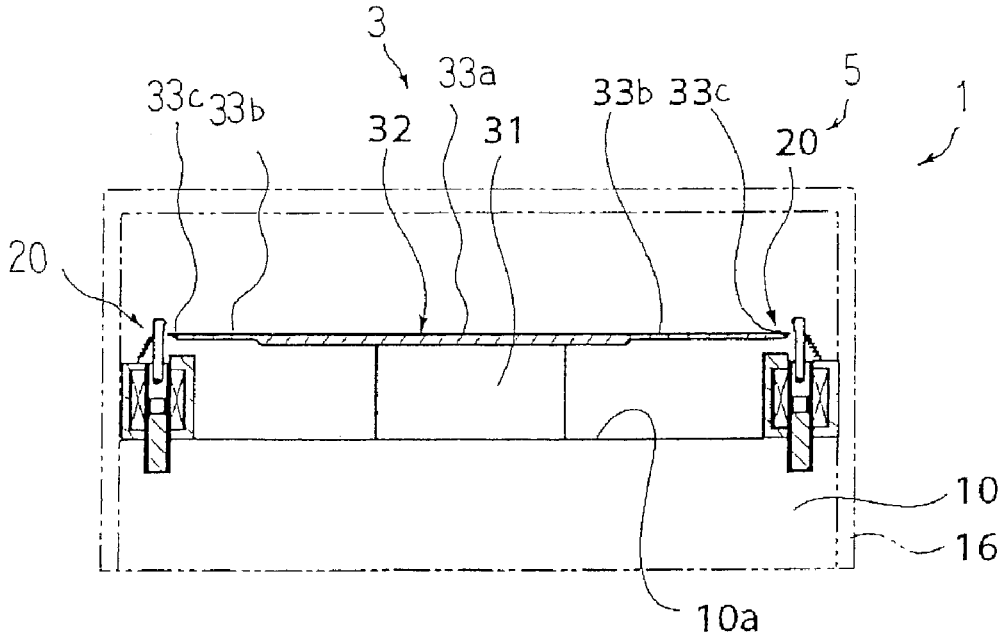
FIG. 1B is a cross sectional view taken along line A—A of FIG. 1A and showing the structure of the music box.

Referring to FIGS. 1A and 1B of the drawings, a music box embodying the present invention largely comprises a housing 1, a tone generator 3 and an automatic player 5. A hollow space is defined in the housing 1, and the tone generator 3 and automatic player 5 are placed inside the housing 1. The tone generator 3 occupies a central zone of the hollow space, and the automatic player 5 is disposed in the peripheral zone of the hollow space, i.e., around the tone generator 3. The automatic player 5 drives the tone generator without changing its position so that any additional space is not required for the automatic player. This results in the compact music box.

In the following description, a direction from the central zone toward the peripheral zone is "outward direction", and a direction from the peripheral zone to the central zone is "inward direction".

A bottom disk 10 and a cap 16 form in combination the housing 1. The cap 16 defines a recess, and the depth of the recess is greater than the thickness of the bottom desk 10. For this reason, when the cap 16 and bottom disk 10 are assembled into the housing 1, the inner space takes place in the housing 1, and the tone generator 3 and the automatic player 5 are accommodated therein.

The tone generator 3 includes a pedestal 31 and a daisy reed wheel 32. The pedestal 31 has a column shape, and is upright on the central area of the upper surface of the bottom disk 10. The daisy reed wheel 32 has a boss portion 33*a* and reeds 33*b*. The boss portion 33*a* is fixed to the upper surface of the pedestal 31, and is horizontally maintained. The reeds 33*b* radially project from the periphery of the boss portion 33*a*, and reach the boundary between the central zone and the peripheral zone. In this instance, twenty-four reeds 33*b* project from the boss portion 33*a* at regular intervals. Although the reeds 33*b* are different in length and width from one another, the tips 33*c* of the reeds 33*b* reaches a virtual circle concentric with the boss portion 33*a*. This means that the boss portion 33*a* has the radius increased together with the angle. For this reason, the periphery of the boss portion 33*a* is like an involute line. The reeds 33*b* are vibratory at predetermined values of the frequency so that the vibrating reeds 33*b* generate the tones of a scale, respectively.

The daisy reed wheel 32 is desirably for the automatic player 5, because the tips 33*c* are widely spaced from one another along the boundary between the central zone and the peripheral zone. The automatic player 5 includes player's fingers 20, which are provided around the daisy reed wheel 32 at regular intervals. The player's fingers 20 are respectively associated with the reeds 33*b*, and are selectively energized for plucking the reeds 33*b*. In this instance, twenty-four player's fingers 20 are disposed on the bottom disk 10. Since the tips 33*c* are widely spaced, a wide local space is assigned to each of the player's fingers 20. When the player's fingers 20 pluck the associated reeds 33*b*, the reeds 33*b* vibrate for generating the tones. Thus, the automatic player 5 performs a piece of music or a passage of the piece of music.

Figure 2A:
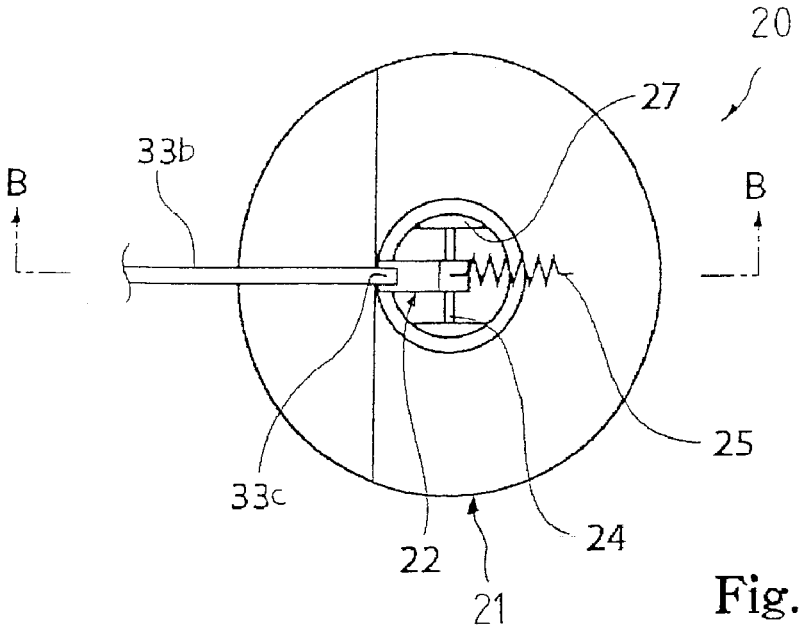
FIG. 2A is a plane view showing a reed and a player's finger of an automatic player incorporated in the music box.
Figure 2B:
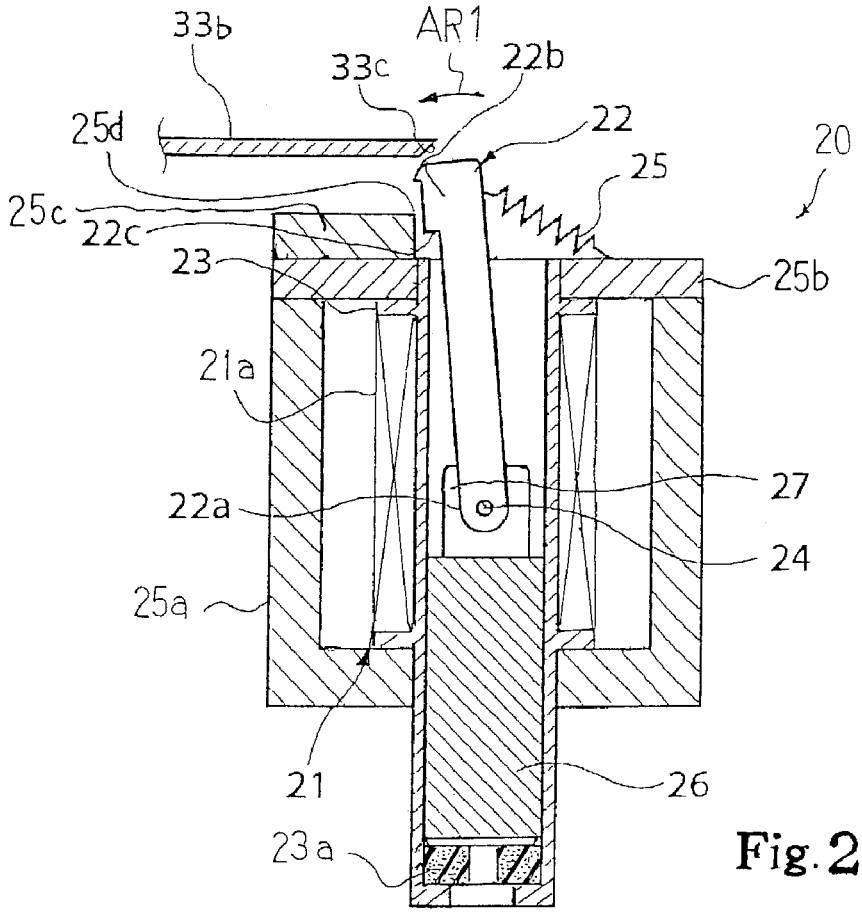
FIG. 2B is a cross sectional view taken along line B—B and showing the structure of the player's finger.
Figure 3:
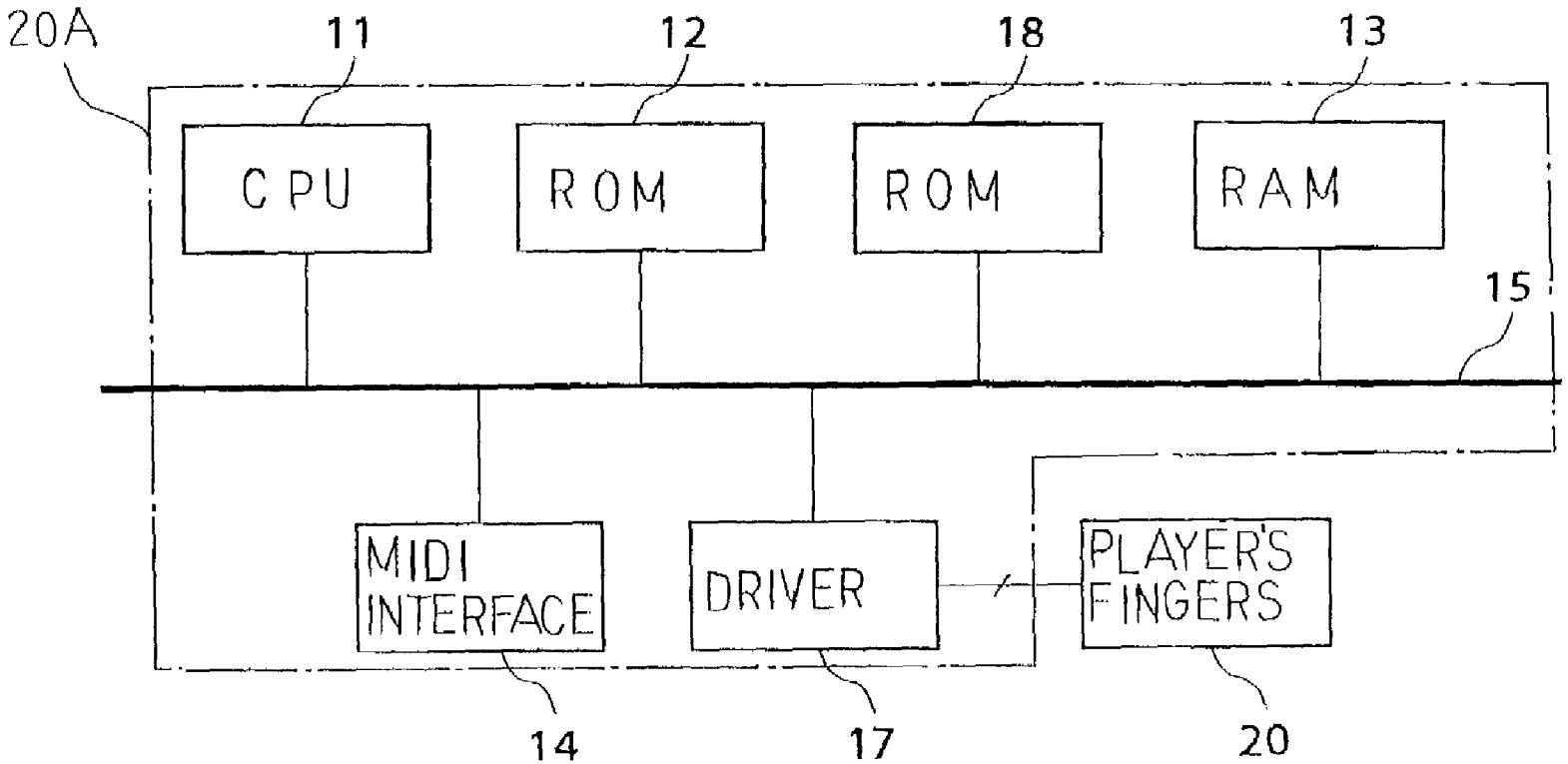
FIG. 3 is a block diagram showing the system configuration of a controller.

Turning to FIGS. 2A, 2B and 3, the automatic player 5 includes the player's fingers 20 and a controller 20A. The player's fingers 20 are similar in structure to one another, and one of the player's fingers 20 is hereinafter described in detail with reference to FIGS. 2A and 2B. The controller 20A is connected to the player's fingers 20 in parallel, and selectively supplies driving current to the player's fingers 20.

The player's finger 20 is broken down into a solenoid-operated actuator 21, a pick 22 and a spring 25. The solenoid-operated actuator 21 is supported by a bottom yoke 25*a*, which in turn is supported by the bottom disk 10, and the pick 22 is mounted on the solenoid-operated actuator 21. The spring 25 is connected between the pick 22 and the bottom yoke 25*a*, and urges the pick 22 outwardly.

A coil 21*a*, a bobbin 23, a cushion sheet 23, a top yoke 25*b*, an additional yoke 25*c* and a plunger 26 form in combination the solenoid-operated actuator 21. The bobbin 23 has a cylindrical configuration, and the cushion sheet 23*a* is provided at the bottom of the inner space of the bobbin 23. The coil 21 is wound on the outer surface of the bobbin 23, and the plunger 26 is slidably received in the inner space of the bobbin 23. The bottom yoke 25 has an inner portion slightly projecting, and forms an offset yoke structure. When current flows through the coil 21*a*, the current creates a magnetic field across the bobbin 23. The bobbin 23 and bottom yoke 25*a* offer a magnetic path to the electric field. The bottom yoke 25*a* has the inner portion projecting from the outer portion so that the magnetic field is asymmetrically developed. For this reason, the picks 22 are urged inwardly as indicated by arrow AR1, and the plunger 26 upwardly projects from the bobbin 23. The inwardly inclined pick 22 is brought into contact with the tip 33*c* of the associated reed 33*b*. If the magnetic field is removed, then the plunger 26 is retracted into the bobbin 23, and is landed on the cushion sheet 23*a*. The cushion sheet 23*a* prevents the plunger 26 from dropping out.

The plunger 26 is formed with a pair of wall portions 27. The wall portions 27 are upright on the upper surface of the plunger 26, and are spaced from each other in parallel to the associated reed 33*b*. A pin 24 is fixed at both ends thereof to the wall portions 27 in such a manner as to be perpendicular to the longitudinal direction of the associated reed 33*b*, and the pick 22 is rotatably connected at the lower portion 22*a* thereof to the pin 24. The pick 22 is a thin narrow plate of soft magnetic material, and is rotatable about the pin 24. The extension line of the centerline of the associated reed 33*b* is on the trajectory of the pick 22. The pick 22 has an upper end portion 22*b*, which is wider than the lower end portion 22*a* so that a step 22*c* is formed at the boundary between the upper end portion 22*b* and the lower end portion 22*a*. The upper end portion 22*b* has a rounded end surface. On the other hand, the tip 33*c* of the reed 33*b* is tapered. While the plunger 26 is projecting from the bobbin 23, the rounded end surface is brought into contact with the tapered tip 33*c*, and makes the reed 33*b* warped.

The spring 25 is connected at one end thereof to the upper portion of the pick 22 and at the other end thereof to the upper surface of the bottom yoke 25*a*. While the plunger 26 is resting in the bobbin 23, the spring 25 is almost in its free length, and a negligible amount of elastic force is exerted on the pick 22. The spring 25 increases the elastic force together with the distance between the pick 22 and the bottom yoke 25*a*, and urges the pick 22 outwardly. As described hereinbefore, when the current starts to flow through the coil 21*a*, the magnetic force makes the pick 22 inwardly inclined. The magnetic force is larger than the elastic force of the spring 25 in the initial stage where the pick 22 warps the reed 33*b*. When the step 22*c* exceeds the upper end of the bottom yoke 25*a*, the space between the pick 22 and the coil 21*a* is so wide that the magnetic force is equalized to the elastic force. The plunger 26 further projects upwardly, and the step 22*c* is spaced from the upper end 25*d*. Then, the elastic force becomes larger than the magnetic force, and the pick 22 escapes from the reed 33*b*. Then, the reed 33*b* vibrates for generating the tone. While the plunger 26 is being retracted into the bobbin 23, the spring 25 keeps the pick 22 inclined outwardly. Thus, the spring 25 prevents the pick 22 from chattering.

Figure 4A:
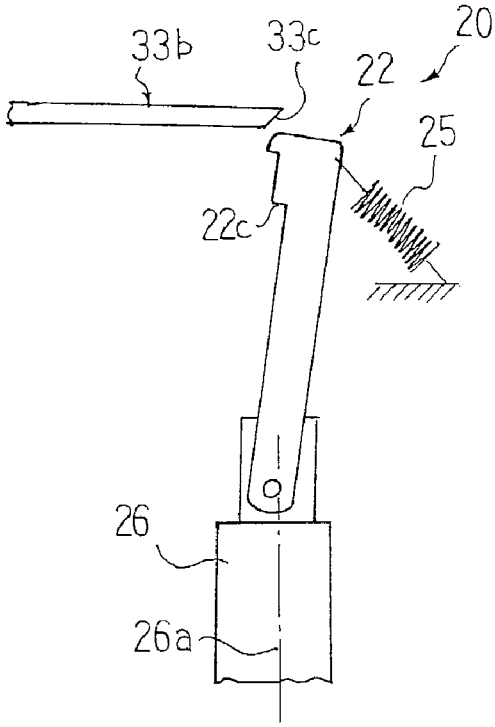
FIGS. 4A to 4C are schematic views showing the player's finger plucking the associated reed.

The player's finger 20 behaves for plucking the associated reed 33*b* as follows. The controller 20A is assumed to have already removed the magnetic field from the player's finger 20. The pick 22 is outwardly inclined with respect to the centerline 26*a* of the plunger 26, and the rounded upper end portion 22*b* is spaced from the tapered tip 33*c* as shown in FIG. 4A.

Figure 4B:
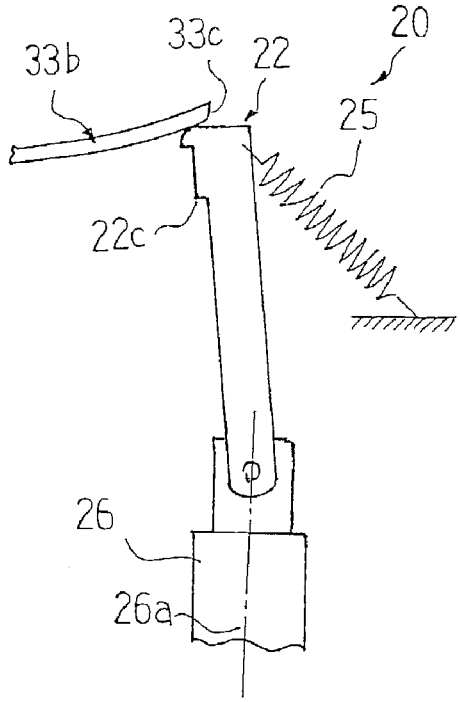
Figure 4C:
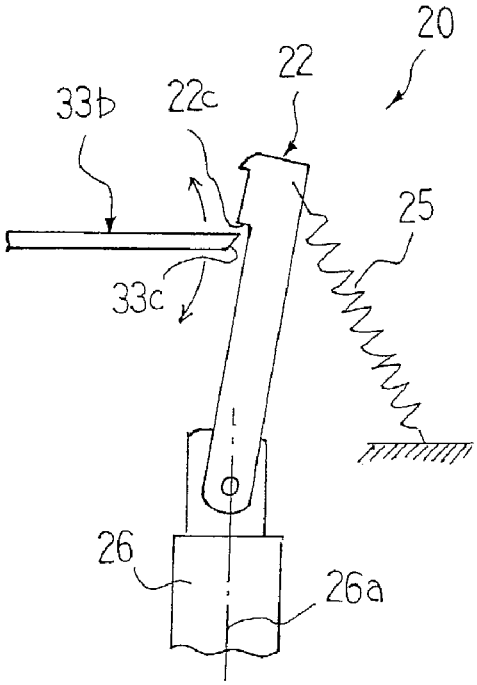
Figure 5:
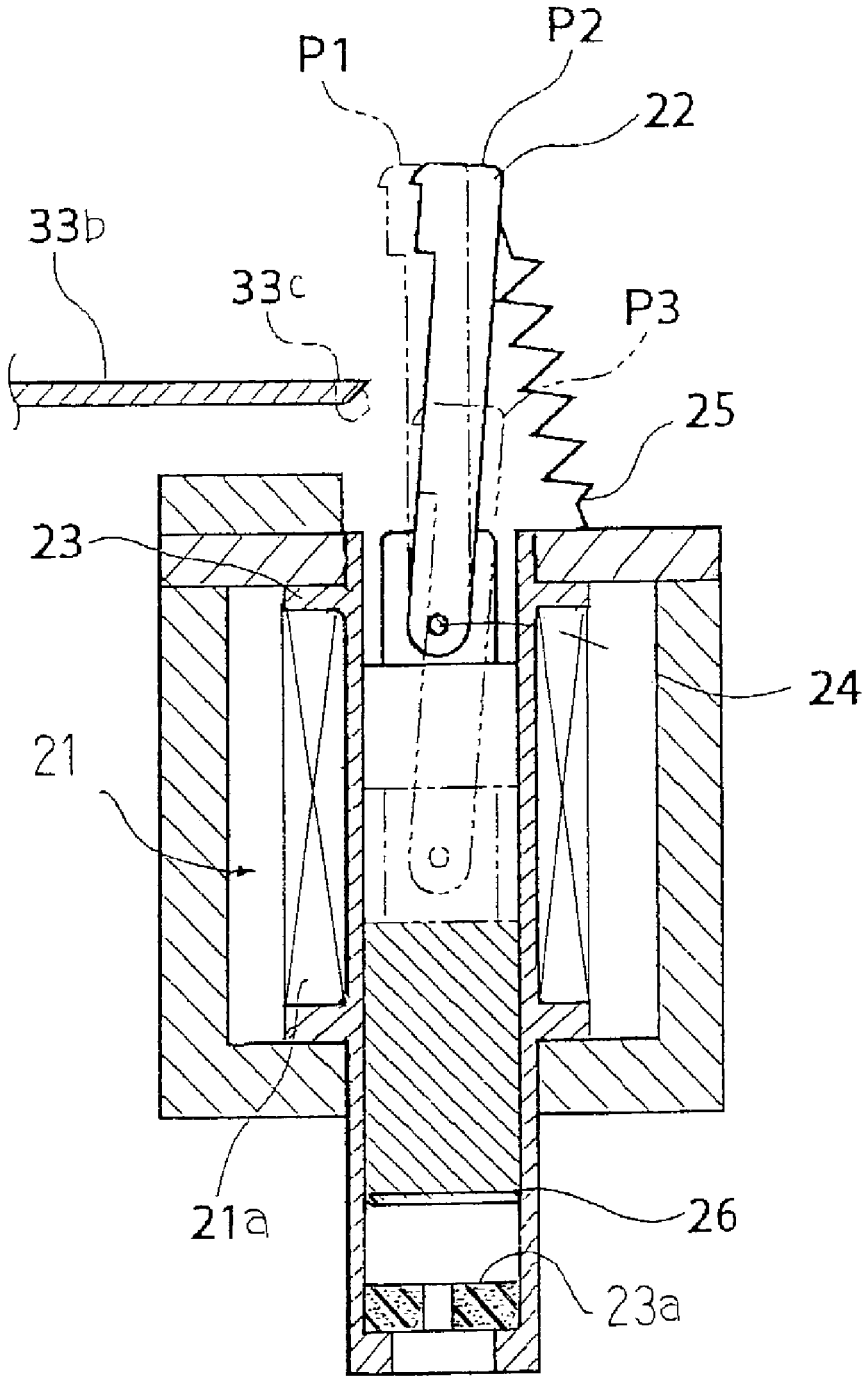
FIG. 5 is a cross sectional view showing the player's finger after the plucking.

When the current flows through the coil 21*a*, the pick 22 is inwardly inclined, and the plunger 26 starts to upwardly project against the elastic force of the string 25. The plunger 26 is brought into contact with the tapered tip 33*c*, and pushes the reed 33*b* upwardly. Although the expanded spring 25 increases the elastic force exerted on the pick 22, the magnetic force is still larger than the elastic force so that the pick 22 makes the reed 33*b* warped as shown in FIG. 4B.

The plunger 26 further projects form the bobbin 23, and the pick 22 becomes far from the coil 21*a*. When the magnetic force becomes smaller than the elastic force, the spring 25 pulls the pick 22 outwardly, and the pick 22 escapes from the reed 33*b*. Then, the reed 33*b* starts the vibrations, and generates the tone. The other player's fingers 20 behave along the above-described sequence so as to pluck the associated reeds 33*b*.

Turning to FIG. 3 of the drawings, the controller 20A includes a central processing unit 11, which is abbreviated as "CPU", read only memories 12/18, which are abbreviated as "ROM"s, a random access memory 12, which is abbreviated as "RAM", an MIDI (Musical Instrument Digital Interface) interface 14 and a driver circuit 17. These system components 11, 12, 13, 14, 17 and 18 are connected to a bus system 15 so that the central processing unit 11 is communicable with the other system components through the bus system 15. The driver circuit 17 is connected to the player's fingers 20 through a suitable cable, and selectively supplies the driving current to the player's fingers 20.

Computer programs and data codes to be required for the execution of the computer programs are stored in the read only memory 12, and the central processing system sequentially executes the instruction codes for achieving given tasks. The random access memory 13 serves as a working memory and a data storage for music data codes representative of pieces of music. The central processing unit 11 is further communicable with external musical instruments and a computer system through the MIDI interface 14. A set of MIDI music data code representative of a piece of music may be supplied from an external data source to the MIDI interface 14, and the central processing unit 11 stores the set of MIDI music data codes into the random access memory 13 for a performance on the daisy reed wheel 32.

The read only memory 18 offers a data storage facility for parameters, and the central processing unit 11 accesses the parameters during the execution of the given computer program.

Assuming now that a user instructs the automatic player 5 to perform a piece of music represented by a set of MIDI music data codes on the daisy reed wheel 32. The set of MIDI music data codes has been already stored in the random access memory 13. As well known to skilled person, event codes and duration codes form essential parts of the set of MIDI music data codes. The tones to be generated and the loudness of the tones are represented by the event codes, and each duration data code is indicative of a time interval between the event or events, i.e., note-on event/note-off event and the next event.

The central processing unit 11 executes a computer program so as to determine the reeds 33*b* to be driven for vibrations, the timing to supply a driving signal to the associated player's fingers 20 and the magnitude of the driving signal as follows. While the central processing unit 11 sequentially fetches the MIDI music data codes from the random access memory 13, an event code just fetched by the central processing unit 11 is assumed to represent the note-on event for generating a tone. The central processing unit 11 specifies one of the reeds 33*b*. The central processing unit 11 accesses the parameters and data codes stored in the read only memories 12/18, and determines the magnitude of the driving signal for generating the tone at the given loudness.

When the time at which the tone is to be generated comes, the central processing unit 11 supplies data codes representative of the position assigned to the player's finger to be energized and the magnitude of the driving signal to be supplied to the driver circuit 17. Then, the driver circuit 17 sets the driving signal to the magnitude, and supplies the driving signal to the solenoid-operated actuator 21 incorporated in the player's finger 20. The solenoid-operated actuator 21 maintains the pick 22 at the rest position P3. When the driving signal reaches the coil 21*a*, the current creates the magnetic field across the bobbin 23. The magnetic force is exerted on the pick 22 as well as the plunger 26. The pick 22 is inclined toward the tip 33*c* of the associated reed 33*b* against the elastic force of the spring 25, and the plunger 26 upwardly projects. The pick 22 upwardly pushes the tip 33*c* of the reed 33*b* so that the reed 33*b* is warped.

Though not shown in FIG. 3, the driver circuit 17 includes a pulse width modulator. The pulse width modulator incorporated in the driver circuit 17 controls the loudness of the tones to be produced through the vibrations of the reeds 33*b*. The central processing unit 11 is assumed to instruct the driver circuit 17 to supply the driving signal for generating a loud tone. The pulse width modulator increases the pulse width of the driving signal, and supplies it to the solenoid-operated actuator associated with the reed 33*b* to be plucked. When the driving signal reaches the coil 21*a*, a large amount of current flows, and creates a strong magnetic field. The pick 22 is strongly attracted to the inner portion of the additional yoke 25*d*, and the plunger upwardly projects from the bobbin 23 powerfully. The magnetic force is so large that the spring can not outwardly incline the pick 22 as usual. Thus, the driving signal with the wide pulse width results in the strong attractive force exerted on the pick 22 as well as the speed-up of the plunger 26. For this reason, the pick 22 makes the reed 33*b* widely warped. However, the elastic force exceeds the magnetic force later than usual. Then, the pick 22 escapes from the tapered tip 33*c*, and permits the reed 33*b* to vibrate. The escape is later than the usual escape is. This means that the reed 33*b* is widely warped, and the amplitude of the vibrations is wider than the amplitude of the usual vibrations. This results in the loud tone.

When the elastic force exceeds the magnetic force, the spring 25 pulls the pick 22 outwardly, and the pick 22 escapes from the reed 33*b*. The pick 22 plucks the reed 33*b* so that the reed 33*b* naturally vibrates. The clear tone is generated through the naturally vibrating reed 33*b*. Upon escape, the pick 22 is changed to position P1.

The driving circuit 17 removes the driving signal from the solenoid-operated actuator 21. Then, the plunger 26 is retracted due to the self-weight and the elastic force of the spring 25, and the spring 25 outwardly inclines the pick 22 as indicated by P2. The cushion sheet 23*a* receives the plunger 26. While the plunger 26 is sinking together with the pick 22, the pick 22 never interferes with the vibrating reed 33*b*, because the spring 25 keeps the pick 22 outwardly inclined. In order to prevent the vibrating reed 33*b* from interference, the spring 25 slightly inclines the pick 22 so that the additional space to be required is negligible. Thus, the music box implementing the first embodiment is made compact by virtue of the radial arrangement of the reeds 33*b* and the picks 22 outwardly inclined.

As will be understood from the foregoing description, the daisy reed wheel 32 occupies the central zone of the inner space defined in the housing 1, and the reeds 33*b* radially extend from the boss portion 33*a*. This feature is desirable, because the automatic player 5 occupies the wide peripheral zone around the tips 33*c* of the reeds 33*b*. Thus, the tone generator 3 and automatic player 5 do not waste the inner space. This results in the compact music box.

Moreover, the tips 33*c* are widely spaced so that the wide local spaces are assigned to the player's fingers 20. The player's fingers 20 require the actuators 21 for plucking the reeds 33*b*. The designer can install large-sized actuators in the wide local spaces so that the player's fingers 20 perform a piece of music at a high tempo. The designer can further install the strong picks 22 on the large-sized plungers 26. Thus, the music box is durable.

Yet another advantage is resulted from the pick's action. The picks 22 upwardly push the tips 33*c* of the associated reeds 33*b*, and, thereafter, escape from the tips 33*c* outwardly. The picks 22 pluck the associated reeds 33*b* as if a human player plucks strings or reeds with his or her fingers. Thus, the picks 20 naturally give rise to vibrations of the reeds 33*b*. This results in clear tones.

Still another advantage is also resulted from the pick's action after the plucking. The springs 25 elastically pull the picks 22, and the picks 22 are outwardly inclined. The outwardly inclined picks 22 return to the initial positions without interference with the vibrating reeds 33*b*. Only a small amount of space is required for the outwardly inclined picks 22. Thus, the pick's action is conducive to the compactness of the music box.

The solenoid-operated actuators 21 are independently controlled by the controller 20A. This means that the controller 20A can concurrently energize more than one solenoid-operated actuator 21. Thus, the automatic player 5 can play a piece of music along the melody accompanied with chords.

The controller 20A sequentially energizes the solenoid-operated actuators 21 on the basis of the music data, and the user arbitrarily changes the music data. Thus, the music box is responsive to any user's request for performing tunes.

Several Models of Music Box

Figure 6A:
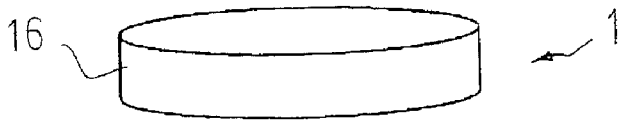
FIGS. 6A to 6D are perspective views showing the external appearance of the music box and modifications thereof.
Figure 6B:
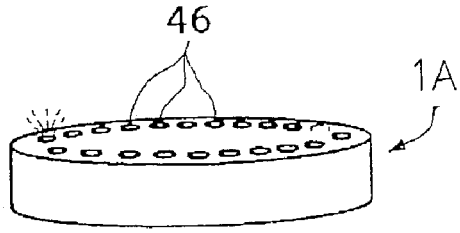

Various modifications of the music box implementing the first embodiment are hereinafter described in detail. FIG. 6A shows the external appearance of the music box described hereinbefore. The first modification has a casing 1A, and light-emitting diodes 46 are provided along the periphery of the upper surface of the casing as shown in FIG. 6B. The light-emitting diodes 46 are respectively associated with the reeds 33*b*, and are connected in parallel to the controller 20A. The controller 20A energizes the light-emitting diodes 46 concurrently with the solenoid-operated actuators 21 for the reeds 33*b* to be plucked. Thus, the tones are harmonized with the light.

Figure 6C:
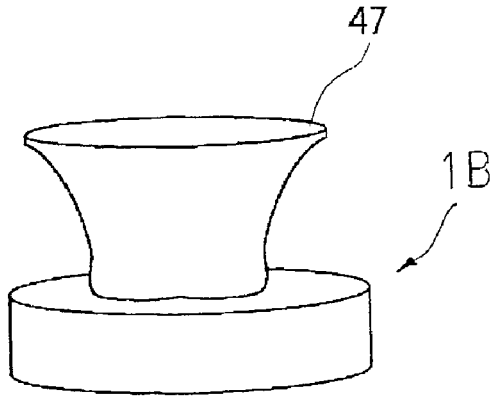
Figure 6D:
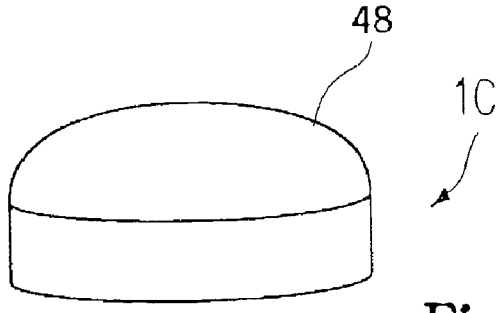

The second modification has a casing 1B, on which a megaphone 47 is provided as shown in FIG. 6C. The megaphone 47 makes the tones loud. The third modification has a casing 1C provided with the light-emitting diodes like the casing 1A of the first modification. A semi-transparent cupola 48 is attached to the casing 1C as shown in FIG. 6D. The semi-transparent cupola 48 disperses the light, and gives fantastic impression. An illumination system may be provided inside of the semi-transparent cupola 48 independently of the solenoid-operated actuators 21.

Multiple Music Box

The tone generator and automatic player may be multiplexed. FIG. 7A shows an example of the multiple music box according to the present invention. The multiple music box comprises plural performing units 41, a cylindrical post 42 and a resonator box 43. Each of the performing units 41 includes the daisy reed wheel 3 and the automatic player 5, which are similar to those of the music box described hereinbefore. A tone hole 43*a* is formed in the upper plate of the resonator box 43, and the resonator 43*b* is connected through the tone hole 43*a* to the column-shaped space 42*a* defined in the cylindrical post 42. Plural trays 42*b* project from the outer surface of the cylindrical post 42, and the performing units 41 are respectively mounted on the trays 42*b*.

Different registers are respectively assigned to the performing units 41 so that the multiple music box produces a piece of music in plural parts. The automatic players 5 of the plural performing units 41 are connected to the controller 20A, and the driver circuit 17 selectively supplies the driving signal to the solenoid-operated actuators 21. When the solenoid-operated actuators 21 are energized, the player's fingers 20 pluck the associated reeds with the picks 22. The tones and vibrations are propagated though the cylindrical post 42 to the resonator 43*b* so that the loud tones are radiated from the resonator box 43.

Figure 7B:
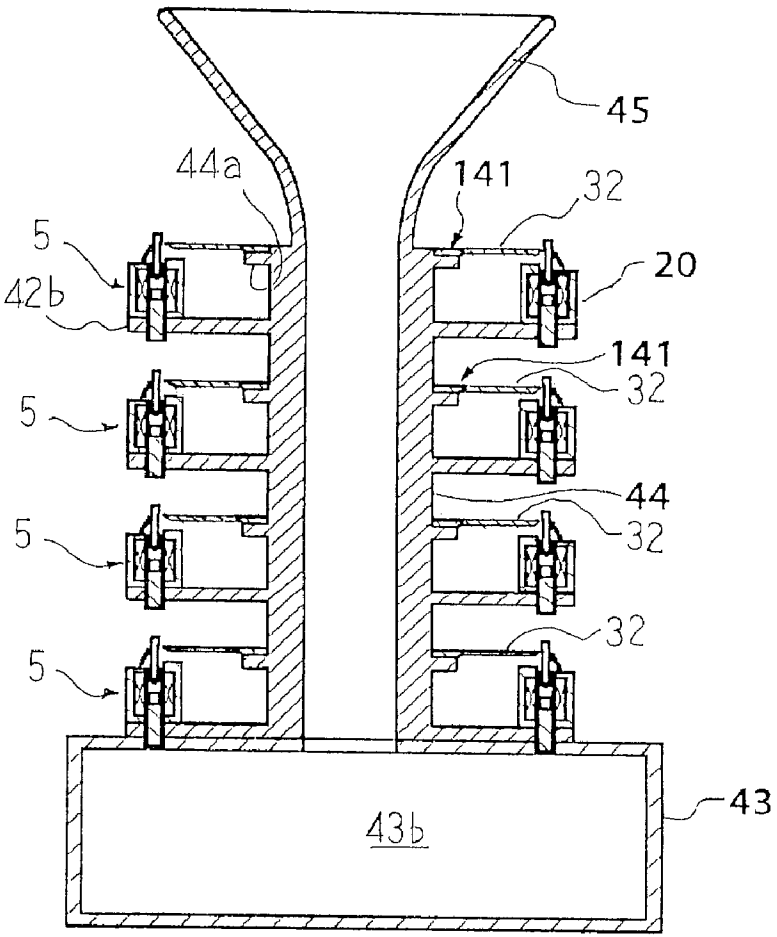
FIGS. 7A and 7B are cross sectional views showing other modifications of the music box implementing the first embodiment.
Figure 7A:
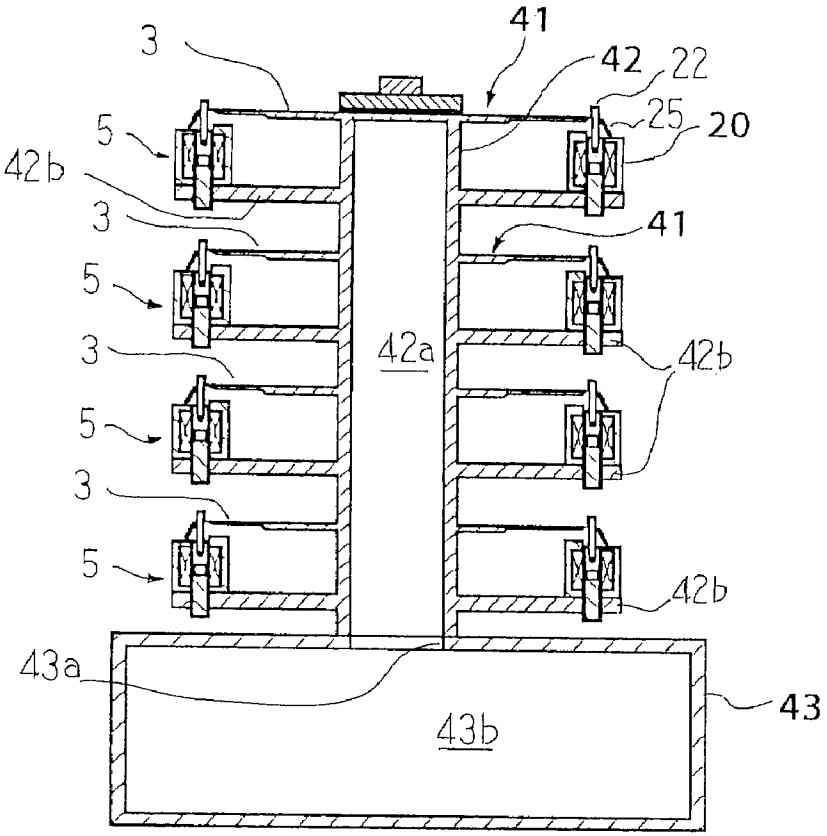

FIG. 7B shows another example of the multiple music box. The multiple music box comprises plural performing units 141, the resonator box 43 and a combined structure of cylindrical post and bell 44/45. The combined structure of cylindrical post and bell 44/45 is upright on the resonator box 43, and brims 44*a* are formed together with the trays 42*b*. Each of the performing units 141 has the daisy reed wheel 32 and the automatic player 5. The daisy reed wheels 32 are detachably connected to the brims 44*a*, and the resonator 43*b* is connected through the bell 45 to the air. The multiple music box produces loud tones, and the daisy reed wheels 32 are easily replaced with another daisy reed wheels.

Unitized Structure

Figure 8B:
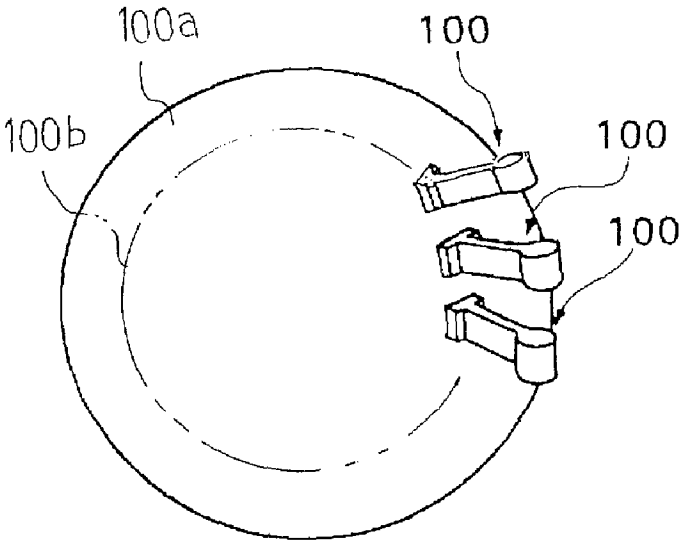
FIG. 8B is a schematic view showing the arrangement of the tone generating units.
Figure 8A:
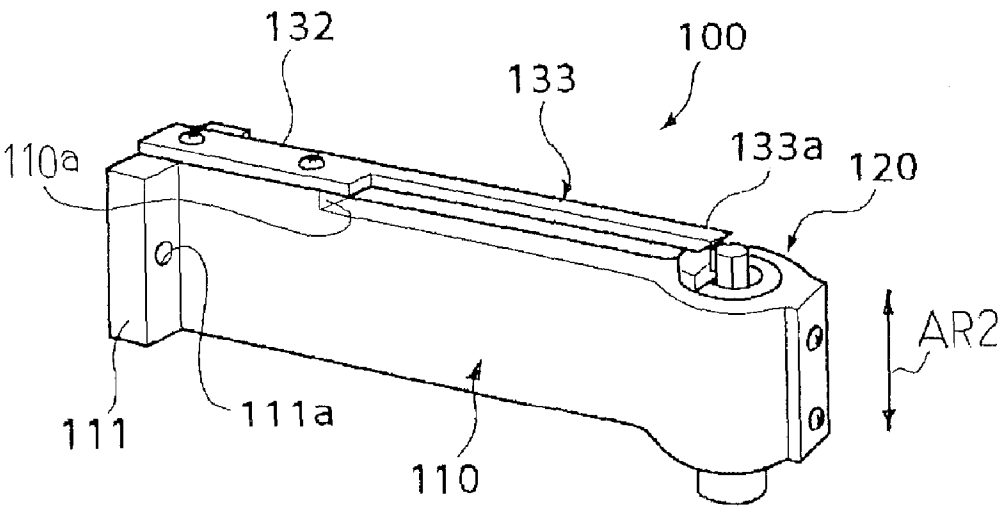
FIG. 8A is a perspective view showing the structure of a tone generating unit incorporated in another modification of the music box.

A reed and a player's finger may form a tone generating unit. In this instance, plural tone generating units may be arranged on a virtual circle. FIG. 8A shows an example of the tone generating unit 100. The tone generating unit 100 largely comprises a holder 110, a player's finger 120 and a reed 133. The player's finger 120 is similar in structure to the player's finger 20 so that no further description is hereinafter incorporated for the sake of simplicity.

The holder 110 is a generally rectangular parallelepiped configuration. A pair of flanges 111 is formed in one end portion, and a through-hole is formed in the other end portion. Bolt holes 11*a* are formed in the pair of flanges 111, and the player's finger 120 is received in the through-hole. The plunger is projectable and retractable in a direction indicated by arrow AR2. The one end portion is thicker than the other end portion so that a step 110*a* takes place at the boundary therebetween. The reed 133 is fixed to the one end portion by means of bolts. The boss portion 132 of the reed 133 is held in contact with the one end portion. However, the remaining portion of the reed is overhung like a cantilever. The tip 133*a* of the reed 133 is over the pick without physical contact as shown. When the solenoid-operated actuator is energized with the driving signal, the pick is inclined toward the tip 133*a*, and the plunger upwardly projects from the bobbin. The pick upwardly pushes the reed 133, and warps it. The pick escapes from the tip 133*a*, and permits the reed 133 to vibrate. The magnetic field is removed from the solenoid-operated actuator, and the plunger is retracted into the bobbin together with the pick. Thus, the player's finger behaves as similar to the player's finger 20.

The tone generating unit or units 100 are attached to any sort of frame. FIG. 8B shows the tone generating units 100 fixed to a disk 100*a*. The tone generating units 100 are arranged on a virtual circle 100*b*, and are fixed to the disk 100*a* by means of the screws. In this instance, the tone generating units 100 occupy an inner space between the disk 100*a* and an outer space assigned to the automatic player. Although the through-holes of the holders 110 are directed in the tangential directions of the virtual circle 100*b* on the disk 100*a*, the through-holes may be arbitrarily directed on another disk 100*a*.

The tone generating units 100 occupy a relatively narrow space, and a compact music box or musical instrument is realized with an array of tone generating units 100.

Stringed Instrument

The reeds do not set any limit on the musical instrument according to the present invention. Any sort of vibratory member is available for the musical instrument. Strings are one of the sorts of vibratory members.

Figure 9A:
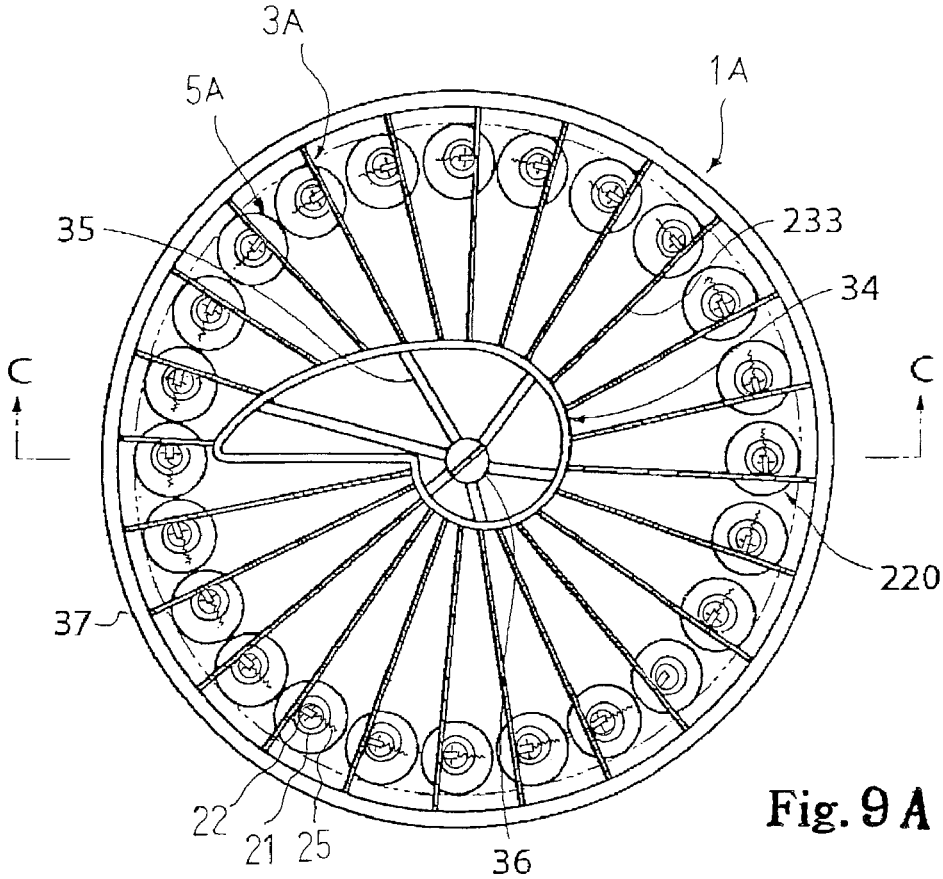
FIG. 9A is a plane view showing strings and automatic player incorporated in another modification of the music box.
Figure 9B:
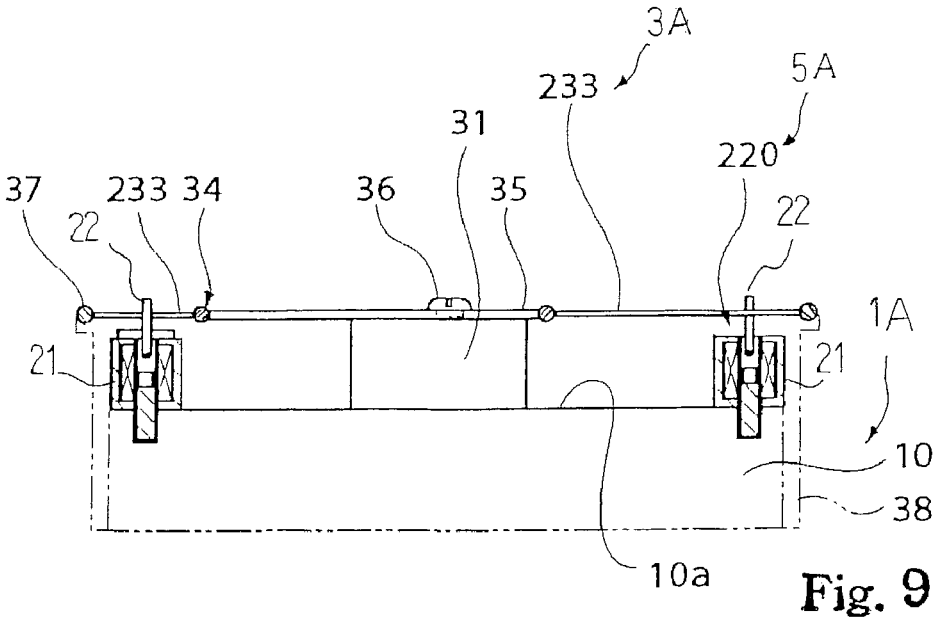
FIG. 9B is a cross sectional view taken along line C—C of FIG. 9A and showing the structure of the modification.

FIGS. 9A and 9B shows an example of the stringed instrument. The stringed instrument may serve as a part of a music box. The stringed instrument largely comprises a housing 1A, a tone generator 3A implemented by strings 233 and an automatic player 5A.

The housing 1A includes the bottom disk 10 and a cylindrical wall 38. The cylindrical wall 38 and bottom disk 10 are assembled into the housing, and define a space over the upper surface of the bottom disk 10. The tone generator 3A and automatic player 5A are accommodated in the space.

The tone generator 3A includes the pedestal 31, an inner frame 34, an outer frame 37 and strings 34 stretched between the inner frame 34 and the outer frame 37. The pedestal 31 is upright on the upper surface 10*a* of the bottom disk 10, and is fixed to the bottom disk 10. The inner frame 34 is made of metal or alloy. The inner frame 34 is reinforced with beams 35, and the distance between the center of the pedestal 31 and the periphery of the inner frame 34 is varied together with the angle. The frame 34 is horizontally disposed on the upper surface of the pedestal 31, and is fixed thereto by means of a bolt 36. The outer frame 37 is circular, and is fixed to the cylindrical wall 38. The distance between the inner frame 34 and the outer frame 37 is varied together with the angle. The strings 233 are stretched between the inner frame 34 and the outer frame 37, and are different in thickness and length for generating tones different in pitch from one another. In this instance, twenty-four strings 233 are incorporated in the tone generator 3A.

Since the strings 233 radially extend between the inner frame 34 and the outer frame 37 so that the strings 233 are spaced from the adjacent strings 233 at the outer ends wider than at the inner ends. Thus, the radial arrangement of the strings 233 offers wide local spaces to the automatic player 5A along the outer frame 37.

The automatic player 5A includes player's fingers 220 and a controller (not shown). The player's finger 220 is similar in structure to the player's finger 20, and a solenoid-operated actuator 21, a pick 22 and a spring 25 form parts of each player's finger 220. The player's fingers 220 are respectively associated with the strings 233, and each player's finger 220 is disposed on one side of the associated string 233.

When a user requests the automatic player 5A to perform a piece of music, the controller (not shown) selectively supplies the driving signal to the solenoid-operated actuators 21 associated with the strings 233 to be plucked. The picks 22 are inclined toward the associated strings 233, and the plungers upwardly project from the bobbins. The picks 22 push the strings 233 upwardly Then, the picks 22 escape from the associated strings 233, and permit the strings 233 to vibrate. The picks 22 are inclined toward the opposite sides of the associated strings 233. The controller removes the magnetic field from the solenoid-operated actuators 220. Then, the plungers are retracted into the bobbins, and the inclined picks 22 return to the rest positions without any interference with the vibrating reeds 33*b*.

It is preferable to pluck the strings 233 at which each string 233 is divided at 1:7. In this instance, the player's fingers 220 are located around the optimum positions. However, the player's fingers are just located at the respective optimum positions.

Second Embodiment

Prototype

Figure 10A:
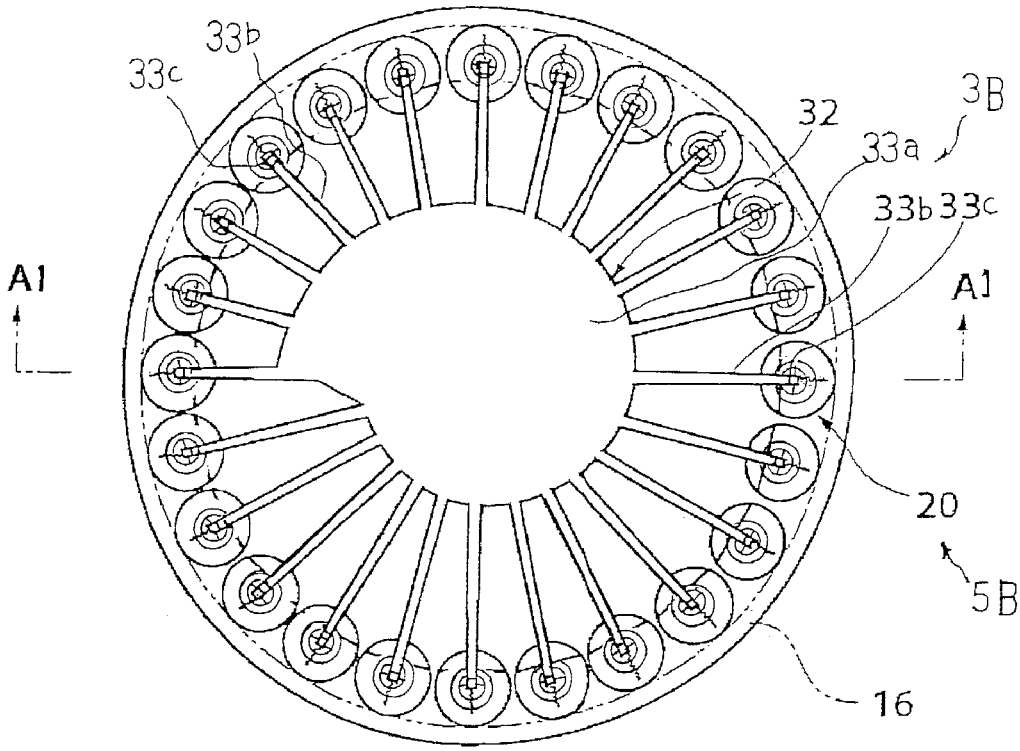
FIG. 10A is a schematic plane view showing the layout of a tone generator and an automatic player incorporated in a musical instrument according to the present invention.
Figure 10B:
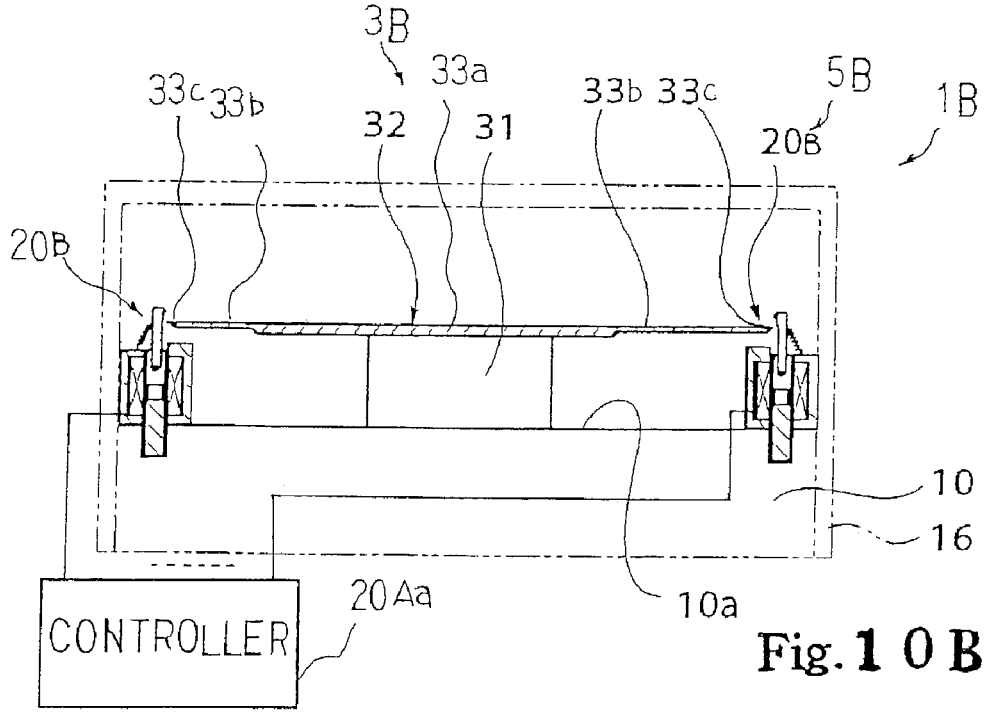
FIG. 10B is a cross sectional view taken along line A1—A1 of FIG. 10A and showing the structure of the music box.

FIGS. 10A and 10B show another musical instrument embodying the present invention. The musical instrument shown in FIGS. 10A and 10B is categorized in a music box. The musical instrument largely comprises a housing 1B, a tone generator 3B and an automatic player 5B. The housing 1B and tone generator 3B are similar in structure to the housing 1 and tone generator 3. For this reason, the component parts of the housing/tone generator 1/3 are labeled with the references designating the corresponding component parts of the housing/tone generator 1/3 without detailed description.

Figure 12:
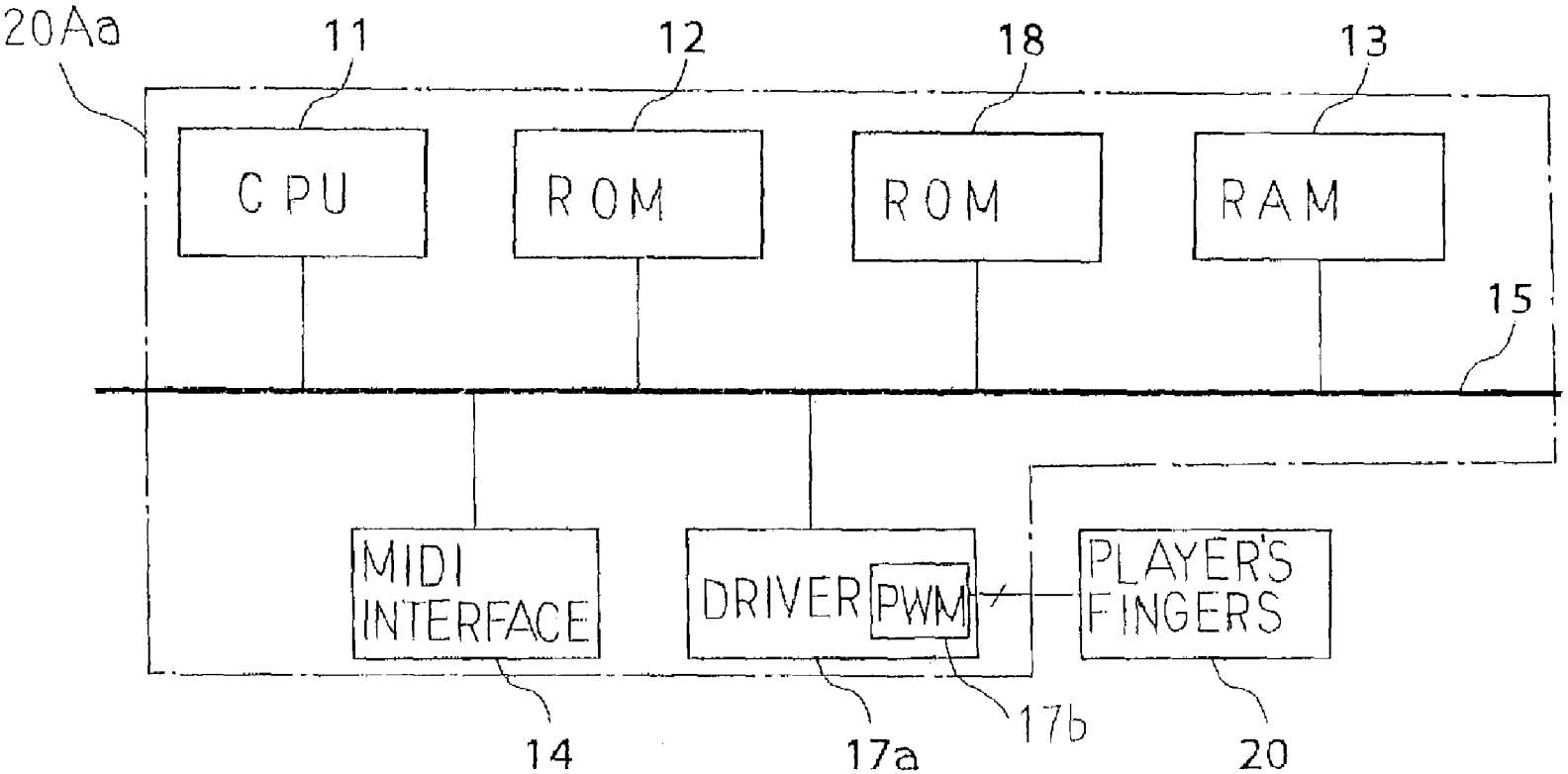
FIG. 12 is a block diagram showing the system configuration of a controller incorporated in the automatic player.
Figure 13:
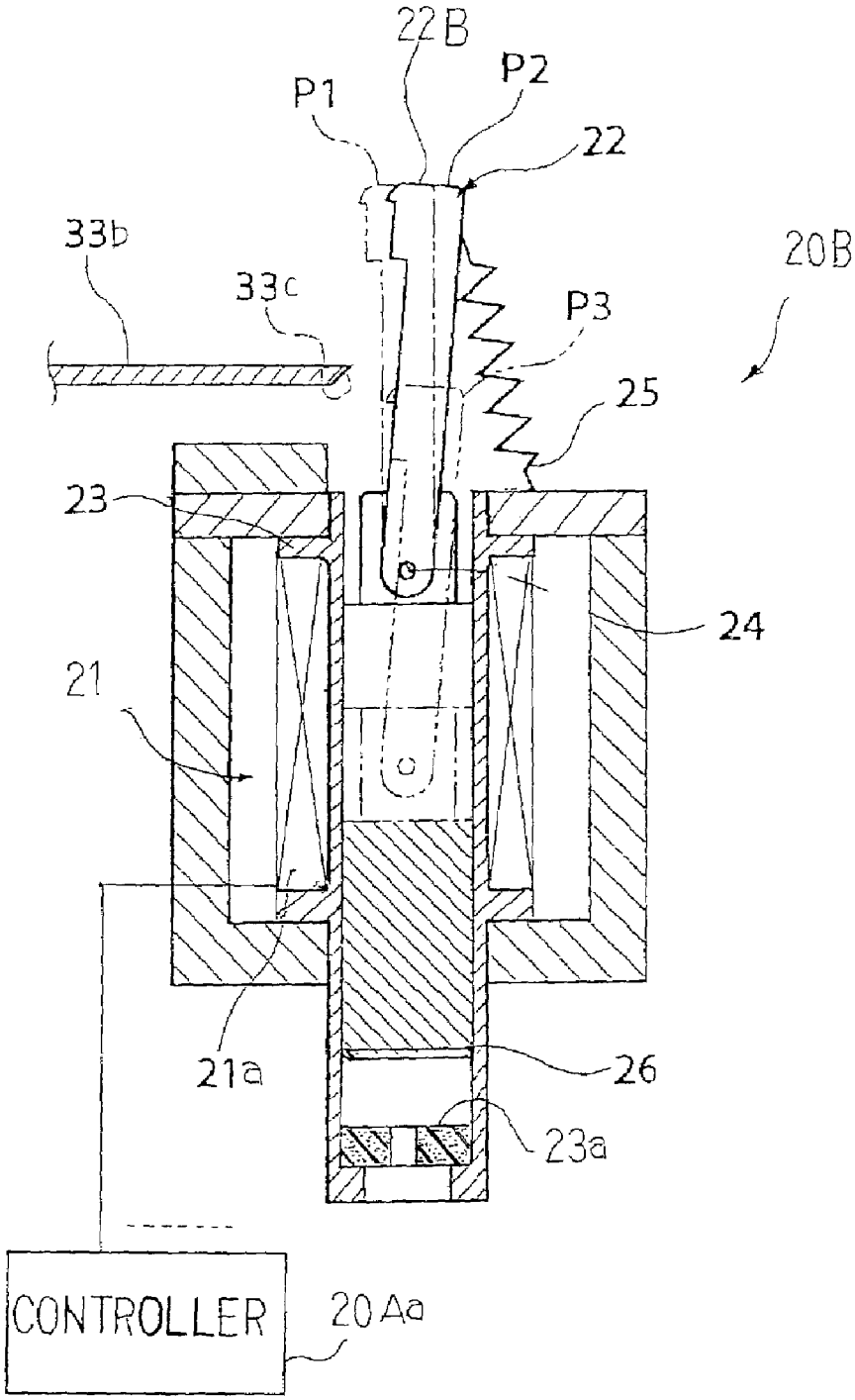
FIG. 13 is a cross sectional view showing the player's finger after the plucking.

The automatic player 5B also comprises player's fingers 20B and a controller 20Aa. The system components of the controller 20Aa are similar to those of the controller 20A (see FIG. 12). In the controller 20Aa, the driver circuit 17*a* includes a pulse width modulator 17*b*. The pulse width modulator 17*b* varies the pulse width of the driving signal depending upon the loudness of a tone to be generated as will be described hereinlater.

Figure 11A:
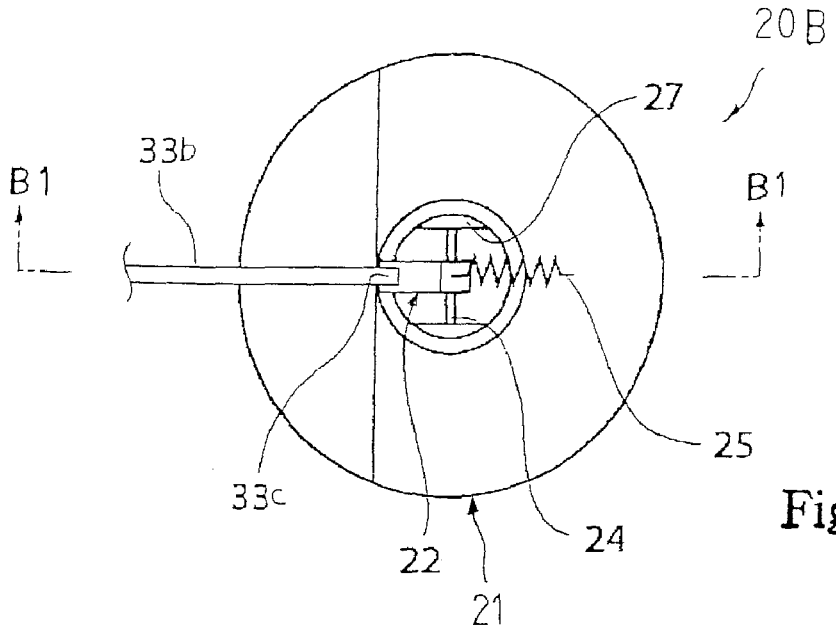
FIG. 11A is a plane view showing a reed and a player's finger of an automatic player incorporated in the music box.
Figure 11B:
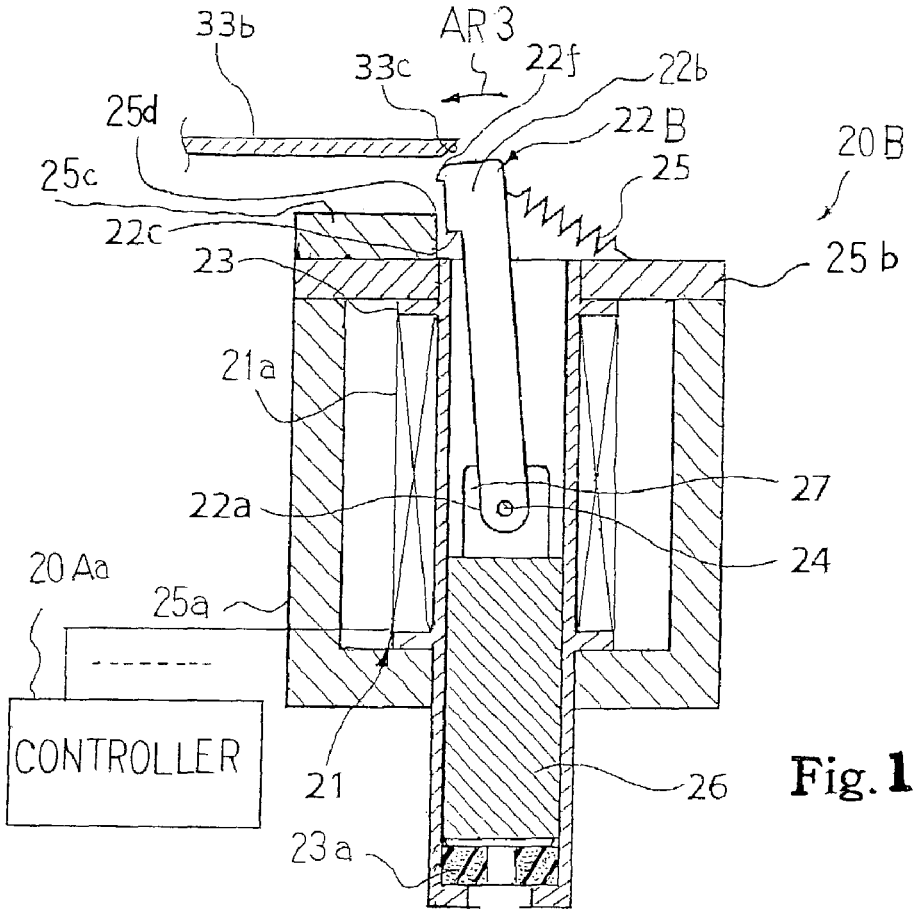
FIG. 11B is a cross sectional view taken along line B1—B1 of FIG. 11A and showing the structure of the player's finger.

The players fingers 20B are arranged in the peripheral zone of the inner space defined in the housing 1B, and are in the close proximity of the tips 33*c* of the reeds 33*b*. The player's fingers 20B are similar in structure to one another. As will be better seen in FIGS. 11A and 11B, the player's finger 20B includes the solenoid-operated actuator 21, a pick 22B and the spring 25.

The pick 22B is rotatably connected to the pin 24, which in turn is supported by the plunger 26. The pick 22B has a relatively narrow lower portion 22*a* and a relatively wide upper portion 22*b* so that the step 22*c* takes place at the boundary between the upper end portion 22*b* and the lower end portion 22*a*. The pick 22B has an end surface 22*f* partially flat and partially rounded. The flat area is brought into contact with the tapered tip 33*c* during the upward motion of the plunger 26, and pushes the tapered tip 33*c* so as to warp the reed 33*b*. When the elastic force exceeds the magnetic force, the spring 25 inclines the pick 22B outwardly. Then, the rounded area slides on the tapered tip 33*c*, and the pick 22B escapes from the tapered tip 33*c*. Thus, the rounded area makes the escape smooth, and the pick 22B is never caught on the tapered tip 33*c*.

The pulse width modulator 17*b* incorporated in the driver circuit 17*a* controls the loudness of the tones to be produced through the vibrations of the reeds 33*b*. The central processing unit 11 is assumed to instruct the driver circuit 17*a* to supply the driving signal for generating a loud tone. The pulse width modulator 17*b* increases the pulse width of the driving signal, and supplies it to the solenoid-operated actuator associated with the reed 33*b* to be plucked. When the driving signal reaches the coil 21*a*, a large amount of current flows, and creates a strong magnetic field. The pick 22B is strongly attracted to the inner portion of the bottom yoke 25*a*, and the plunger upwardly projects from the bobbin 23 powerfully. The magnetic force is so large that the spring can not outwardly incline the pick 22 as usual. Thus, the driving signal with the wide pulse width results in the strong attractive force exerted on the pick 22 as well as the speed-up of the plunger 26. For this reason, the pick 22B makes the reed 33*b* widely warped. However, the elastic force exceeds the magnetic force later than usual. Then, the pick 22 escapes from the tapered tip 33*c*, and permits the reed 33*b* to vibrate. The escape is later than the usual escape is. This means that the reed 33*b* is widely warped, and the amplitude of the vibrations is wider than the amplitude of the usual vibrations. This results in the loud tone.

Assuming now that a user requests the automatic player 5B to perform a piece of music, the central processing unit 11 sequentially fetches the music data codes from the random access memory 13. One of the music data codes is assumed to represent the note-on event for generating a tone. When the time at which the tone is to be generated comes, the central processing unit 11 instructs the driving circuit 17*a* to supply the driving signal to the associated solenoid-operated actuator 21. The driving circuit 17*a* determines the optimum pulse width, and the pulse width modulator 17*b* adjusts the driving signal to the optimum pulse width. The driving signal is supplied to the coil 21*a*, and creates the magnetic field. The pick 22B was resting at position P3 before reaching the driving current. When the magnetic field is created, the pick 22B is inwardly inclined, and the plunger 26 starts to lift the pick 22B.

The pick 22B is brought into face-to-face contact with the tapered tip 33*c* at the flat area of the upper surface 22*f*. The upper surface 22*f* pushes the tapered tip 33*c*, and warps the reed 33*b*. While the plunger 26 is upwardly projecting, the magnetic force is weakened, and the elastic force of the spring 25 is increased. When the elastic force exceeds the magnetic force, the spring 25 pulls the pick 22B, and outwardly inclines the pick 22B as indicated by P1. While the spring 25 is inclining the pick 22B, the rounded area of the upper surface 22*f* smoothly slides on the tapered tip 33*c* until the escape from the tapered tip 33*c*.

The driver circuit 17*a* recovers the driving signal to the inactive level. The magnetic field is removed from the solenoid-operated actuator 21, and the magnetic force is exerted on the pick 22B. For this reason, the spring 25 further inclines the pick 22B outwardly as indicated by P2. The plunger 26 is retracted into the bobbin 23, and the pick 22B returns to the rest position as indicated by P3.

As will be appreciated from the foregoing description, the musical instrument implementing the second embodiment achieves all the advantages of the first embodiment. Moreover, the spring 25 inclines the pick 22B outwardly so that the pick 22B returns to the rest position without interference with the vibrating reed 33*b*. The automatic player 5B merely requires an additional space, which permits the outwardly inclined picks 22B to return to the rest positions thereof. Any other space is not required for the player's fingers 20B. The additional space is negligible in the inner space of the housing 1B so that the musical instrument is compact.

Another attractive point of the musical instrument according to the present invention is forcibly to incline the pick 22B after the plucking. The outwardly inclined pick 22B never interferes with the vibrating reeds 33*b*. This results in clear tones. Moreover, the springs 25 continuously exert the elastic force on the pick 22B until returning to the rest position. Thus, the springs 25 prevent the picks 22B from chattering.

Yet another attractive point of the music instrument according to the present invention is the upper surfaces 22*f* of the picks 22B which have the respective flat areas and respective rounded areas. While the picks 22B is warping the tips 33*c* of the associated reeds 33*b*, the flat areas are held in contact with the flat surfaces of the associated tapered tips 33*c* so that the force is effectively transferred from the picks 22B to the reeds 33*b* without slippage. When the springs 25 pull the picks 22B outwardly, the rounded area slide on the flat surfaces of the tapered tips 33*c* so that the picks 22B smoothly escape from the reeds 33*b*.

Other Player's Fingers

Figure 14:
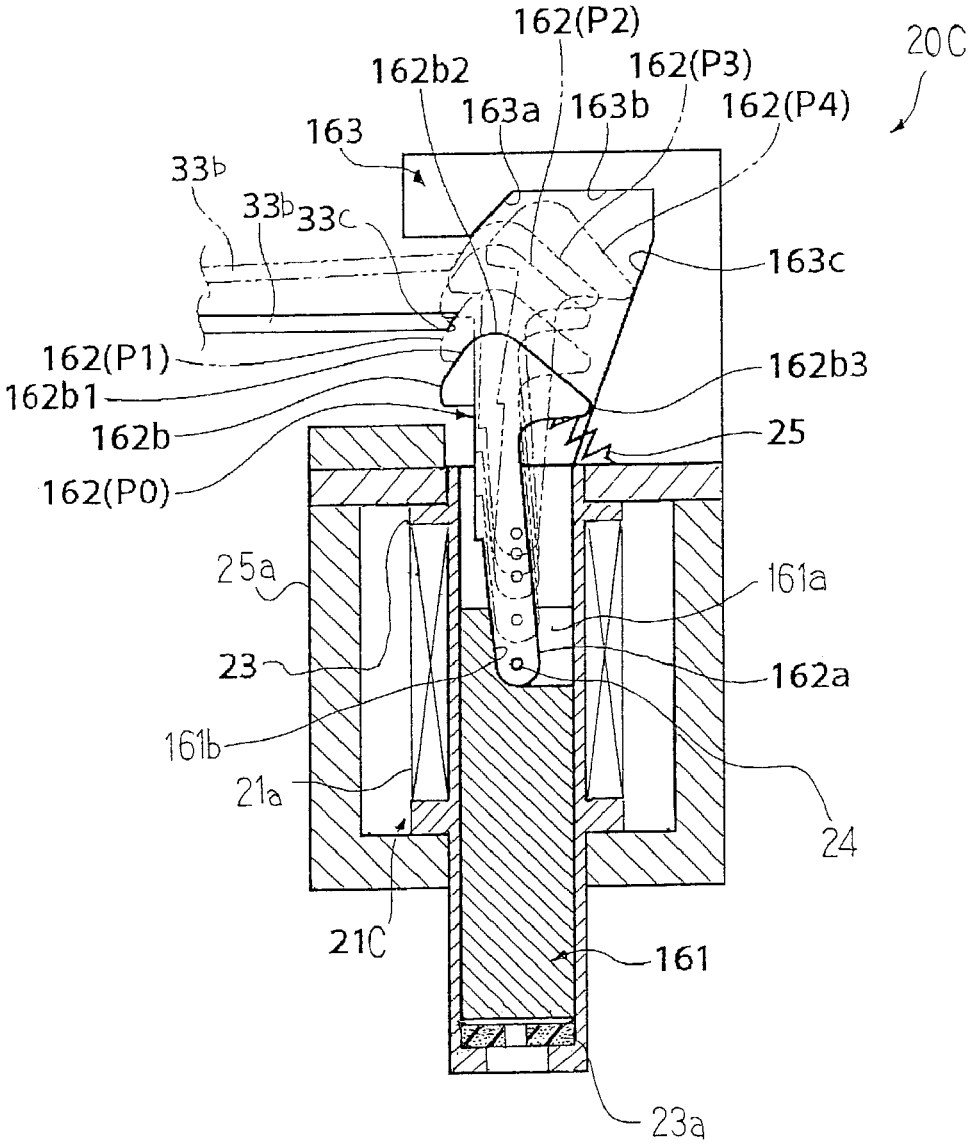
FIG. 14 is a cross sectional view showing a player's finger incorporated in a modification of the musical instrument.

The musical instrument implementing the second embodiment are modified as follows. First, the player's fingers 20B are replaced with player's fingers 20C shown in FIG. 14. The player's finger 20C includes a solenoid-operated actuator 21C, the spring 25, a pick 162 and a guide block 163. The solenoid-operated actuator 21C is similar to the solenoid-operated actuator 21 except a plunger 161. For this reason, the other component parts are labeled with the references designating the corresponding component parts of the solenoid-operated actuator 21 without detailed description.

The plunger 161 is slidably received in the bobbin 23, and a slit 161*a* is formed in the upper end portion of the plunger 161. The slit 161*a* is opened at the outer end, and is closed at the inner end. In other words, a pair of side surfaces and an inner end surface 161*b* define the slit 161*a*. The pin 24 is provided in the upper portion of the plunger 162 across the slit 161*a*, and the pick 162 is rotatably supported at the lower end of the stem portion 162*a* thereof by the pin 24. The pick 162 is rotatable on a trajectory, which is aligned with the centerline of the associated reed 33*b*. However, the inner end surface 161*b* sets a limit to the rotation of the pick 162, and the inner end surface 161*b* causes the pick 162 to be brought into contact with the tapered tip 33*c* of the associated reed 33*b*. The pick 162 is made of soft magnetic material.

The pick 162 is like a plate, and has a head portion 162*b* at the upper end of the stem portion 162*a*. The head portion 162*b* projects inwardly and outwardly from the stem portion 162*a*, and the spring 25 is connected between the head portion 162*b* and the upper surface of the bottom yoke 25*a*. The head portion 162*b* has a rounded upper surface. The rounded upper surface is steep in the inward direction, and is gentle in the outward direction. The part of the head portion 162*b* inwardly projecting from the stem portion 162*a* is hereinafter referred to as "inner sub-portion 162*b*1", the top of the head portion is labeled with 162*b*2, and the part of the head portion 162*b* outwardly projecting from the stem portion 162*a* is referred to as "outer sub-portion 162*b*3". The tip of the inner sub-portion 162*b*1 is rounded.

The guide block 163 is fixed to the bottom yoke 25*a*. The guide block 163 rises from the upper surface of the bottom yoke 25*a*, and inwardly projects. The inner end portion of the guide block 163 is spaced from the associated reed 33*b* so that the vibrating reed 33*b* does not beat the inner end portion. The guide block 163 has three guide surfaces 163*a*, 163*b* and 163*c* over the pick 162. As will be described hereinafter in detail, the head portion 162*b* is firstly brought into contact with the guide surface 163*a*, thereafter, slides on the guide surfaces 163*a*, 163*b* during the escape, and the guide surface 163*c* leads the head portion 162*b* to the rest position. Thus, the guide block 163 defines the behavior of the pick 162 in the reciprocal motion.

The reference 162(P0) is indicative of the pick at the rest position. Assuming now that the controller energizes the solenoid-operated actuator 21C, the magnetic field is created, and the plunger 161 starts to project from the bobbin 23. The pick 162 is inwardly attracted in the magnetic field. For this reason, although the elastic force of the spring 25 is increased together with the upward motion of the plunger 161, the stem portion 162*a* is pressed to the inner end surface 161*b*.

The inner sub-portion 162*b*1 is brought into contact with the tapered tip 33*c* as indicated by 162(P1). The plunger 161 further projects upwardly, and the head portion 162*b* warps the reed 33*b*. The inner sub-portion 162*b*1 keeps the face-to-face contact with the tapered tip 33*c* so that the force is effectively exerted on the reed 33*b*. When the pick 162 reaches the position indicated by 162(P2), the elastic force of the spring 25 becomes larger than the magnetic force, and the pick 162 outwardly inclined. The inner sub-portion 162*b*1 slides on the tapered tip 33*c*, and the pick 162 escapes from the reed 33*b*. Since the tip of the inner sub-portion 162*b*1 is rounded, the pick 162 smoothly escapes from the reed 33*b*.

The plunger 161 further projects, and the inner sub-portion 162*b*1 is brought into contact with the guide surface 163*a* as indicated by 162(P3). The guide surface 163*a* makes the head portion 162*b* further spaced from the reed 33*b*, and the pick 162 is further inclined outwardly. The elastic force of the spring 25 is increased together with the stroke of the plunger 161, and the magnetic force is weakened. The head portion 162*b* slides on the guide surface 163*b*, and reaches the guide surface 163*c* as indicated by 162(P4).

The magnetic field is removed from the solenoid-operated actuator 21C, and the plunger 161 is retracted into the bobbin 23. The elastic force is still exerted on the pick 162, and the outer sub-portion 162*b*3 downwardly slides on the guide surface 163*c*. The plunger 161 is softly received on the cushion sheet 23*a*, and the pick 162 reaches the rest position 162(P1).

As will be understood, the guide block 163 defines the trajectory of the pick 162, and prevents the pick 162 from damage due to excess force. This results in that the pick 162 is durable.

FIGS. 15A to 15F shows another modification 20D of the player's finger. The player's finger 20D includes a solenoid-operated actuator 21D, a spring 176 and a guide block 174 and a pick 175. The solenoid-operated actuator 21D includes a yoke 171, a coil 172 and a plunger 173. The yoke 171 has a cylindrical space, and the plunger 173 is slidably received in the cylindrical space. The coil 172 is wound around the plunger 173. The upper portion of the plunger 173 is partially cut off (see FIG. 15B), and the pick 175 is rotatably connected to the plunger 171 by means of a pin.

The yoke 171 has a flat upper surface, and any projection is not formed in the inner portion thereof. For this reason, the magnetic force is not exerted on the pick 175 so as to make the pick 175 inclined inwardly.

The pick 175 has a plate portion 175*a* and a head portion 175*b*. The plate portion 175*a* is rotatably connected to the pin. The head portion 175*b* has an inner rounded end surface 175*c*. The spring 176 is connected at one end thereof to the head portion 175*b*, and is anchored to the upper surface of the yoke 171. The anchored portion is sidewardly offset from the trajectory of the pick 175 so that the pick 175 is sidewardly outwardly urged. In other words, the pick 175 is urged outwardly as similar to the pick 162, and is further urged in the direction indicated by F4 (see FIG. 15F) A guide pin 179 passes through the head portion 175*b*, and sideward projects from both side surfaces of the head portion 175*b*.

Figure 15A:
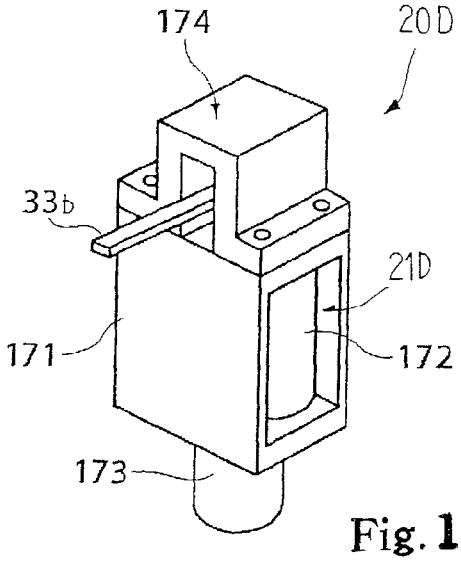
FIG. 15A is a perspective view showing a player's finger incorporated in another modification of the musical instrument.
Figure 15B:
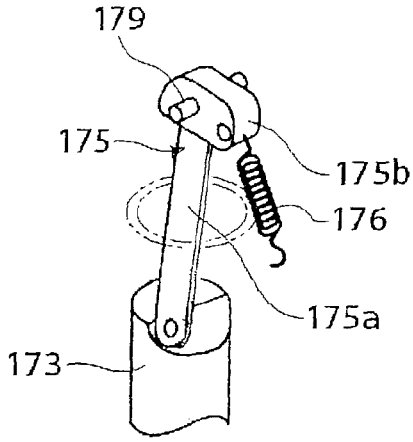
FIG. 15B is a perspective view showing a pick incorporated in the player's finger.
Figure 15C:
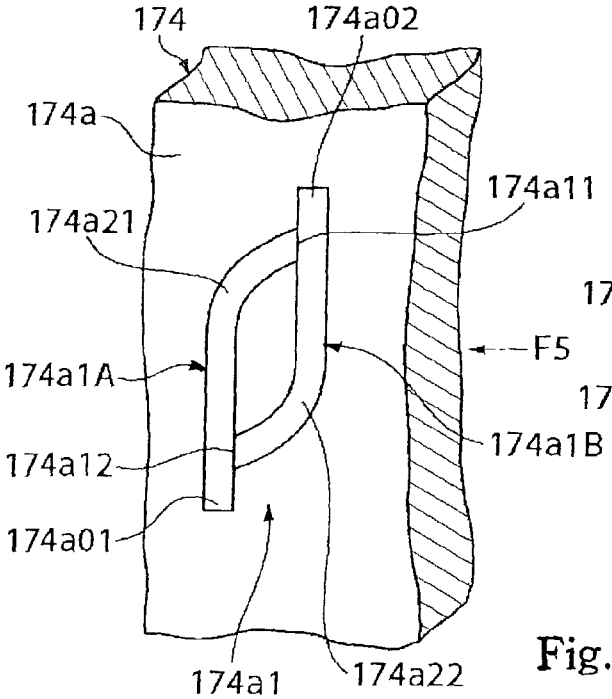
FIG. 15C is a perspective view showing paths formed in a guide block also incorporated in the player's finger.
Figure 15D:
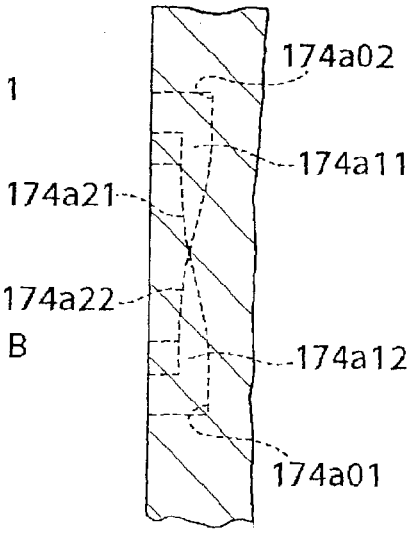
FIG. 15D is a cross sectional view in a direction of F5 of FIG. 15C and showing the paths.
Figure 15F:
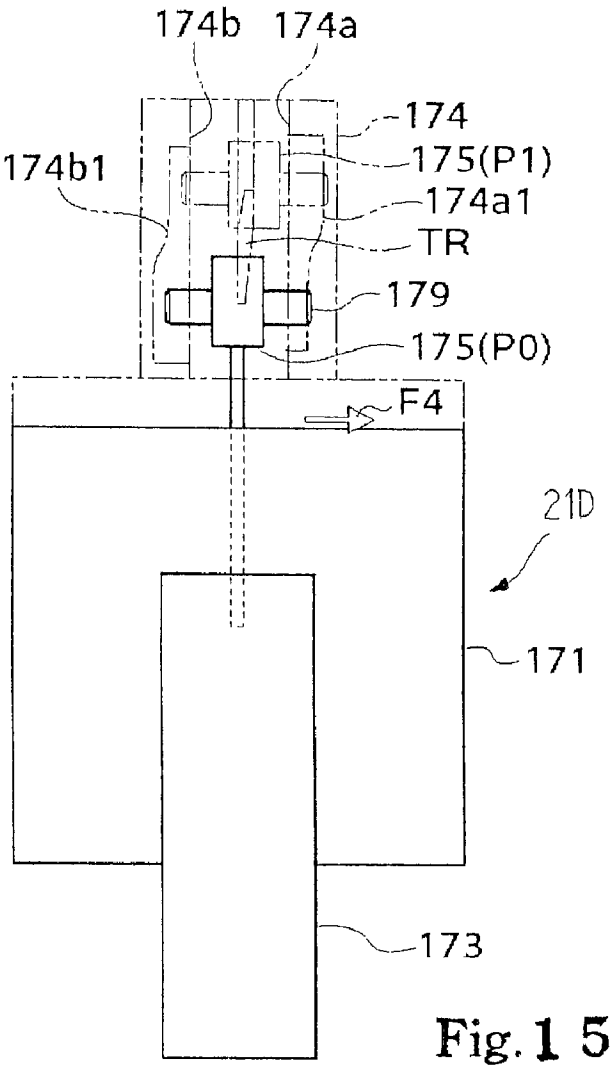
FIG. 15F is a front view showing the pick attached to the solenoid-operated actuator.
Figure 15E:
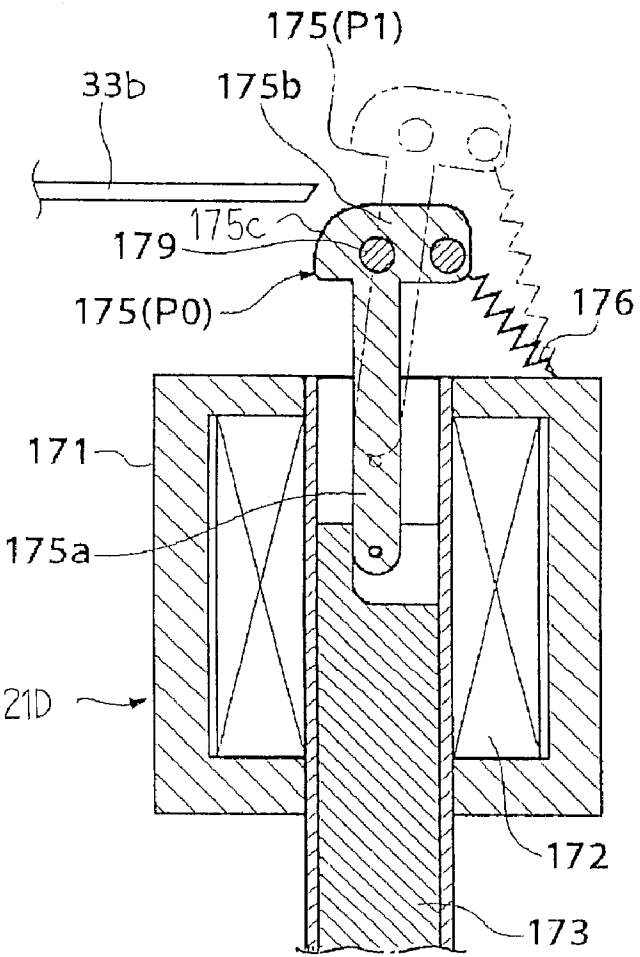
FIG. 15E is a schematic cross sectional view showing a pick attached to a solenoid-operated actuator incorporated in the player's finger.

The guide block 174 is fixed to the yoke 171, and is shaped like a channel, When the guide block 174 is fixed to the yoke 171, a hollow space is defined. The reed 33*b* projects into the hollow space as shown in FIG. 15A. The guide block 174 has a pair of side walls 174*a*/174*b*, and the side wall 174*a* is in parallel to the other side wall 174*b*. Guide grooves 174*a*1 and 174*b*1 are respectively formed in the side walls 174*a*/174*b*, and the pin 179 is loosely received at both end portions thereof to the guide grooves 174*a*1/174*b*1. The guide groove 174*a*1 has an upward path 174*a*1A and a downward path 174*a*1B. The lowermost end of the upward path 174*a*1A is the lower dead point 174*a*01 of the guide groove 174*a*1, and the uppermost end of the downward path 174*a*1B is the upper dead point 174*a*02 of the guide groove 174*a*1. The guide groove 174*a*1 is deepest at the lower dead point 174*a*01 and upper dead point 174*a*02 (see FIG. 15D). The upward path 174*a*1A becomes shallower along the curved portion 174*a*21, and the curved portion 174*a*21 is connected to the downward path 174*a*1B. However, the curved portion 174*a*21 is shallower than the downward path 174*a*1B at the boundary therebetween so that a step 174*a*11 takes place. Similarly, the downward path 174*a*1B becomes shallower along the curved portion 174*a*22, and is connected to the upward path 174*a*1A. The curved portion 174*a*22 is also shallower than the upward path 174*a*1A so that a step 174*a*12 takes place at the boundary therebetween. The other guide groove 174*b*1 also has an upward path and a downward path, and the upward path and downward path are arranged in parallel to the upward path 174*a*1A and downward path 174*a*1B, respectively. However, any step is not formed between the upward path and the downward path. The spring 176 always urges the pick 175 toward the side wall 174*a* so that the pin 179 slides on the bottom surfaces of the upward/downward paths 174*a*1A/174*a*1B.

The pin 179 is moved along the guide grooves 174*a*/174*b*. While the plunger 173 is projecting from the yoke 171, the pick 175 is moved upwardly together with the plunger 173, and the upward paths 174*a*1A guide the pin 179. The pin 179 passes through the curved portion 174*a*21, and enters the downward path 174*a*1B. Although the pin 179 passes through the boundary between the downward path 174*a*1B and the curved portion 174*a*21 in the downward motion, the pin 179 does not enter the curved portion 174*a*21, because the step 174*a*11 does not permit the pin 179 to enter the curved portion 174*a*21. Similarly, the step 174*a*12 does not permit the pin 179 to enter the curved portion 174*a*22 in the upward motion. Thus, the head 175*a* is traced along a trajectory TR (see FIG. 15F), and plucks the reed 33*b* as will be described hereinafter in detail.

While any current does not flow through the coil 172, the pick 175 is staying at the rest position 175(P0). Assuming now that the controller (not shown) energizes the solenoid-operated actuator 21D, the magnetic field is created, and gives rise to the upward motion of the plunger 173. The plunger 173 upwardly lifts the pick 175, and the pin 179 slides on the bottom surface from the lower dead point 174*a*01 to the boundary between the straight portion and the curved portion 174*a*21. Since the depth is constant, the head 175*b* is straightly moved toward the tip of the associated reed 33*b*. When the head 175*b* is brought into contact with the tip of the reed 33*b*, the pin 179 is still on the way to the boundary between the straight portion and the curved portion 174*a*21. The head 175*b* is further moved upwardly, and warps the reed 33*b*.

The pin 179 enters the curved portion 174*a*21. Then, the head 175*b* starts to laterally slide on the tapered tip of the reed 33*b*. The elastic force of the spring 176 is increased together with the plunger stroke, and makes the pick 175 outwardly inclined. The elastic force becomes large so that the pick 175 escapes from the reed 33*b*. The reed 33*b* freely vibrates for generating the tone. The plunger 173 further projects, and the pin 179 enters the downward path 174*a*1B over the step 174*a*11. The head 175*b* becomes offset from the vibrating reed 33*b*.

The controller (not shown) removes the magnetic field from the solenoid-operated actuator 21D so that the plunger 173 and, accordingly, pick 175 start to sink downwardly. The pin 179 slides on the bottom surface of the downward path 174*a*1B toward the boundary between the straight portion and the curved portion 174*a*22. Since the depth is constant, the pick 175 passes beside the vibrating reed 33*b*, and does not interfere with the vibrating reed 33*b*. When the pin 179 reaches the boundary, the head 175*b* is below the vibrating reed 33*b*. Then, the pin 179 enters the upward path over the step 174*a*12. Although the head 175*b* returns to the space beneath the reed 33*b*, the head 175*b* does not interfere with the vibrating reed 33*b*. Finally, the pin 179 slides on the bottom surface of the straight portion to the lower dead point 174*a*01, and reaches the rest position.

Thus, the pin 179 and guide block 174 shunt the head portion 175*b* from the upward pass to the downward path after the plucking, and make the head portion 175*b* pass beside the vibrating reed 33*b*. The pick 175 never interfere with the vibrating reed 33*b* so that the musical instrument generates clear tones.

Figure 16:
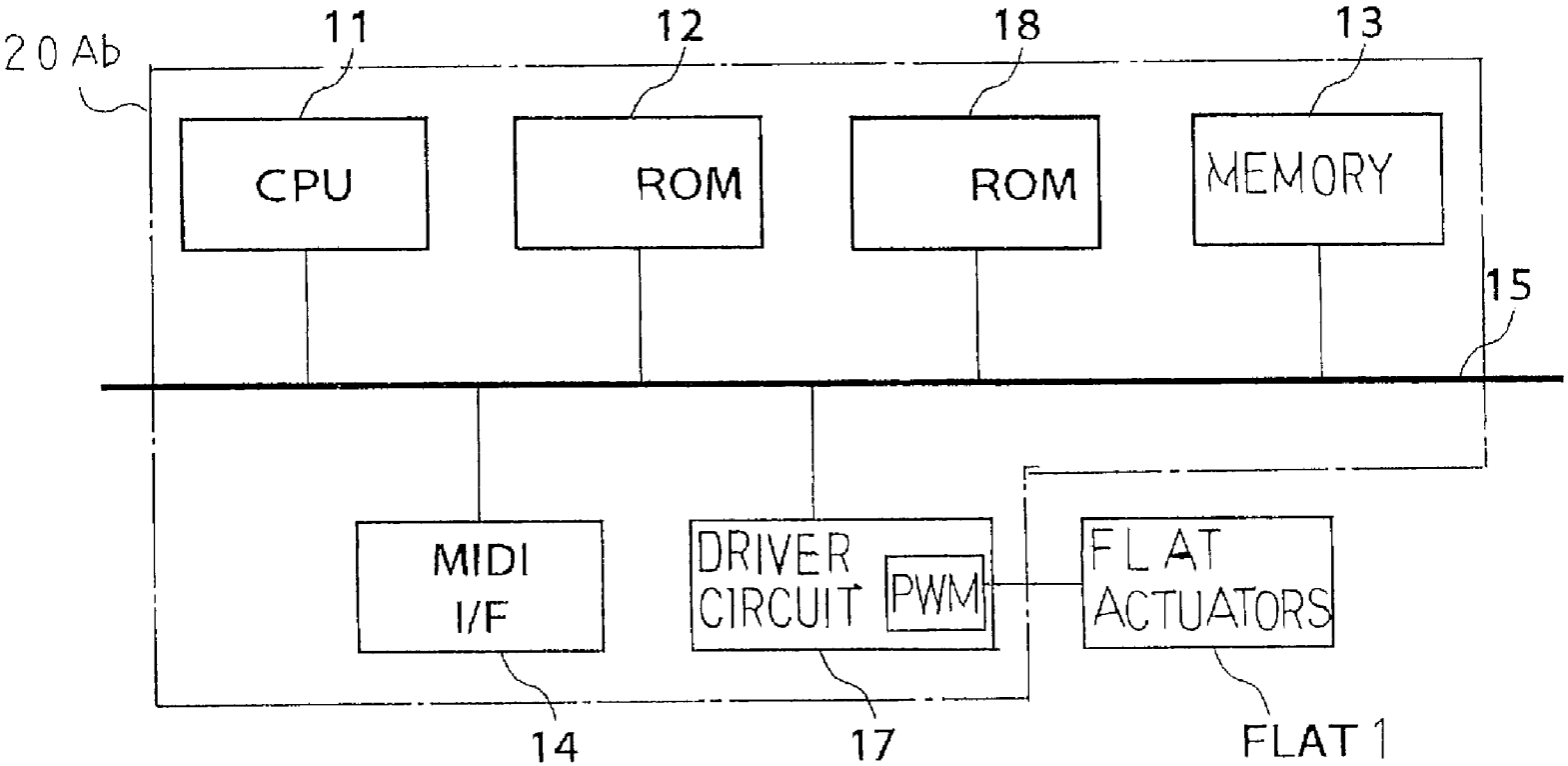
FIG. 16 shows a block diagram showing the system configuration of a controller incorporated in another musical instrument according to the present invention.
Figure 17:
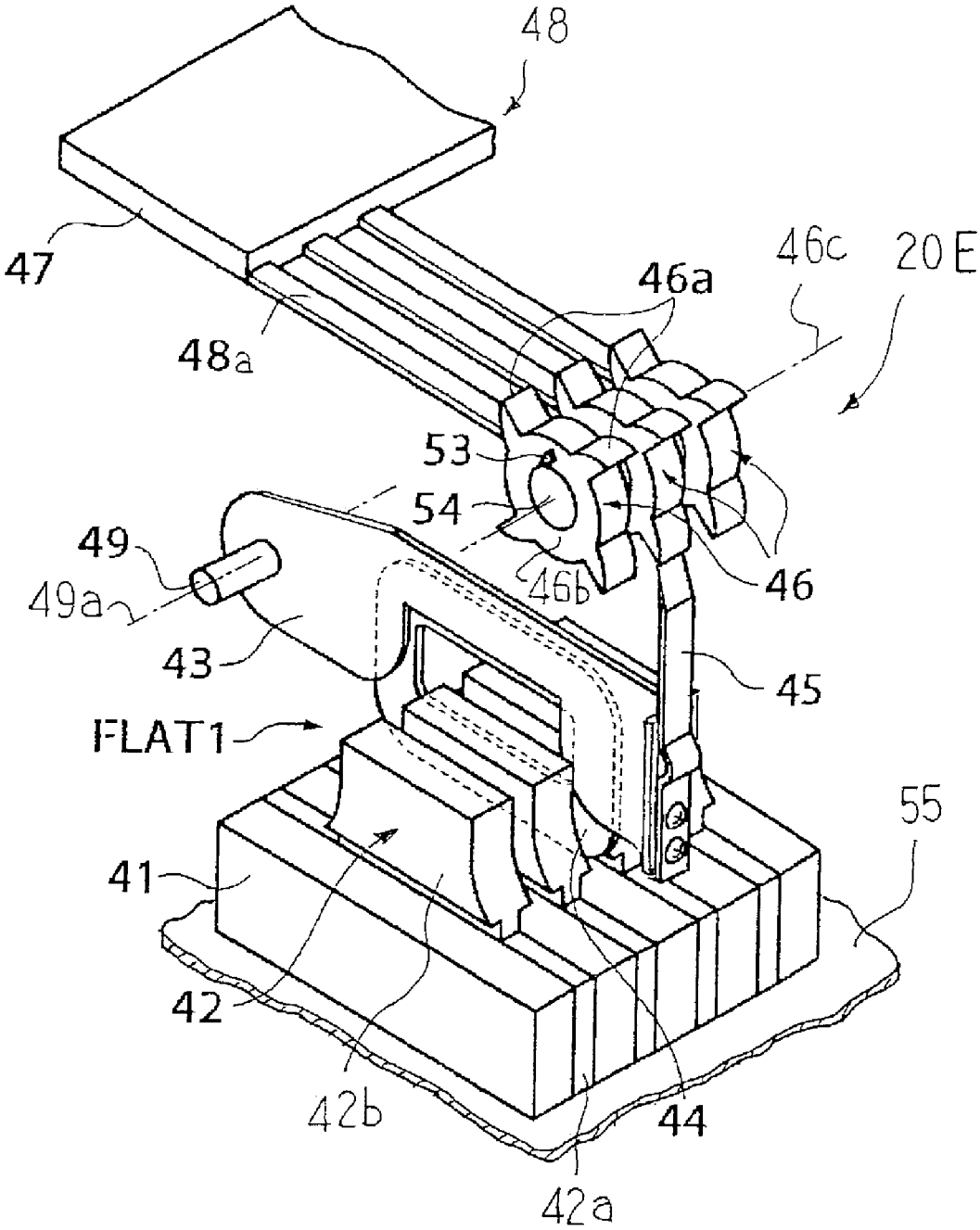
FIG. 17 is a perspective view showing player's fingers incorporated in the musical instrument.

FIGS. 16 and 17 show an automatic player, in which another modification of the player's fingers. The player's fingers 20E form parts of the automatic player together with a controller 20Ab, and the automatic player in turn forms a musical instrument together with an array 48 of reeds. The musical instrument is categorized in the music box. The array 48 includes a base plate 47 and reeds 48*a*, and the reeds 48*a* project from the base plate 47 in parallel to one another. Thus, the comb-like reed array is used in the musical instrument. The player's fingers 20E are associated with the reeds 48*a*, respectively, and are disposed in the proximity of the tips of the associated reeds 48*a*.

The controller 20Ab causes the player's fingers 20E to selectively pluck reeds 48. The system configuration of the controller 20Ab is similar to that of the controller 20Aa, and the system components are labeled with references designating corresponding system components of the controller 20Aa without detailed description.

The player's fingers 20E include respective solenoid-operated flat actuators FLAT1, respective blades 45 and respective rotary picks 46. Plural permanent magnet plates 41 are alternated with yokes 42 so as to form a magnetic block, which is shared among the solenoid-operated flat actuators FLAT1. The magnetic block is fixed to a base 55 in such a manner that the permanent magnet plates 41 are elongated in directions in parallel to the centerlines of the associated reeds 48*a*. The permanent magnet plates 41 are made of magnetic material containing a rare earth element such as, for example the magnetic material in neodymium series.

The yokes 42 have a same shape. Each yoke 42 has a thin portion 42*a* and a thick portion 42*b*. The thin portion 42*a* is sandwiched between two permanent magnetic plates 41, and the thick portion 42*b* projects over the permanent magnetic plates 41. Since the thick portion 42*b* is thinner than the permanent magnetic plate 41, the adjacent thick portion 42*b* is spaced from the adjacent thick portions 42*b*, and gaps take place between the thick portions 42*b*. The yokes 42 offer magnetic paths to the magnetic field created by the permanent magnet plates 41, and the magnetic field are created across the gaps.

Each of the solenoid-operated flat actuators FLAT1 further includes a swingable arm 43 and a flat coil 44. The swingable arm 43 has both side surfaces substantially in parallel to a virtual plane on which the centerline of the associated reed 48*a* extends. The flat coil 44 is fixed to one of the side surfaces of the swingable arm 43, and a pin 49 is fixed to the swingable arm 43. The pin 49 sidewardly projects from the side surfaces of the swingable arm 43, and is rotatably supported by a frame (not shown). Thus, the swingable arm 43 and, accordingly, the flat coil 44 are rotatably supported by the frame. Although the gaps are respectively assigned to the swingable arms 43, only one swingable arm 43 is illustrated in FIG. 17. While any current does not flow through the flat coil 44, the flat coil 44 is resting in the magnetic field created in the gap. When the current flows through the flat coil 44, the magnetic force is exerted on the flat coil 44, and causes the flat coil 44 and, accordingly, the arm 43 to move in the direction determined on the basis of the Fleming's left-hand rule. Thus, the current flowing through the flat coil 44 gives rise to the rotation of the swingable arm 43 about the centerline 49*a* of the pin 49 in the counter clockwise direction in FIG. 17. When the controller 20Ab stops the current, the self-weight of the swingable arm/flat coil 43/44 return to the rest position in the gap. The trajectory of the swingable arm 43 is substantially coplanar with the vibrating reed 48*a*.

The blade 45 is made of metal or alloy, and is fixed to the leading end of the swingable arm 43. The blade 45 has a leading end portion slightly inclined to the associated rotary pick 46. For this reason, the blade 45 gives rise to rotation of the rotary pick 46 without slippage. Thus, the force is surely transferred from the blade 45 to the rotary pick 46. While the swingable arm 43 is resting in the gap, the blade 45 upwardly projects from the swingable arm 43 (see FIG. 18A). The blade 45 is rotated together with the swingable arm 43 when the current flows through the flat coil 44.

Figure 18B:
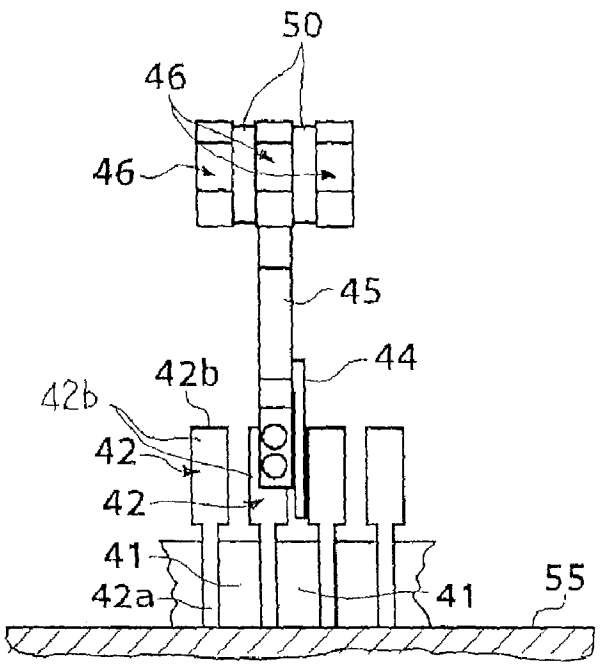
FIG. 18B is a rear view showing the player's finger.

The rotary picks 46 are made of metal or alloy, and are respectively associated with the reeds 48*a*. Spacers 50 are alternated with the rotary picks 46 so as to make the rotary picks 46 confronted to the associated reeds 48*a* (see FIG. 18B). The rotary picks 46 are arrayed as similar to the reeds 48*a*. Each of the rotary picks 46 has plural claws 46*a* and a disk 46*b*. In this instance, claws 46*a* radially project from the disk 46*b* at regular intervals. In other words, each claw 46*a* is spaced from the adjacent claws 46*a* at 90 degrees. The disk 46*b* is rotatably supported by the frame. Although the disk 46*b* is spaced from the tip of the associated reed 48*a*, the claws 46*a* reach the reed 48*a*, and pluck the reed 48*a* for vibrations. A ratchet 53 is provided for each of the rotary pick 46 so that the rotary pick 46 is rotatable about a centerline 46*c* only in the counter clockwise direction in FIG. 17.

While the swingable arm 43 is resting in the gap, the tip of the blade 45 is located in the close proximity of one of the claws 46*a*. When the swingable arm 43 is rotated, the tip of the blade 45 pushes the claw 46*b* so that the rotary pick 46 is driven for rotation, and another claw 46*b* pushes the tip of the reed 48*a* downwardly. The claw 46*b* is further rotated, and is spaced from the tip of the reed 48*a*. Thus, the rotary pick 46 plucks the reed 48*a* for vibrations.

Figure 18A:
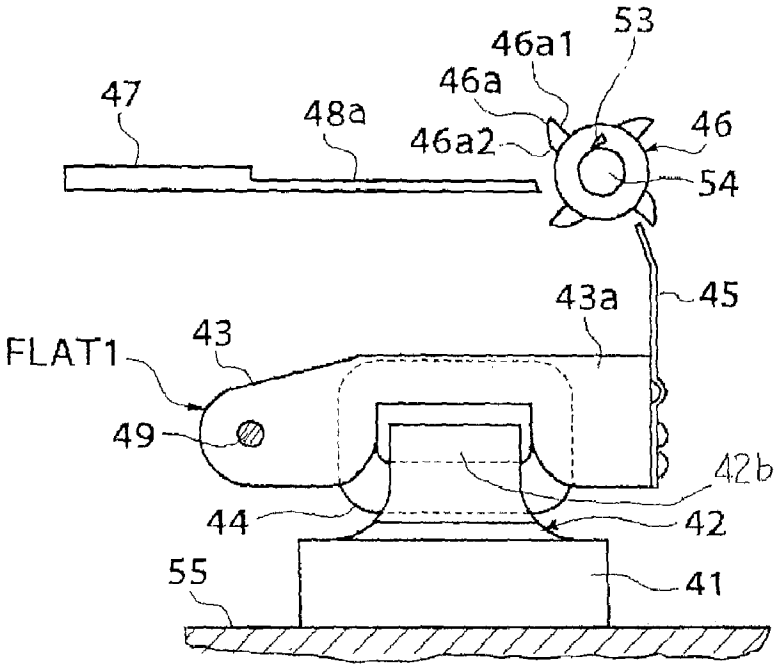
FIG. 18A is a side view showing the player's finger before plucking the associated reed.

The claw 46*a* has a rounded front surface 46*a*2 and a flat back surface 46*a*1 (see FIG. 18A). The blade 45 pushes the flat back surface 46*a*1 so that the force is certainly exerted on the claw 46*a*. On the other hand, the rounded front surface 46*a*2 is brought into contact with the tip of the reed 48*a*, and makes the reed 48*a* warped. The tip of the reed 48*a* smoothly slides on the rounded front surface 46*a*2 so that the claw 46*a* is never caught on the reed 48*a*.

Assuming now that a user requests the automatic player to perform a piece of music, the central processing unit 11 sequentially accesses music data codes stored in the memory 13, and instructs the driver circuit 17 to selectively energize the solenoid-operated flat actuators FLAT1. While the central processing unit 11 is sequentially processing the music data, the central processing unit 11 is assumed to instruct the driver circuit 17 to pluck the reed 48*a* shown in FIG. 18A. The flat coil 44 has not been energized so as to keep the swingable arm 43 horizontal. The tip of the blade 45 stands upright, and is spaced from the rotary pick 46.

The driver circuit 17 determines the pulse width to be required for the target loudness, and the pulse width modulator PWM supplies the driving signal with the pulse width to be required for the target loudness to the flat coil 44. When the current flows through the flat coil 44, the magnetic force is exerted on the flat coil 44, and gives rise to rotation of the swingable arm 43 in the counter clockwise direction. The blade 45 is brought into contact with the flat back surface 46*a*1 of the rotary pick 46, and pushes it. The rotary pick 46 is driven for rotation over 90 degrees as indicated by arrow AR5 (see FIG. 19), and plucks the reed 48*a* with the claw 46 spaced 180 degrees from the claw 46 pushed by the blade 45. The reed 48*a* vibrates as indicated by arrow AR6, and generates the tone. The disk 46*b* is spaced from the vibrating reed 48*a*, and the claws 46*a* are out of the trajectory of the vibrating reed 48*a*. Thus, the rotary pick 46 does not interfere with the vibrating reed 48*a*.

The driver circuit 20Ab removes the driving signal from the flat coil 44. Then, the self weight causes the swingable arm 43, flat coil 44 and blade 45 to return to the rest position shown in FIG. 18A. The ratchet 53 prevents the rotary pick 46 from the reverse rotation.

In this instance, the swingable arms 43 and flat coils 44 occupy the space under the array of reeds 48, and the blades 45 and the rotary picks 46 are provided in the proximity of the tips of the reeds 48*a*. The space to be additionally required for the vibrating reeds 48*a* is the gap between the claws 46*a*. Thus, the array of reeds 48 and player's fingers 20E are compactly packed in a housing of the musical instrument without interference with the vibrating reeds 48. This results in the compact musical instrument.

Moreover, the controller 20Ab independently energizes the solenoid-operated flat actuators FLAT1 on the basis of the music data codes so that the automatic player performs any piece of music. If plural tones are to be concurrently produced for a chord, the controller 20Ab concurrently energizes the associated solenoid-operated flat actuators FLAT1.

The flat coils 44 are used in the player's fingers 20E. The flat coils 44 are so thin that the manufacturer can arrange the player's fingers 20E at small pitches. Thus, the player's fingers 20E plucks the reeds 48*a* of the comb-like array 48.

The claws 46*a* are arranged on the disk 46*b* at intervals, and the intervals are wide enough to permit the associated reed 48*a* to vibrate without interference. The vibrations are stable, and, accordingly, the tones are clear.

The rotary pick 46 includes more than one claws 46*a*. One of the claws 46*a* is pushed with the blade 45, and another claw 46*a* plucks the reed 48*a*. The roles are sequentially changed among the plural claws 48*a*. This results in the simple structure of the player's fingers.

Figure 20B:
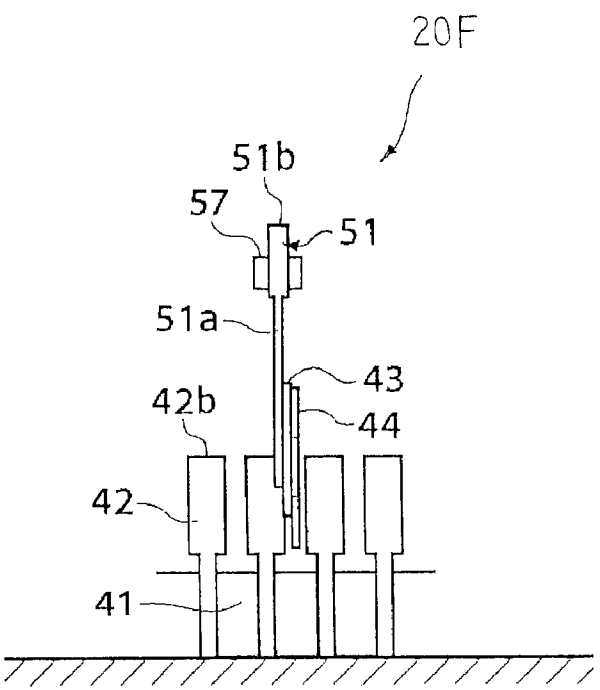
FIG. 20B is a rear view showing the player's finger.
Figure 20A:
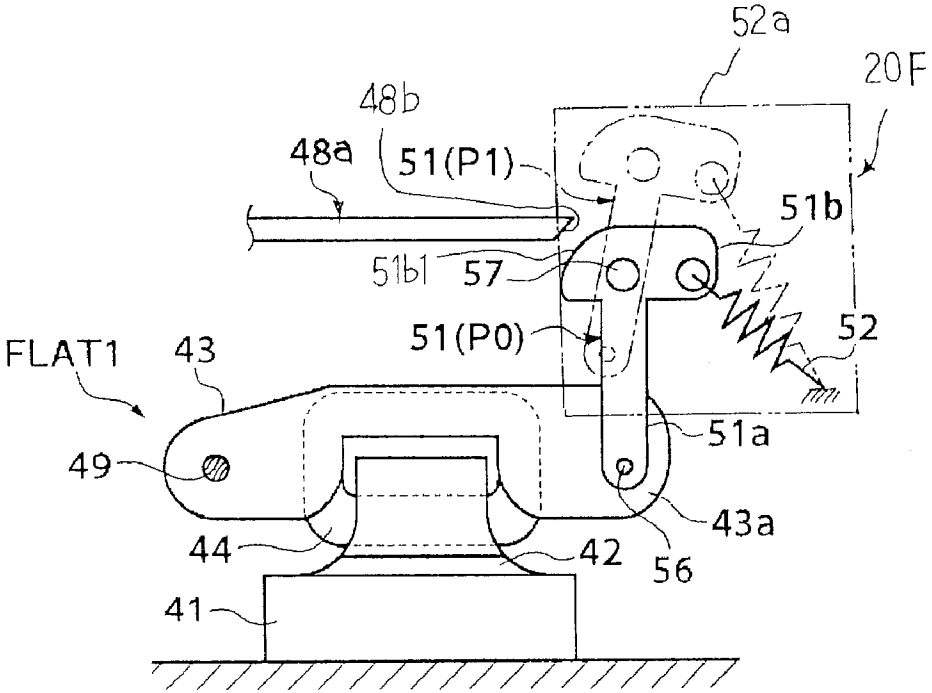
FIG. 20A is a side view showing another player's finger incorporated in a musical instrument according to the present invention.

FIGS. 20A and 20B show another player's finger 20F incorporated in an automatic player, which in turn forms a part of a musical instrument. The player's fingers 20F are respectively associated with the reeds 48*a*, and, are selectively energized by the controller 20Ab (see FIG. 16). Each of the player's fingers 20F includes the solenoid-operated flat actuator FLAT1, a pick 51, a string 52 and a guide block 52*a*. The solenoid-operated flat actuator FLAT1 is similar to that of the player's finger 20E, and the component parts are labeled with same references designating corresponding component parts in the player's finger 20E without detailed description.

The blade 45 and rotary pick 46 are replaced with the pick 51. The pick 51 pick 51 has a stem portion 51*a* and a head portion 51*b*, and the stem portion 51*a* is rotatably connected at the lower end thereof to the free end portion 43*a* of the swingable arm 43 by means of a pin 56. For this reason, the pick 51 is rotatable in the clockwise direction and counter clockwise direction. The head portion 51*b* has a rounded front surface 51*b*1, and the rounded front surface 51*b*1 smoothly slides on the tapered tip 48*b* of the associated reed 48*a*. The spring 52 is connected at one end thereof to the head portion 51*b* and at the other end thereof to a stationary member of the musical instrument such as an inner surface of the guide block 52*a*. While the swingable arm 43 is staying in the gap between the yokes 42, the spring exerts a negligible amount of elastic force on the pick 51 so that the pick 51 keeps its attitude upright. The spring 52 increases the elastic force together with the rotation of the swingable arm 43 in the counter clockwise direction.

Guide pins 57 sidewardly project from the side surfaces of the head portion 51*b*. Though not shown in the figures, guide grooves are formed in the side walls of the guide block 52*a*, and the pins 57 are moved along the guide grooves. The guide grooves for the upward motion are routed differently from the guide grooves for the downward motion. While the pins 57 are moved along the guide grooves for the upward motion, the rounded front surface 51*b*1 is brought into contact with the tapered tip 48*b*, makes the rounded front surface 51*b*1 slide on the tapered tip 48*b*, and escapes form the tapered tip 48*b*. Then, the reed 48*a* vibrates for generating a tone. After the escape, the pins 57 enter the guide grooves for the downward motion. While the pins 57 are moving along the guide grooves for the downward motion, the pick 51 is inclined as indicated by 51(P1), and passes in front of the vibrating reed 48*a* without any interference. Thus, the trajectory of the head portion 51*b* is defined by the guide grooves.

The pick 51 is staying at the rest position P0. The driver circuit 17 is assumed to energize the solenoid-operated flat actuator FLAT1 during performance of the automatic player. The swingable arm 43 is driven for rotation in the counter clockwise direction, and the pins 57 keep the pick 51 tangential with the longitudinal direction of the swingable arm 43 against the elastic force of the spring 52. The rounded front surface 51*b*1 is brought into contact with the tapered tip 48*b*, and warps the reed 48*a*. The guide grooves and pins 57 make the pick 51 inclined as indicated by 51(P1), and the pick 51 escapes from the tapered tip 48*b* of the reed 48*a*. The rounded front surface 51*b*1 smoothly slides on the tapered tip 48*b* so that the head portion 51*b* is never caught on the tapered tip 48*b*.

The driving circuit 17 removes the driving signal from the flat solenoid 44, and the self-weight and elastic force cause the swingable arm 43, flat solenoid 44 and pick 51 to pull down. Since the pins 57 are moved along the guide grooves for the downward motion, the head portion 51*b* passes the space in front of the vibrating reed 48*a*. Thus, the pick 51 does not interfere with the vibrating reed 48*a*.

As will be understood, the player's fingers 20F achieve all the advantages of the player's fingers 20E. Moreover, the picks 51 are simpler than the rotary picks 46 so that the production cost is reduced. The guide block 52*a*, pins 57 and springs 52 surely shunt the picks 51 to the downward trajectory, and prevent the vibrating reeds 48*a* from the interference. This results in the clear tones.

Figure 21:
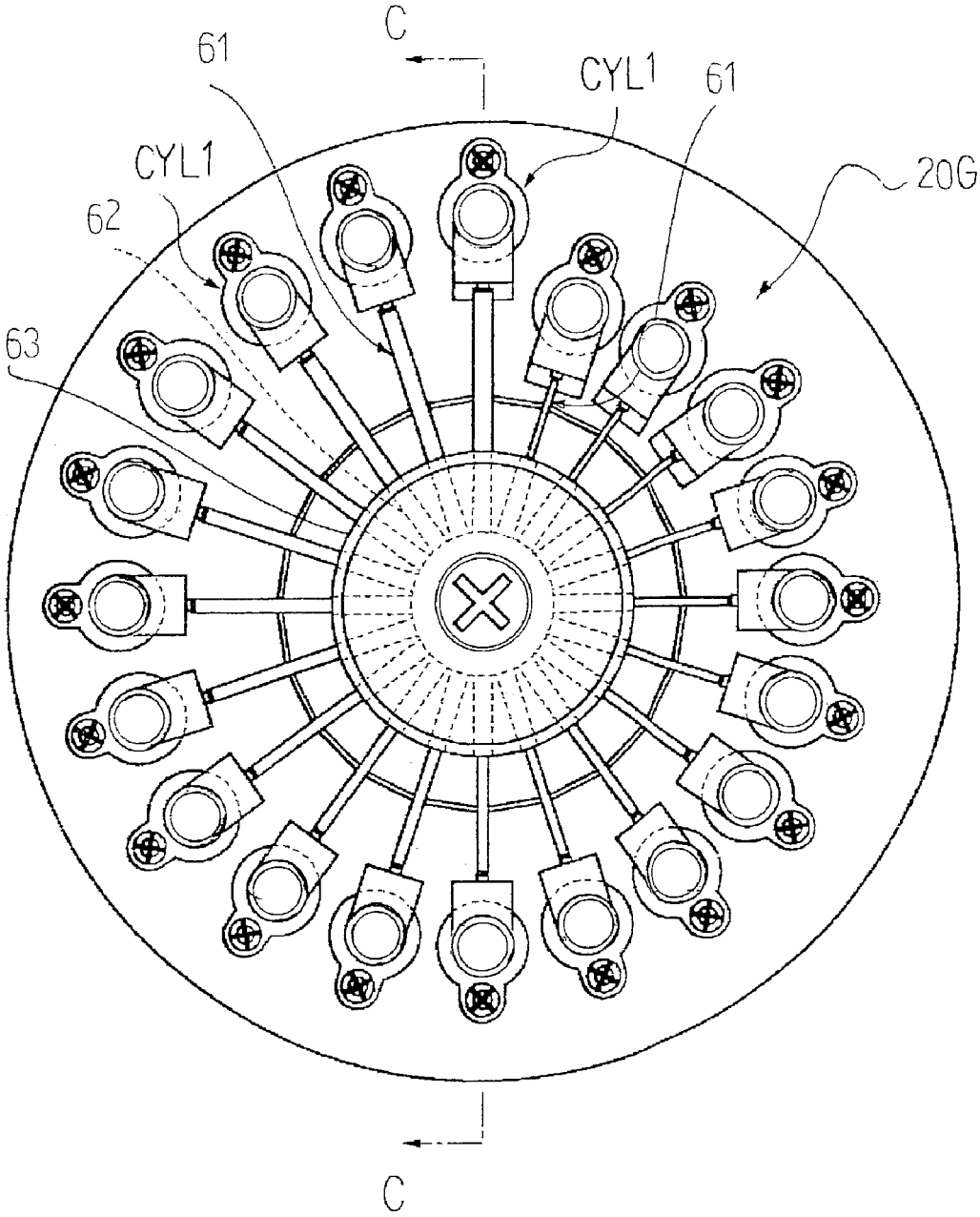
FIG. 21 is a plane view showing the layout of reeds and player's fingers incorporated in a musical instrument according to the present invention.
Figure 22C:
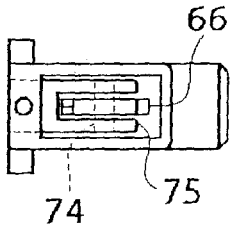
FIG. 22C is a view a rotary pick and a brake unit viewed in a direction indicated by F1.
Figure 22B:
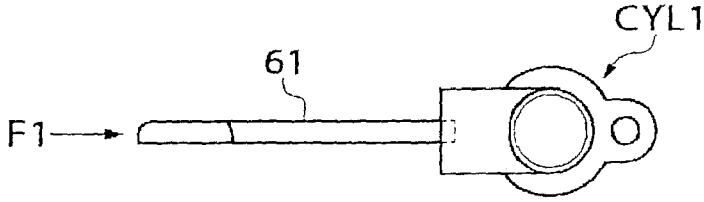
FIG. 22B is a plane view showing a standard solenoid-operated actuator.
Figure 22A:
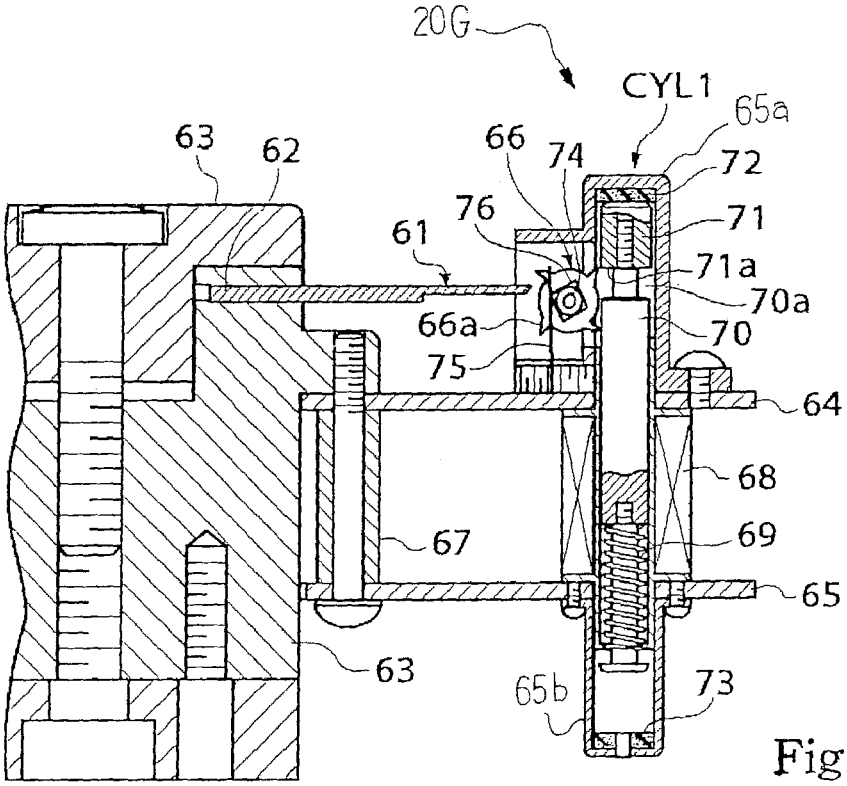
FIG. 22A is a cross sectional view taken along line C—C of FIG. 21 and showing the structure of the musical instrument.

FIG. 21 shows another modification of the musical instrument. The musical instrument shown in FIG. 21 is similar to the musical instrument shown in FIG. 17 except that rotary picks 66 are driven for rotation by solenoid-operated cylindrical actuators CYL1. The musical instrument comprises plural reeds 61, a hub 63, a controller (not shown) and player's fingers 20G. The reeds 61 have respective boss portions 62 fixed to the hub 63, and radially project form the hub 63. In this instance, twenty reeds 61 are arranged around the hub 63, and the hub 63 has a disk shape. In other words, the distance from the center of the hub 63 to the periphery thereof is constant. The reeds 61 are different in length and width from one another depending upon pitches of tones to be generated. The distance between the center of the hub 62 and the player's fingers 20G is varied depending upon the length of the reeds 61. However, the distance between the center of the hub 63 and the periphery may be varied together with the angle so that the player's fingers 20G are disposed on a virtual circle.

The player's fingers 20G are fixed to brackets 64/65, and are respectively associated with the reeds 61 for plucking. The player's finger 20G includes the solenoid-operated cylindrical actuator CYL1, a rotary pick 66, a head block 71 and a combination of cam plates and cam springs 76/75 serving as a brake unit. A solenoid coil 68, a plunger 70, a plunger spring 69 and yoke 64/65 form in combination the solenoid-operated cylindrical actuator CYL1. The yoke 64/65 has a pair of ring plates 64/65, and yoke spacers 67 are provided between the ring plates 64 and 65. The yoke 64/65 is bolted to the hub 63, and is shared among all the solenoid-operated cylindrical actuators CYL1. The solenoid coils 68 are inserted into the space between the ring plates 64 and 65, and the plungers 70 are slidably received in the cylindrical spaces defined in the associated solenoid coils 68. Caps 65*a*/65*b* are bolted to the ring plate 64 and 65 at intervals, and the caps 65*a* offer extension spaces to the associated plungers 70, respectively. Cushion sheets 72 and 73 are disposed at the bottoms of the caps 65*a*/65*b*, and define the upper dead points and the lower dead points for the associated plungers 70. The cushion sheets 72 and 73 absorb the impact of the plunger 70, and prevent the solenoid-operated actuator CYL1 from noise.

The plunger springs 69 are attached to the ring plate 65, and always urge the associated plungers 70 upwardly. When current flows through the coil 68, magnetic filed is created, and the plunger 70 is downwardly pulled. On the other hand, the magnetic field is removed, the plunger spring 69 pushes the plunger 70 upwardly.

The head block 71 is fixed to an upper thin portion of the plunger 70, and a ring space 70*a* takes place between the head block 71 and the remaining thick portion of the plunger 70. The claws 66*a* of the associated rotary pick 66 selectively slide into the ring space 70*a*, and are brought into contact with a part 71*a* of the head block 71 when the plunger returns to the upper dead point. Thus, the head block 71 serves as a pusher.

The rotary pick is rotatably supported between the tip of the reed 61 and the solenoid-operated cylindrical actuator CYL1. The rotary pick 66 is similar to the rotary pick 46, and has plural claws 66*a*, which radially project at regular intervals. The brake units are respectively associated with the rotary picks 66. The cam plates 76 are fixed to the sides surface of the rotary pick 66, and the cam springs 75 are fixed to the cap 65*a* on both sides of the rotary pick 66. Each cam plate 76 has four corners, and the cam springs, which are leaf springs made of metal, are urged to be always held in contact with the cam plates 76. The brake unit 76/75 permits the associated rotary pick 66 to be rotated in the clockwise direction. However, the brake unit 76/75 prohibits the rotary pick 66 from the rotation in the counter clockwise direction.

Figures 23A, 23B, 23C, 23D:
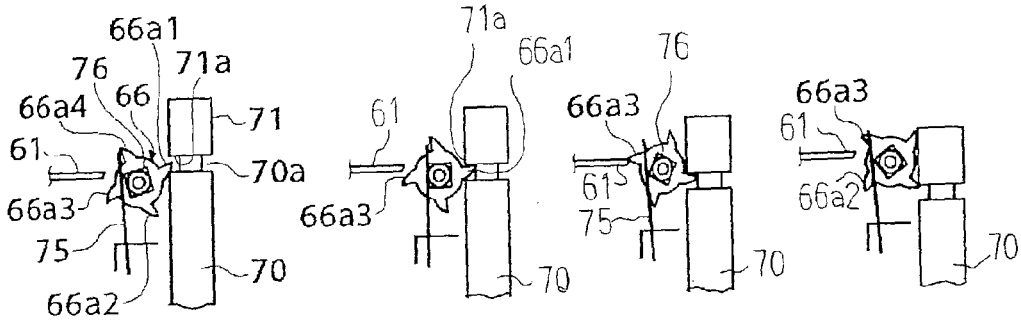
FIGS. 23A to 23H are schematic views illustrating a plucking motion of the rotary pick.

The player's finger 20G plucks the associated reed 61 as shown in FIGS. 23A to 23H. FIG. 23A shows the plunger 71 at the upper dead point, and the claw 66*a*1 is resting in the ring space 70*a*. The controller is assumed to energize the coil 68. The plunger 70 starts the downward motion against the elastic force of the spring 69. The inner portion 71 a is brought into contact with the claw 66*a*1 as shown in FIG. 23B. However, the claw 66*a*3 is still spaced from the tip of the reed 61.

The plunger 70 is further moved downwardly, and gives rise to the rotation of the rotary pick 66 in the clockwise direction. The cam plates 76 are rotated against the elastic force of the cum springs 75 exerted on the corners, and the claw 66*a*3 plucks the reed 61 as shown in FIG. 23C. The reed 61 vibrates, and generates a tone. The plunger 70 is further moved downwardly, and the rotary pick 66 is rotated in the clockwise direction. However, the next claw 66*a*2 has not reached the vibrating reed 61, and the rotary pick 66 does not interfere with the vibrating reed 61 as shown in FIG. 23D. When the plunger 70 reaches the lower dead point, the next claw 66*a*2 is still spaced from the vibrating reed 61.

The magnetic field is removed from the solenoid-operated cylindrical actuator CYL1, and the plunger spring 69 urges the plunger 70 in the upward direction. Although the head block 71 pushes the claw 66*a*4, the cam springs 75 and cam plates 76 do not permit the rotary pick 76 to be rotated in the counter clockwise direction, because the braking force is larger than the friction between the head block 71 and the claw 66*a*4 (see FIG. 23E).

Figures 23E, 23F, 23G, 23H:
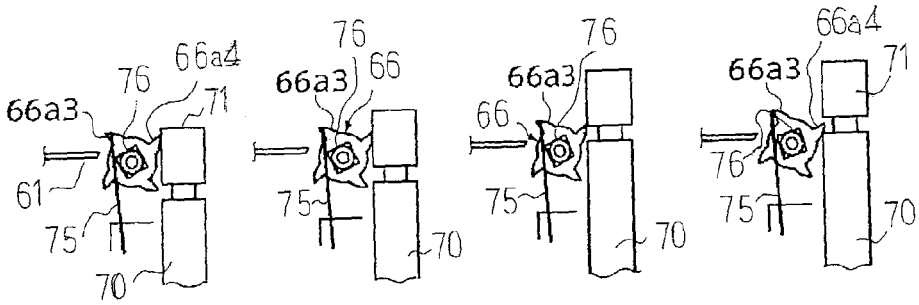

FIGS. 23F and 23G illustrate the plunger 70 on way to the upper dead point. However, the cam plates 76 and cam springs 75 prevent the rotary pick 66 from the rotation in the counter clockwise direction. When the plunger 70 reaches the upper dead point, the head block 71 is spaced from the claw 66*a*4, which is to be pushed during the next downward motion of the plunger 70, and the cam springs 75 slightly rotate the rotary pick 66 in the clockwise direction. As a result, the next claw 66*a*4 slides into the ring space as shown in FIG. 23H.

The musical instrument achieves all the advantages of the above-described musical instrument according to the present invention. Moreover, the player's fingers 20G pluck the associated reeds 61 surer than the player's fingers 20E, because the head blocks 71 faithfully reciprocate the given trajectories. The brake unit 75/76 not only prevents the rotary pick 66 from the reverse rotation but also keep the claws 66*a* at the same position in the ring space 70*a* after the spring 69 spaces the head block 71 from the claws 66*a*. The magnetic force exerted on the plunger 70 is constant, and the head block 71 exerts the constant force on the claw 66*a*. This results in the clear tones at constant loudness.

Figure 24:
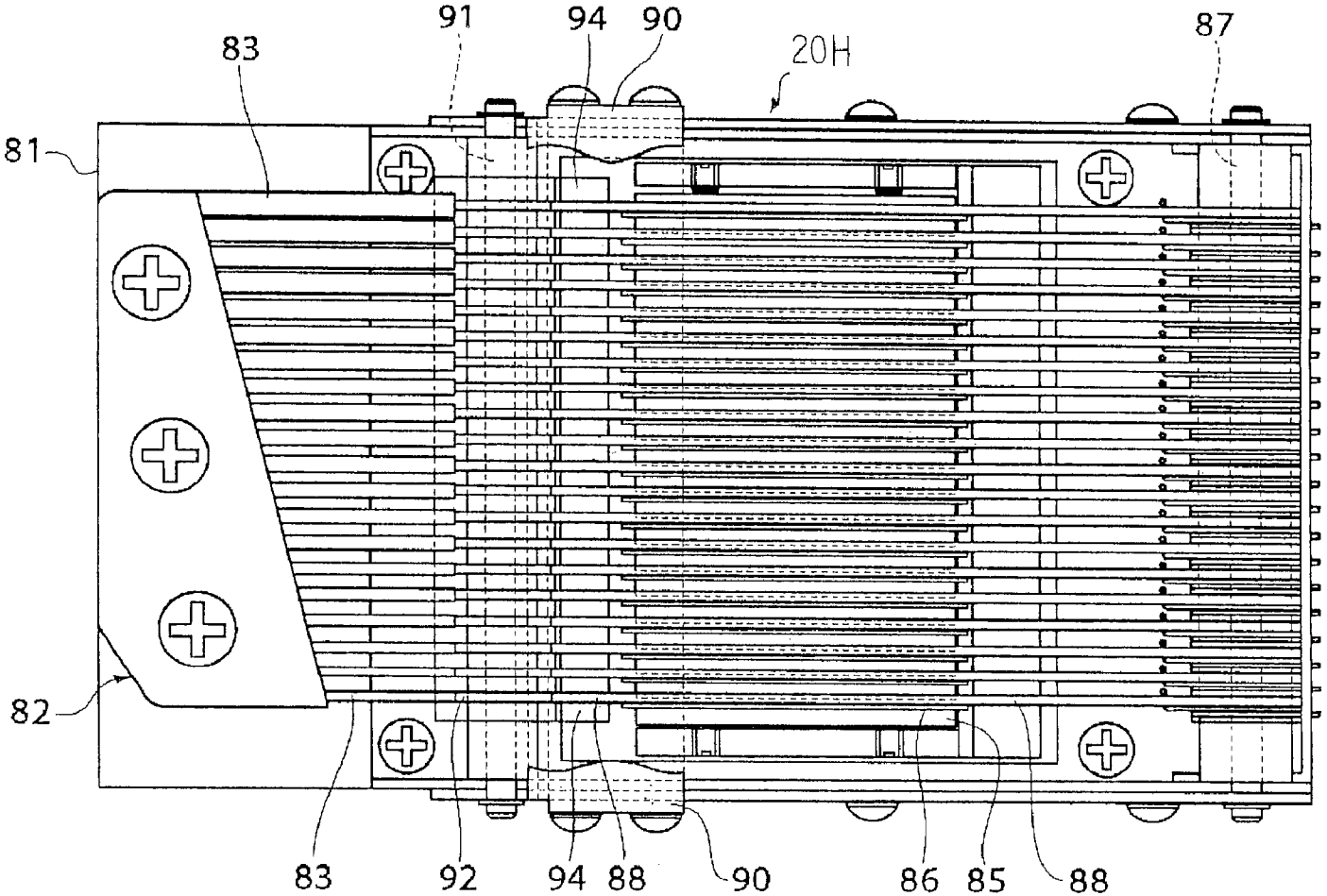
FIG. 24 is a plane view showing the layout of a musical instrument according to the present invention.
Figure 25A:
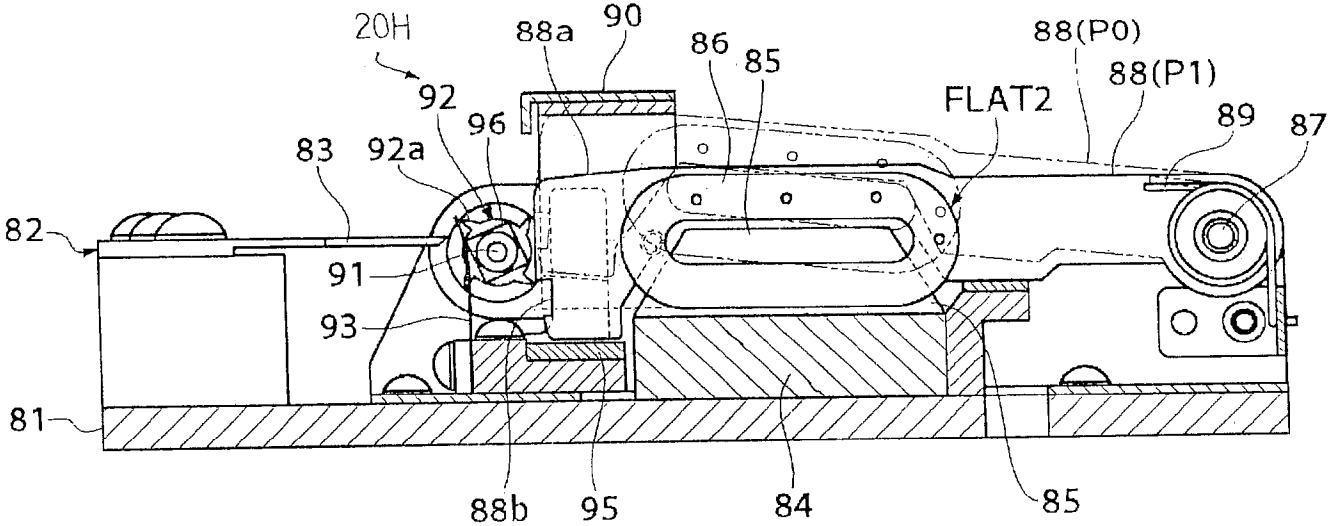
FIG. 25A is a cross sectional view showing the structure of the musical instrument.

FIGS. 24 and 25A show another musical instrument according to the present invention. The musical instrument comprises an array 82 of reeds 83 and an automatic player. The automatic player includes plural player's fingers 20H and a controller, which is same as the controller 20Ab shown in FIG. 16.

The array 82 is like a comb, and the reeds 83 project in parallel like the teeth of the comb. The reeds 83 are different in length and width so that tones different in pitch are generated by the reeds 83. The array 82 is mounted on a block, and is fixed to the base plate 81 by means of bolts.

Solenoid-operated flat actuators FLAT2 are employed in the player's fingers 20H, and include permanent magnet plates 84, yokes 85, flat coils 86 and swingable arms 88. The flat coils 86 are respectively attached to the side surfaces of the swingable arms 88. The yokes 85 are taller than the permanent magnet plates 84, and the yokes 85 and permanent magnet plates 84 are alternated with one another. For this reason, gaps take place between the yokes 85, and the swingable arms 88 are resting in the gaps together with the flat coils 86 as shown in FIG. 25B.

The arms 88 are swingably connected at the rear ends thereof to a shaft 87, which in turn is supported by the base plate 81. Arm springs 89 are provided for the swingable arms 88, respectively, and always urge the swingable arms 88 in the clockwise direction in FIG. 25A so that free end portions of the arms 88 are rested on the lower surface of the upper stopper 90, which is fixed to the base plate 81, without any magnetic field. The rest positions of the swingable arms 88 are indicated by 88(P0), and the upper surfaces of the swingable arms 88 are held in contact with the lower surface of the upper stopper 90 at the rest positions. A lower stopper 95 is further fixed to the base plate 81, and receives the free end portions of the arms 88 at the end of the rotation in the counter clockwise direction. 88(P1) is indicative of the swingable arm 88 on the way to the lower stopper 95. Guide plates 94 (see FIG. 24) are provided on both sides of each swingable arm 88, and define the trajectory of the associated swingable arm 88. For this reason, the trajectory of the swingable arm 88 is perpendicular to the upper surface of the base plate 81.

Figure 25C:
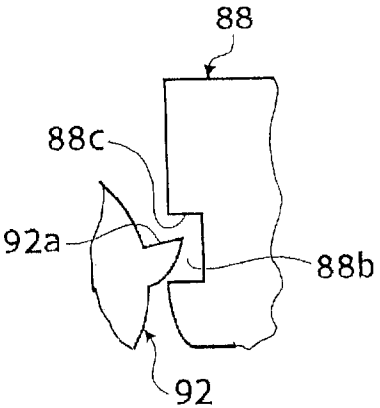
FIG. 25C is a schematic side view showing the swingable arm and an associated rotary pick.
Figure 25B:
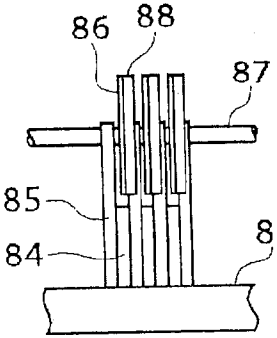
FIG. 25B is a front view showing swingable arms and solenoid-operated flat actuators.

The swingable arms 88 are respectively formed with notches 88*b* in the free end portions as shown in FIG. 25C. Rotary picks 92 are rotatably connected to a shaft 91, which is supported at both end portions thereof by the base plate 81. A brake unit 93/96 is associated with each of the rotary pick 92. The rotary pick 92 and brake unit 93/96 are same as those of the music player shown in FIGS. 21 to 23H. For this reason, detailed description is omitted for the sake of simplicity.

The claws 92*a* selectively enter the notch formed in the associated swingable arm 88. While the swingable arm 88 is rotating in the counter clockwise direction, the edge 88*c*, which partially defines the notch 88*b*, presses the claw 92*a*, and gives rise to rotation of the rotary pick 92. When the rotary pick 92 is rotated over a predetermined angle, the brake unit 93/96 stops the rotary pick 92, and does not permit the rotary pick 92 from the reverse rotation.

Assuming now that the controller 20Ab energizes the flat coil 86 shown in FIG. 25A, the magnetic force is exerted on the flat coil 86 and, accordingly, the swingable arm 88 so as to give rise to the rotation of the swingable arm 88 about the shaft 87 in the counter clockwise direction against the elastic force of the arm spring 89. The swingable arm 88 starts the rotation at the rest position 88(P0), and is moved on the trajectory toward the lower stopper 95.

The edge 88*c* is brought into contact with the claw 92*a*, and gives rise to the rotation of the rotary pick 92 in the clockwise direction against the elastic force of the cam springs 93. Subsequently, the claw 92*a*, which is at the opposite position 180 degrees spaced from the claw 92*a* pressed by the edge 88*c*, is brought into contact with the associated reed 83, and plucks it. The reed 83 vibrates, and generates the tone. When the swingable arm 88 reaches the lower stopper 95, the reed 83 is vibrating in the space between the claw 92*a* and the next claw 92*a* so that the rotary pick 92 does not interfere with the vibrating reed 83.

When the magnetic force is removed from the flat coil 86, the arm spring 89 rotates the swingable arm 88 in the clockwise direction. Although the friction between the claw 92*a* and the swingable arm 88 urges the rotary pick 92 in the counter clockwise direction, the brake unit 93/96 does not permit the rotary pick 92 from the reverse rotation. The swingable arm 88 reaches the upper stopper 90, and the cam springs 93 urge the rotary pick 92 in the clockwise direction so that the next claw 92*a* enters the notch 88*b*.

The musical instrument achieves the advantages by virtue of the solenoid-operated flat actuators FLAT2, rotary picks 92 and brake units 93/96. Moreover, the swingable arms 88 are stable and large in mechanical strength so that the musical instrument is durable.

Figure 26A:
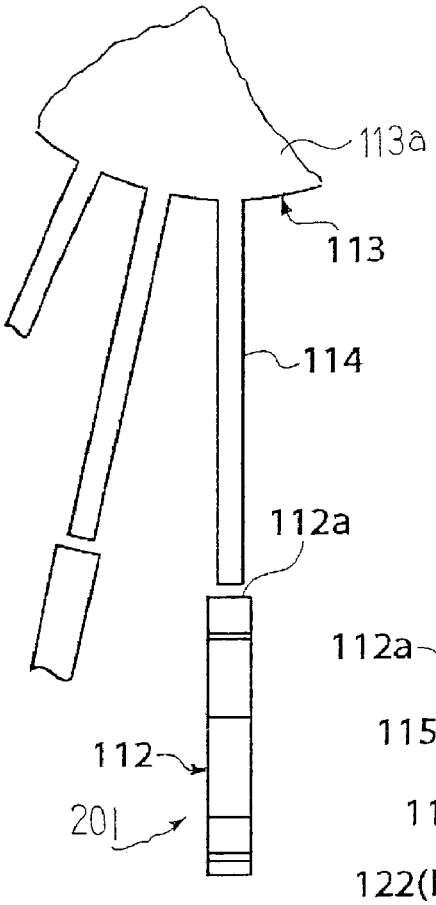
FIG. 26A is a plane view showing another musical instrument according to the present invention.
Figure 26B:
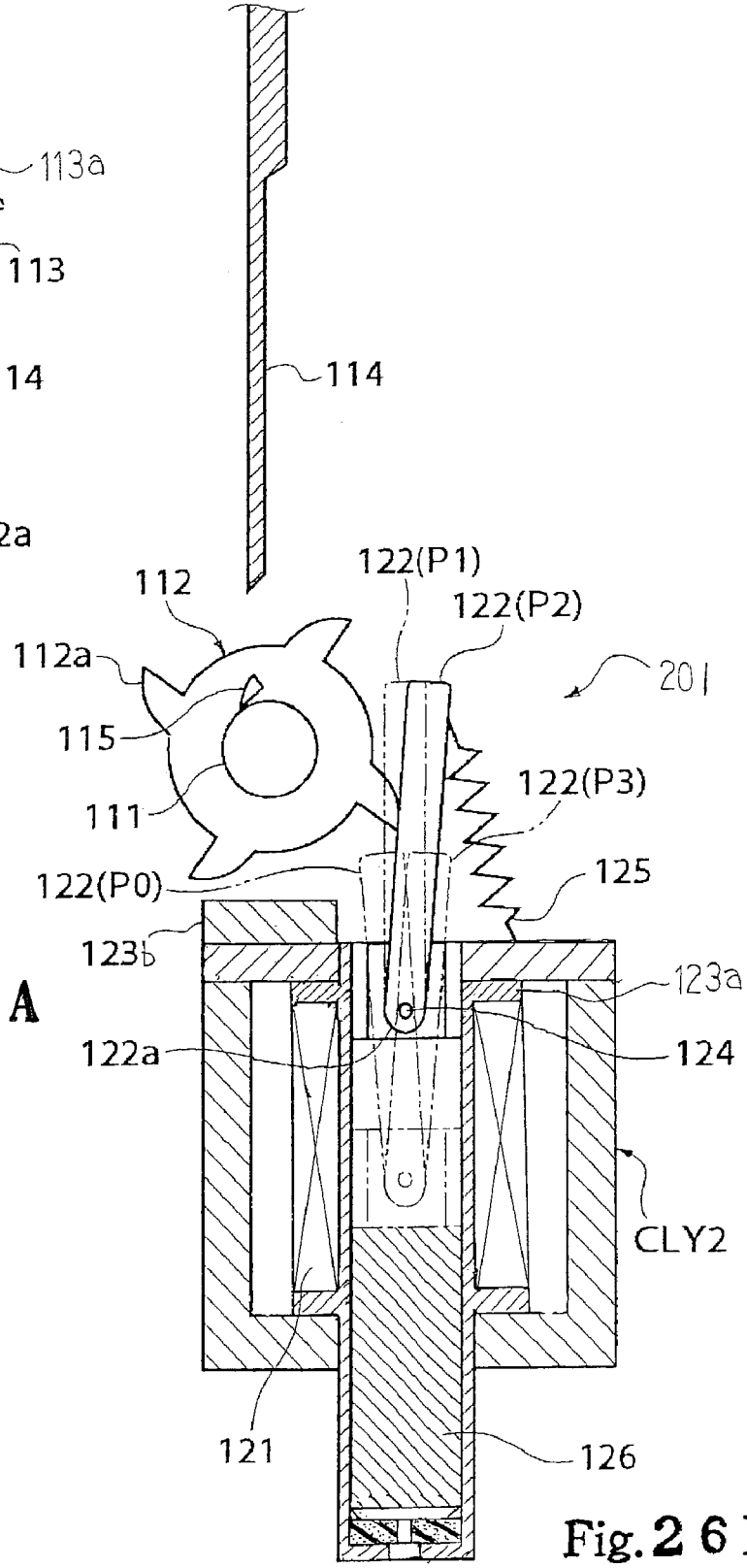
FIG. 26B is a cross sectional view showing the structure of a player's finger incorporated in the musical instrument.

FIGS. 26A and 26B show another musical instrument according to the present invention. The musical instrument comprises an automatic player and a daisy reed wheel 113, which forms a part of a tone generator. The automatic player includes plural player's fingers 20I and the controller 20Aa (see FIG. 12). The daisy reed wheel 113 has reeds 114 radially outwardly projecting from the circular periphery of a disk 113*a*, and the player's fingers 20I are disposed in the proximity of the tips of the reeds 114. In this instance, twenty-four reeds project from the disk 113*a*, and are different in length and width from one another for generating tones different in pitch.

The player's finger 20I includes a solenoid-operated actuator CLY2, a rotary pick 112, a pusher 122 and a spring 125. The solenoid-operated actuator CLY2 is similar to the solenoid-operated 21C (see FIG. 14), and includes a coil 121, a bobbin 123*a*, a bottom yoke 123*b* and a plunger 126. The pusher 122 has a lower end portion 122*a*, which is rotatably connected to a pin 124, and the string 125 is connected at one end thereof to the upper end portion of the pusher 122 and at the other end thereof to the bottom yoke 123*b*. While the plunger 126 is staying at the rest position, the spring 125 exerts a negligible amount of elastic force on the pusher 122. However, the elastic force is increased together with the stroke of the plunger 126 from the rest position. Since the bottom yoke 123*b* has the inward portion upwardly project from the remaining portion, pusher 122 is inwardly inclined in the magnetic field. While the plunger 126 is projecting upwardly, the pusher 122 is spaced from the bottom yoke 123*b*, and the magnetic force exerted on the pusher 122 is decreased. When the elastic force exceeds the magnetic force, the pusher 122 is outwardly inclined.

The rotary pick 112 is rotatably supported by the shaft 111 between the tip of the associated reed 114 and the solenoid-operated actuator CLY2. The rotary pick 112 has plural claws 112*a* spaced at regular intervals, and a ratchet 115 is provided for the rotary pick 112. The ratchet 115 permits the rotary pick 112 in the counter clockwise direction in FIG. 26B.

The controller 20Aa is assumed to energize the solenoid-operated actuator CLY2, current flows through the coil 121, and magnetic field is created. The pusher 122 is inwardly inclined as indicated by 122(P0), and the plunger 126 starts to project upwardly. The pusher 122 is brought into contact with the claw 112*a*, and gives rise to rotation of the rotary pick 112 in the counter clockwise direction. Another claw 112*a* warps the reed 114, and escape from the reed 144. Then, the reed 114 vibrates, and generates the tone. The ratchet 115 stops the rotary pick 112. When the elastic force exceeds the magnetic force, the pusher 122 escapes from the claw 112*a*.

When the pusher 122 reaches the upper dead point 122(P1), the controller 20Aa removes the magnetic field from the solenoid-operated actuator CLY2 so that any magnetic force is not exerted on the pusher 122. The spring 125 outwardly inclines the pusher 122 as indicated by 122(P2), and the plunger 126 is retracted into the bobbin 123*a*. When the plunger 126 reaches the lower dead point, the pusher 122 returns to the rest position 122(P3). Thus, the pusher 122 returns to the rest position without any interference with the claw 112*a*.

The musical instrument achieves the advantages by virtue of the rotary pick 112 and solenoid-operated actuator CLY2. The player's fingers 20I shown in FIG. 26B do not set any limit to the positions to be occupied. Other player's fingers may be provided over the rotary picks 112.

Figure 27A:
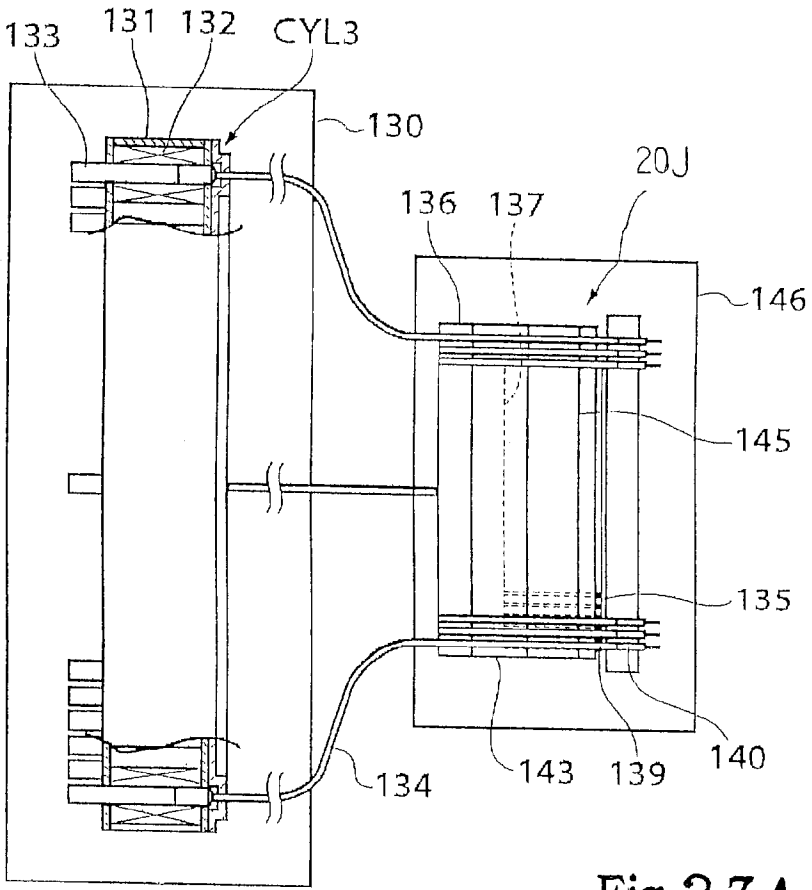
FIG. 27A is a plane view showing the layout of another musical instrument according to the present invention.
Figure 27B:
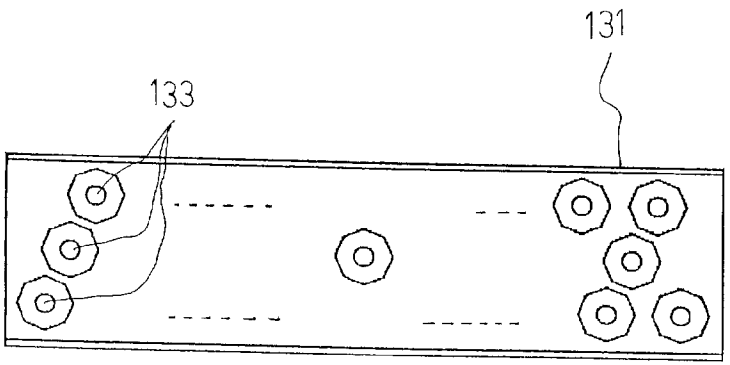
FIG. 27B is a rear view showing the structure of the musical instrument on the left side.
Figure 28:
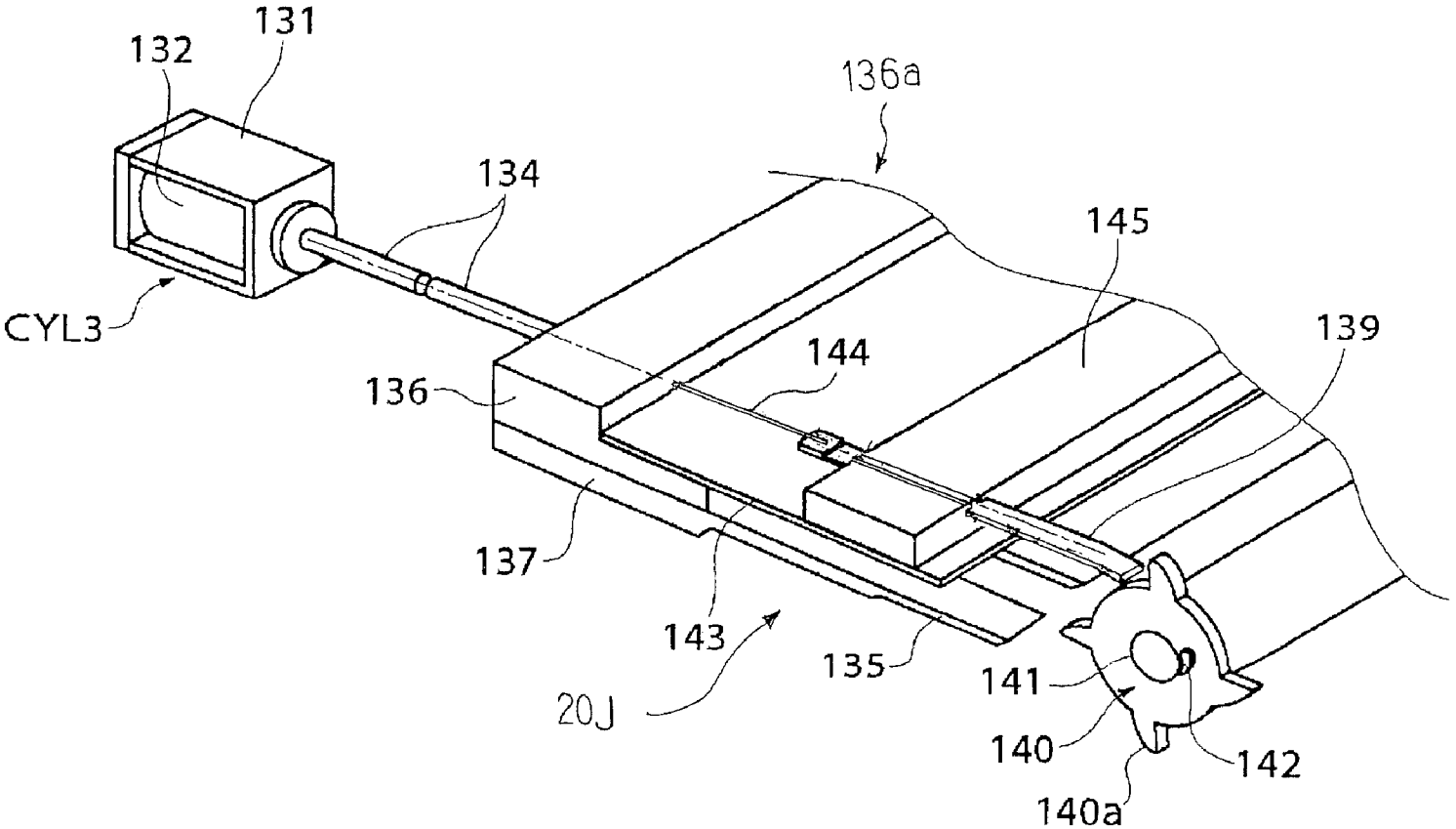
FIG. 28 is a perspective view showing a player's finger incorporated in the musical instrument.

FIGS. 27A, 27B and 28 show another musical instrument according to the present invention. The musical instrument is also broken down into a tone generator and an automatic player. The tone generator includes plural reeds 135 arranged like a comb on a base plate 146. The reeds 135 project from a boss portion 137 in parallel to one another. In the following description, term "front" is indicative of a relative position close to the right side of the paper where FIGS. 27A and 27B are drawn. For this reason, the reeds 135 project frontward.

On the other hand, the automatic player includes the controller 20Aa and plural player's fingers 20J, which share a guide frame 136*a* on the base plate 146 and a yoke 131 on a base plate 130 spaced from the base plate 146. The guide frame 136*a* is fixed to the base plate 146, and is provided over the reeds 135. The player's fingers 20J are respectively associated with the reeds 135.

Each of the player's fingers 20J includes a solenoid-operated actuator CYL3, a flexible tube 134, a wire 144, a pusher 139, a rotary pick 140 and a ratchet 142. The yoke 131 is fixed to the base plate 130, and is shared among the solenoid-operated actuators CYL3. Coils 132 are retained by the yoke 131, and are partially overlapped with one another. For this reason, plungers 133, which are respectively inserted into the coils 132, are exposed to the rear surface of the yoke 131 as shown in FIG. 27B.

The wire 144 is inserted into the flexible tube 134, and is connected at one end thereof to the associated plunger 133 and at the other end to the pusher 139. The wire 144 is flexible, and is strong enough to transmit the force to the pusher 139. A piano wire may be used as the wire 144. Even if the flexible tube 134 is winded, the wire 144 can slide inside the winded tube 134.

The guide frame 136*a* has two guide blocks 136 and 146 and a base plate 143. The guide blocks 136/145 are as wide as the array of reeds 135. The guide block 145 is frontward spaced from the other guide block 136, and are fixed to the base plate 143. Through-hole are formed in the guide block 136 for the flexible wires 144, and grooves are formed in the other guide block 145 for the pushers 139. The flexible wires 144 pass through the through-holes, and the pushers 139 are slidably received in the groove. The pushers 139 frontward project from the front end surfaces of the guide block 145. When the plungers 133 project from the yoke 131, the plungers 133 push the flexible wires 144, and the flexible wires 144 transfer the force to the associated pushers 139. As a result, the pushers 139 frontward project from the guide block 145. The pushers 139 are made from a relatively thin metal plate, and are elastically deformable.

The shaft 141 is arranged in parallel to the guide block 145, and the rotary picks 140 are rotatably supported by the shaft 141 at intervals. The rotary picks 140 are close to the associated pushers 139 and associated reeds 135. The ratchets 142 permit the associated rotary picks 140 in the clockwise direction in FIGS. 29A and 29B. Each of the rotary picks 140 has plural claws 140*a* spaced at regular intervals. In this instance, four claws 140*a* radially project at intervals of 90 degrees.

Figure 29A:
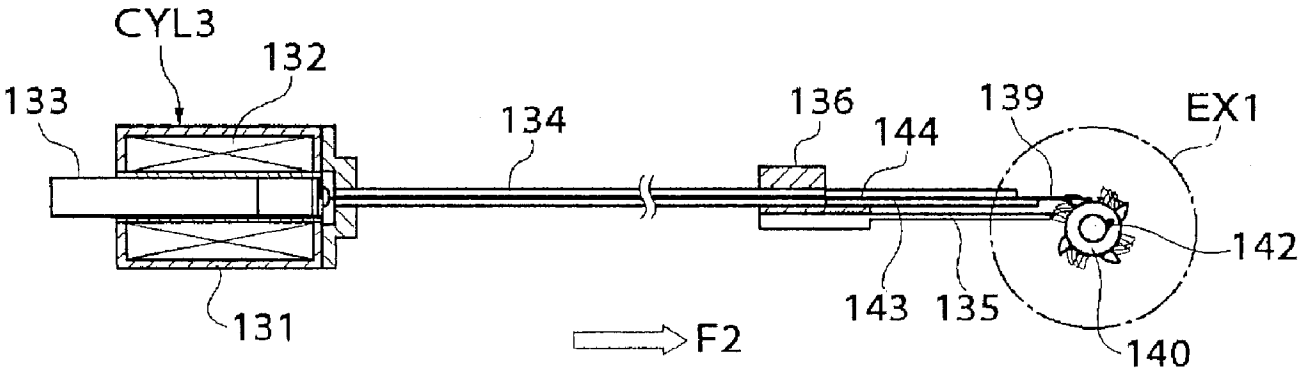
FIG. 29A is a side view showing the player's finger.
Figure 29B:
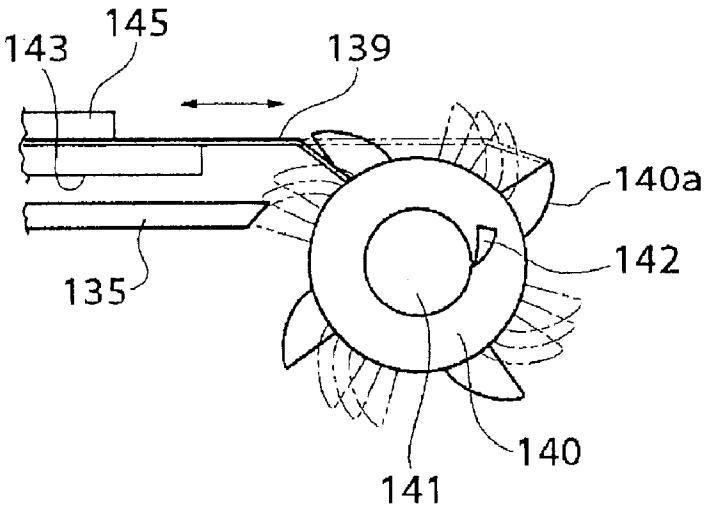
FIG. 29B is a side view showing the parts encircled in EX1 of FIG. 29A, FIGS. 30A and 30B are side views showing a modification of the player's finger shown in FIG. 28.

Assuming now that the controller 20Aa energizes the solenoid-operated actuator shown in FIG. 29A, the current flows through the coil 132, and creates magnetic field. Then, the plunger 133 frontward projects from the yoke 131, and the force F2 is transmitted from the plunger 133 through the flexible wire 144 to the pusher 139. The pusher 139 frontward projects from the guide block 145, and is brought into contact with one of the claws 140*a*. Although the tip of the pusher 139 is deformed (see FIG. 29B), the force F2 gives rise to the rotation of the rotary pick 140 over 90 degrees. While the rotary pick 140 is rotating, another claw 140*a* plucks the reed 135 so that the reed 135 vibrates for generating a tone. The claw 140*a*, which has plucked the reed 135, reaches the position occupied by the claw 140*a* previously pushed by the pusher 139.

When the controller 20Aa removes the magnetic field, a return spring (not shown) moves the plunger 133 backwardly, and the plunger 133 is retracted into the yoke 131. The plunger 133 pulls the flexible wire 144 and the pusher 139. The pusher 139 slides on the claw 140*a* backwardly. However, the ratchet 142 does not permit the rotary pick 140 to rotate in the counter clockwise direction. The tip of the pusher 139 is warped, and returns to the rest position.

The musical instrument achieves the advantages by virtue of the rotary wheel 140. Moreover, the solenoid-operated actuators CYL3 are connected to the pushers 139 by means of the flexible wires 144 so that the manufacturer can locate the base plates 130 and 146 at the optimum positions. Thus, the flexible wires 144 enhance the design flexibility.

The yoke 131 may be separated into yokes, which are incorporated in the solenoid-operated actuators CYL3, respectively. The yoke may be replaced with a pair of plates. In this instance, each of the coils 132 is sandwiched between the plates.

Figure 30A:
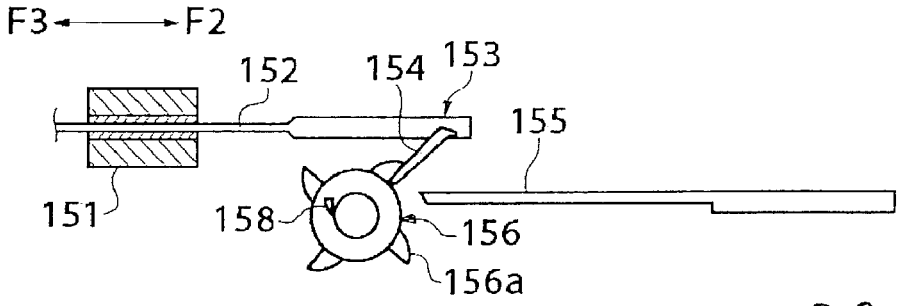
FIG. 30C is a side view showing another modification of the player's finger.
Figure 30B:
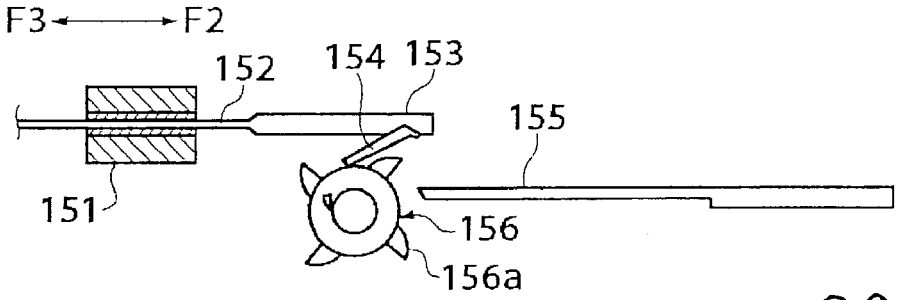

In the musical instrument described hereinbefore, the pusher 139 projects from the guide block 145 for exerting the force on the claw 140*a* of the rotary pick 140. Another musical instrument may have a reciprocal rod 153 instead of the pusher 139 as shown in FIGS. 30A and 30B. In these figures, reference numeral 155 designates one of the reeds of a comb-like array, and rotary picks 156 are rotatably supported in the proximity of the associated reeds 155. The ratchets 158 are provided on the rotary picks 156, and permit the associated rotary picks 156 in the counter clockwise direction over the predetermined angle. Though not shown in the figures, the solenoid-operated actuators CYL3 are connected through flexible wires 151 to the reciprocal rods 153, and a guide block 151 slidably supports the flexible wires 152. Arms 154 are swingably connected to the tips of the reciprocal rods 153, and springs (not shown) always urge the swingable arms 154 in the counter clockwise direction. However, stoppers (not shown) do not allow the arms 154 to rotate beyond the positions shown in FIG. 30A. While the controller 30Aa is keeping the solenoid-operated actuators CYL3 non-magnetized, the reciprocal rods are staying at the rest positions spaced from the guide block 151, and the tip of the reed 155 is in the gap between the claws 156*a* as shown in FIG. 30A.

The solenoid-operated actuator CYL3 is assumed to pull the flexible wire 152. The reciprocal rod 153 is moved in the direction indicated by F3, and the arm 154 gives rise to the rotation of the rotary pick 156 in the counter clockwise direction. The ratchet 158 permits the rotary pick 156 to rotate over the predetermined angle, and another claw 156*a* plucks the reed 155 as shown in FIG. 30B. The reed 155 vibrates, and generates a tone.

The controller 20Aa removes the magnetic field from the solenoid-operated actuator CYL3. Then, the spring (not shown) moves the flexible wire 152 and the reciprocal rode 153 in the direction F2. Although the claw 156*a* is the obstacle against the arm 154 moved in the direction F2, the arm 154 is folded against the elastic force of the spring, and returns to the rest position. Even though the arm 154 slides on the claw 156*a*, the ratchet 158 keeps the rotary pick 156 stable. Thus, the player's finger achieves all the advantages of the player's finger 20J.

Figure 30C:
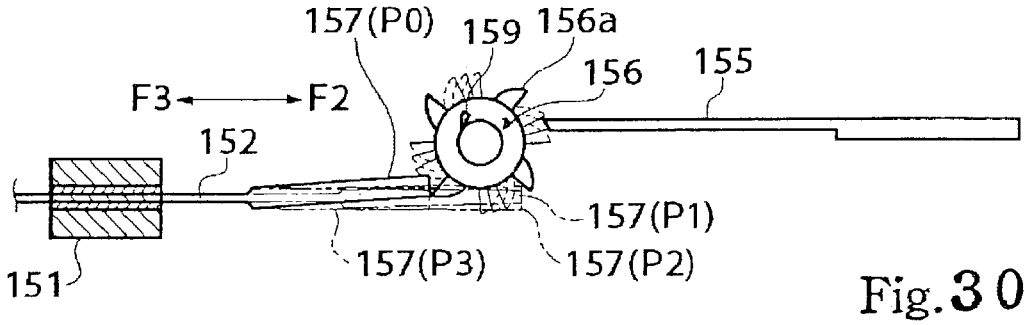
Figure 31:
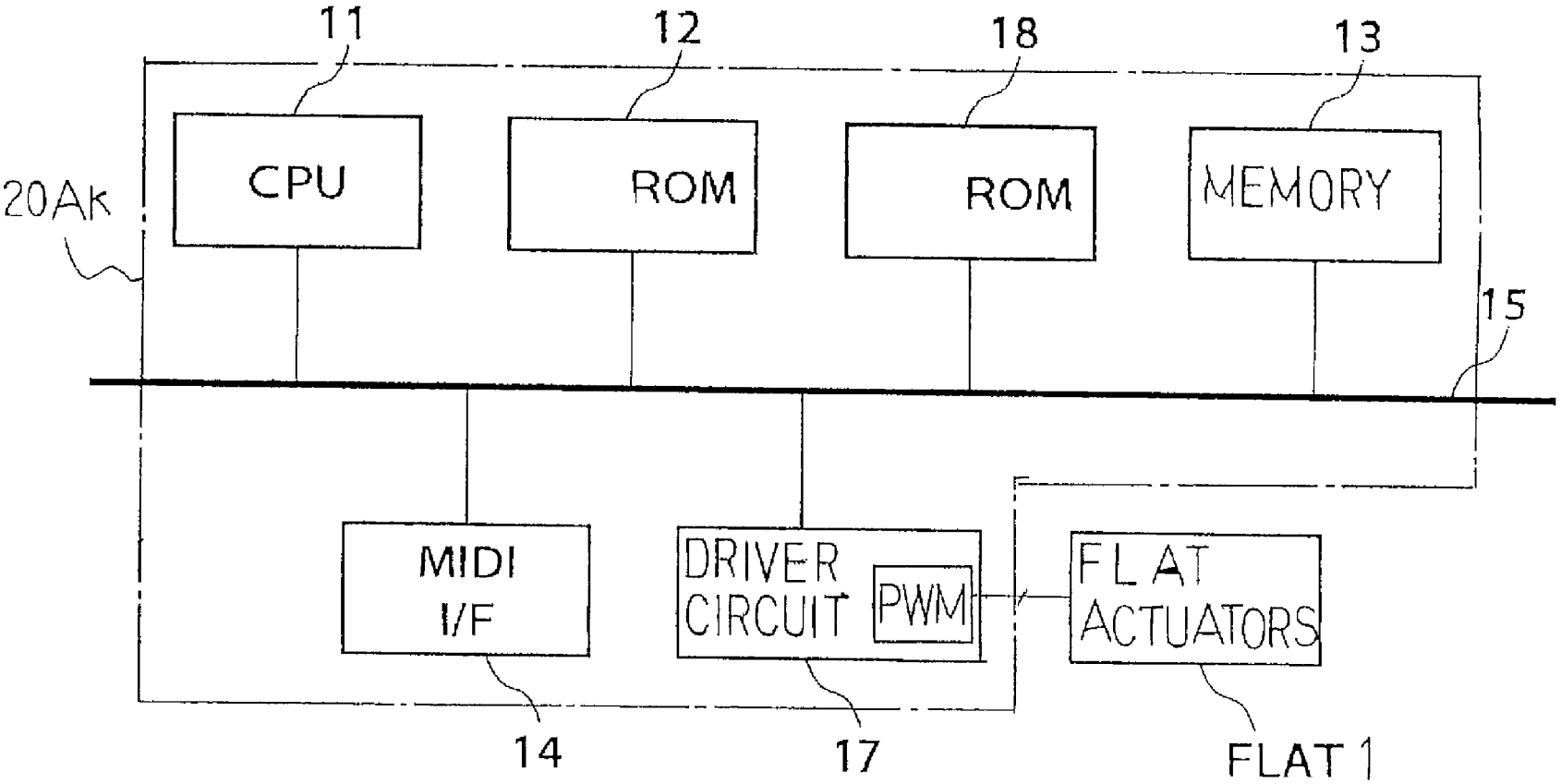
FIG. 31 is a block diagram showing the system configuration of a controller incorporated in another musical instrument according to the present invention.
Figure 32:
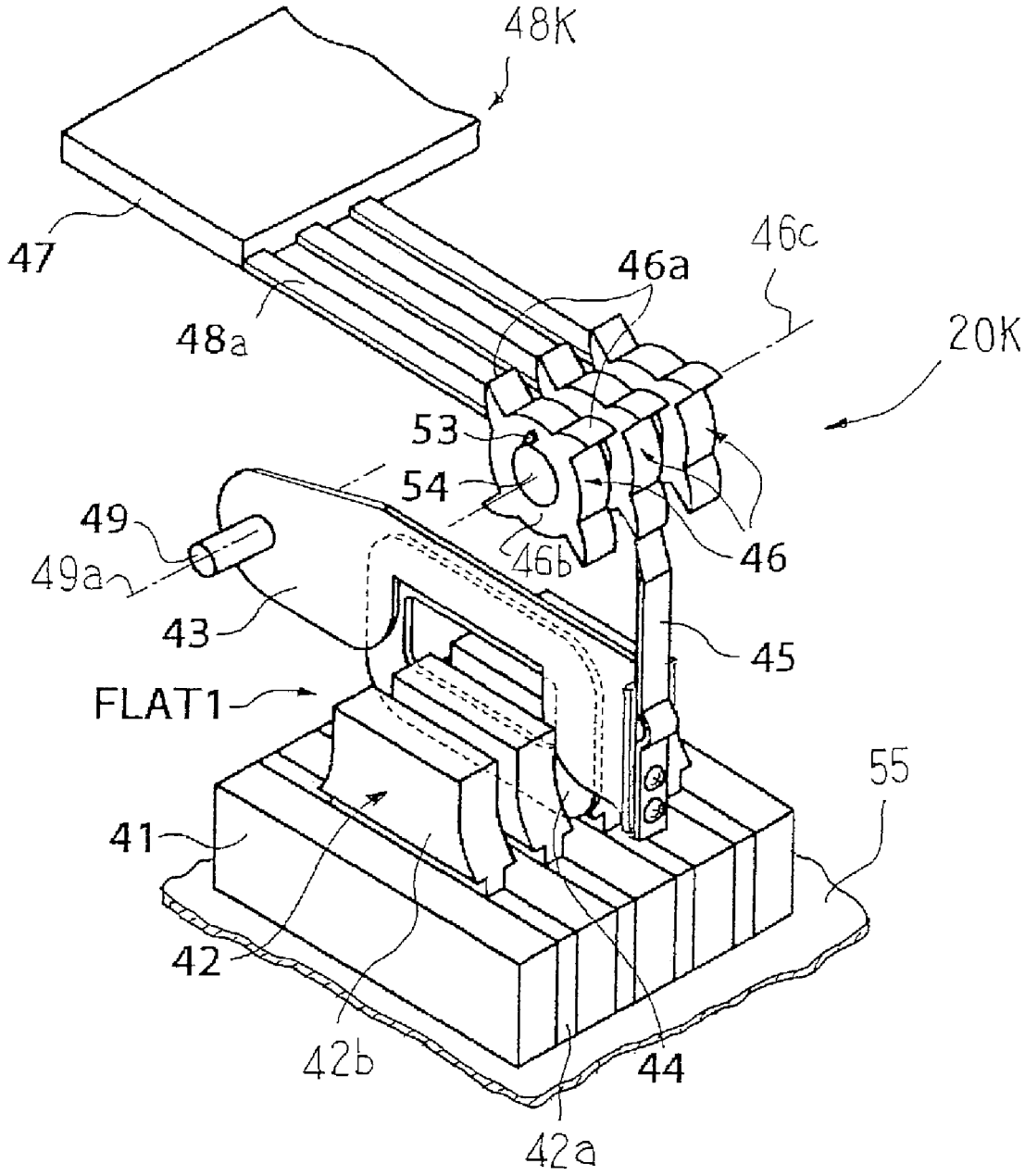
FIG. 32 is a perspective view showing the structure of a player's finger incorporated in the musical instrument.

The pusher 139 may be replaced with a foldable pusher 157 shown in FIG. 30C. The ratchet 159 permits the rotary pick 156 to rotate in the counter clockwise direction, and the foldable pusher 157 is connected through the flexible wire 152 to the plunger of the solenoid-operated actuator CYL3. A spring urges the foldable pusher 157 at a slightly raised attitude at the rest position 157(P0).

The plunger 133 is assumed to project from the yoke 131. The flexible wire 152 and the foldable pusher 157 project from the rest position 157(P0) to the position 157(P1), and gives rise to the rotation of the rotary pick 156 in the counter clockwise direction. The claw 156*a* plucks the reed 155 for vibrations.

When the controller 20Aa removes the magnetic field from the solenoid-operated actuator CYL3, the flexible wire 152 and foldable pusher 157 are moved in the direction F3. The foldable pusher 157 is stretched against the elastic force of the spring as indicated by 157(P2), and passes under the claw 156*a* as indicated by 157(P3).

As will be understood from the foregoing description, the musical instruments implementing the second embodiment have the following advantages. The musical instruments equipped with the rotary picks make the reeds vibrate with the claws, and the reeds vibrate in the gap between the claws. This results in the natural vibrations without interference. In other words, clear tones are generated from the vibrating reeds.

The rotary picks change themselves between the plucking positions and the shunt positions through the rotation thereof Any additional space is not required for leaving the reeds vibrating. Moreover, the rotary picks per se require narrow space. Thus, the rotary picks are conducive to the compactness of the musical instruments.

Another advantage by virtue of the rotary picks is promptness. The rotary picks require the rotation over the predetermined angle for changing their positions. Even if the controller quickly changes the plunger of the solenoid-operated actuator between the projecting position and the retracted position, the rotary pick can respond to the quick motion so that the musical instrument reproduces the repetition on the certain reed.

The reeds are replaceable with another sort of vibrating members such as, for example, strings or tone bars. Although the strings are plucked, the tone bars are beaten with mallets. In this instance, the player's fingers selective beat the tone bars.

Third Embodiment

Prototype

FIGS. 31, 32, 33A and 33B show a musical instrument embodying the present invention. The musical instrument is categorized in the music box. The musical instrument largely comprises a tone generator and an automatic player as similar to the first and second embodiments. The tone generator is implemented by a comb-like array 48K of reeds 48*a*, and the automatic player comprises a controller 20Ak and player's fingers 20K. The comb-like array 48K of reeds 48*a*, controller 20Ak and player's fingers 20K are similar in structure to the array 48 of reeds 48, controller 20Ab and player's fingers 20E shown in FIGS. 16 and 17. For this reason, component circuits of the controller 20Ak and component parts of the comb-like array 48K and player's fingers 20K are labeled with references designating corresponding circuits of the controller 20Ab and corresponding parts of the array 48 and player's finger 20E without detailed description.

Figure 33B:
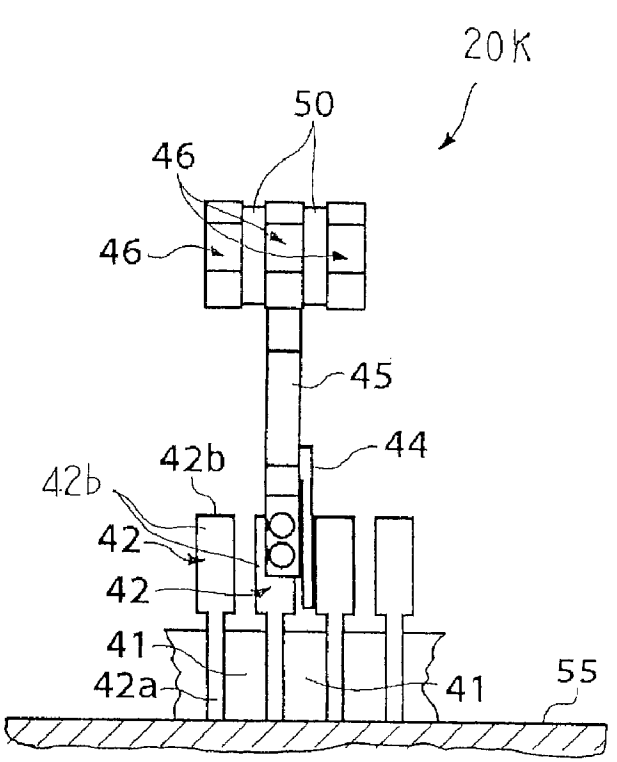
FIG. 33B is a rear view showing the player's finger.
Figure 33A:
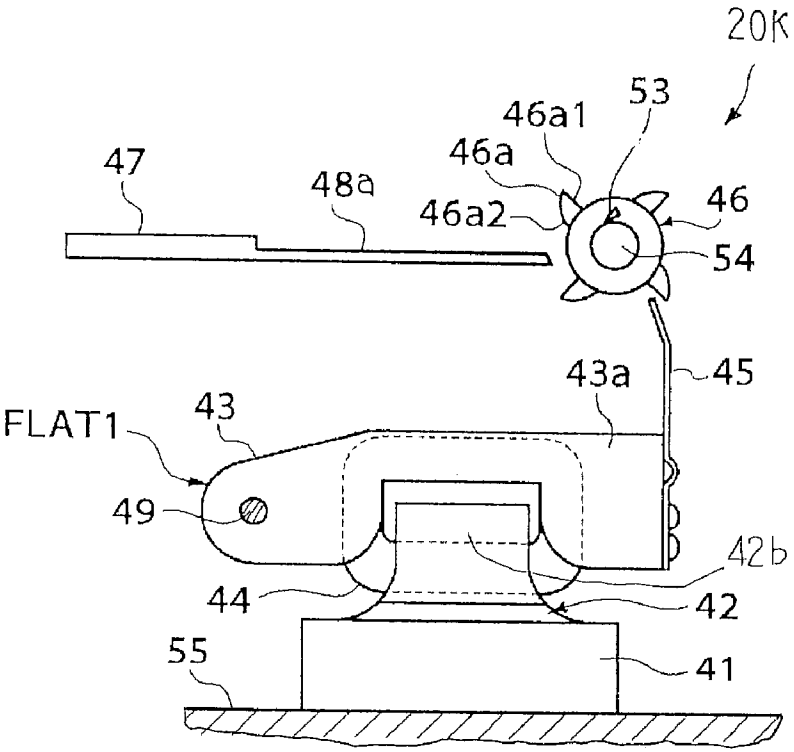
FIG. 33A is a side view showing the player's finger before plucking.

Assuming now that a user requests the automatic player to perform a piece of music, the central processing unit 11 sequentially accesses music data codes stored in the memory 13, and instructs the driver circuit 17 to selectively energize the solenoid-operated flat actuators FLAT1 While the central processing unit 11 is sequentially processing the music data, the central processing unit 11 is assumed to instruct the driver circuit 17 to pluck the reed 48*a* shown in FIG. 33A. The flat coil 44 has not been energized so as to keep the swingable arm 43 horizontal. The tip of the blade 45 stands upright, and is spaced from the rotary pick 46.

Figure 34:
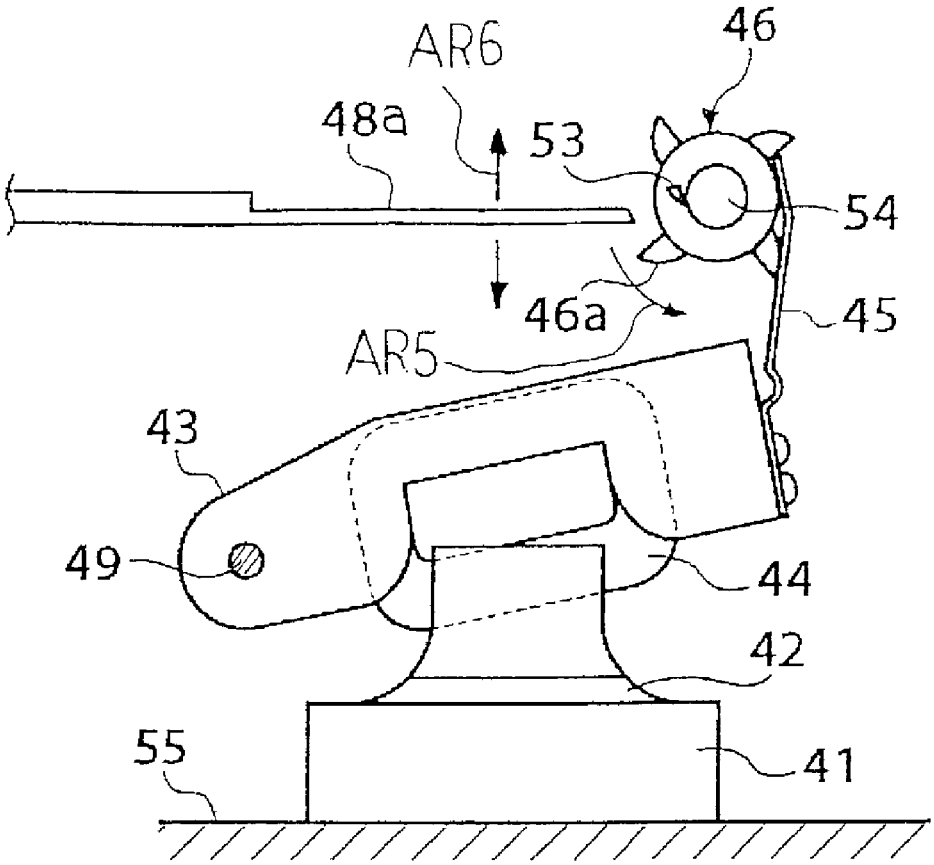
FIG. 34 is a side view showing the player's finger after the plucking.

The driver circuit 17 determines the pulse width to be required for the target loudness, and the pulse width modulator PWM supplies the driving signal with the pulse width to be required for the target loudness to the flat coil 44. When the current flows through the flat coil 44, the magnetic force is exerted on the flat coil 44, and gives rise to rotation of the swingable arm 43 in the counter clockwise direction. The blade 45 is brought into contact with the flat back surface 46*a*1 of the rotary pick 46, and pushes it. The rotary pick 46 is driven for rotation over 90 degrees as indicated by arrow AR5 (see FIG. 34), and plucks the reed 48*a* with the claw 46 spaced 180 degrees from the claw 46 pushed by the blade 45. The reed 48*a* vibrates as indicated by arrow AR6, and generates the tone. The disk 46*b* is spaced from the vibrating reed 48*a*, and the claws 46*a* are out of the trajectory of the vibrating reed 48*a*. Thus, the rotary pick 46 does not interfere with the vibrating reed 48*a*.

The driver circuit 20Ab removes the driving signal from the flat coil 44. Then, the self weight causes the swingable arm 43, flat coil 44 and blade 45 to return to the rest position shown in FIG. 33A. The ratchet 53 prevents the rotary pick 46 from the reverse rotation.

In this instance, the controller 20Ak selectively energizes the flat coils FLAT1 for plucking the reeds 48*a* with the claws 46*a*. This means that the plural rotary picks 46 can concurrently pluck the reeds 48*a* for producing a chord. The rotary pick 46 is rotated over only the predetermined angle for plucking the reed 48*a*. The rotary pick 46 is responsive to quick repetition so that the automatic player can perform any complicated passage.

The solenoid-operated flat actuators FLAT1 give rise to the rotation of the associated swingable arms 43 without any physical contact between the flat coils 44 and the yokes 42 and between the arms 43 and the yokes 42. The arms 42 and flat coils 44 are less worn out. Thus, the player's fingers 20K are durable.

The solenoid-operated flat actuators FLAT1 occupy the space under the reeds 48*a*. In other words, the solenoid-operated flat actuators FLAT1 are overlapped with the comb-like reed array 48K. This results in the compact musical instrument.

The automatic player can perform various passages without changing the hardware. The user needs to load a piece of music data into the memory 13. Thus, the automatic player can answer all the user's requests in so far as the user prepares the pieces of music data.

The solenoid-operated flat actuators FLAT1 are desirable for the comb-like reed array 48K, because the manufacturer can arrange them at small pitches. Even though the reeds 48*a* are extremely narrow, the solenoid-operated flat actuators FLAT1 are provided in the proximity of the tips of the reeds 48*a*.

The rotary picks 46 are desirable for the simple structure of the automatic player, because the claws 46*a* not only receive the force from the blades 45 but also pluck the reeds 48*a*.

Another attractive point of the rotary picks 46 is smoothly to change itself between the plucking position and the shunt position. This results in that the reeds 48*a* generate clear tones. When the rotary pick 46 is rotated over the predetermined angle, the rotary pick 46 plucks the reed 48*a* with one of the claws 48*a*, and stops at the angular position in which the reed 48*a* freely vibrate between the claws 46*a*. The rotary pick 46 is required for the rotation over the predetermined angle. The claws 46*a* do not interfere with the vibrating reed 48*a*, because the claws 46*a* are spaced wide enough to permit the reed 48*a* to vibrate in the gap therebetween.

The solenoid-operated flat actuators FLAT1 are disposed at any space, because the rotary picks 46 pluck the associated reeds 48*a*. The combination between the rotary picks 46 and the solenoid-operated flat actuators FLAT1 enhances the design flexibility.

The flat coils 44 may be alternated with the yokes 42. In this instance, the permanent magnet plates 41 are attached to the swingable arms 43. A large magnet may create a strong magnetic field for all the flat coils 44.

Modifications

Figure 35B:
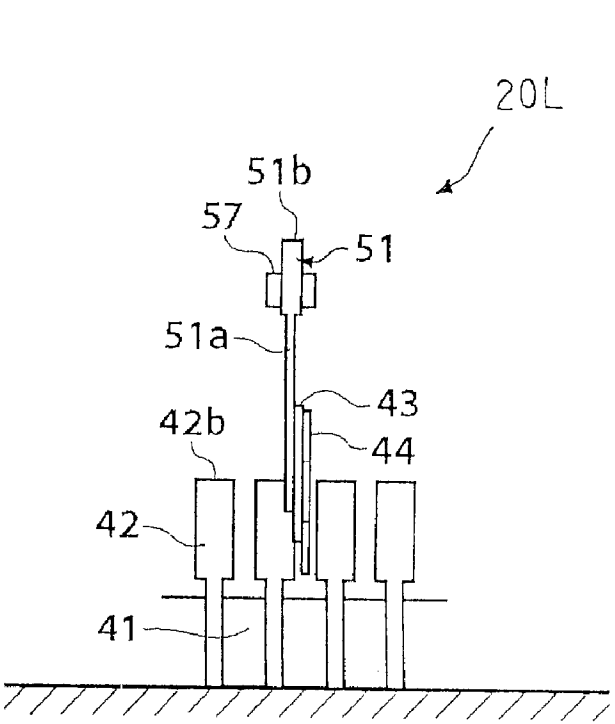
FIG. 35B is a rear view showing the player's finger.
Figure 35A:
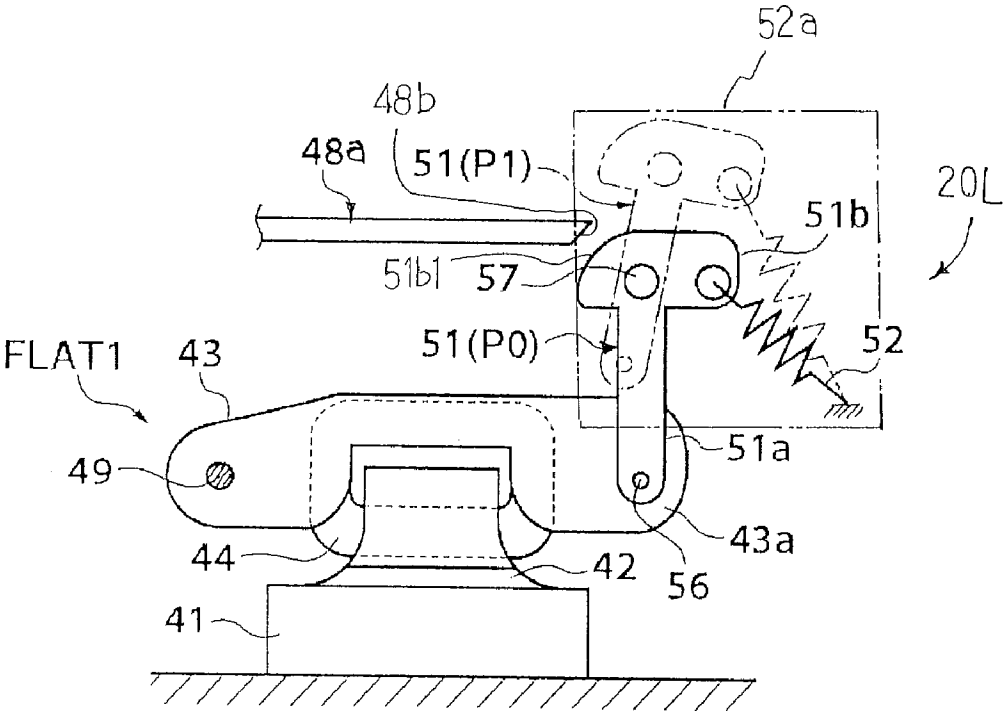
FIG. 35A is a side view showing another player's finger incorporated in a musical instrument according to the present invention.

FIGS. 35A and 35B show a modification of the player's finger. The player's finger 20L. The player's fingers 20L are similar to the player's fingers 20F so that the component parts of the player's finger 20L are labeled with the component parts of the player's finger 20F without detailed description.

The guide block 52*a* and pin 57 keep the trajectory of the pusher 51 stable so that the pusher 51 does not interfere with the vibrating reed 48*a*. The player's finger 20F has the advantages by virtue of the solenoid-operated flat actuators FLAT1.

Figure 36:
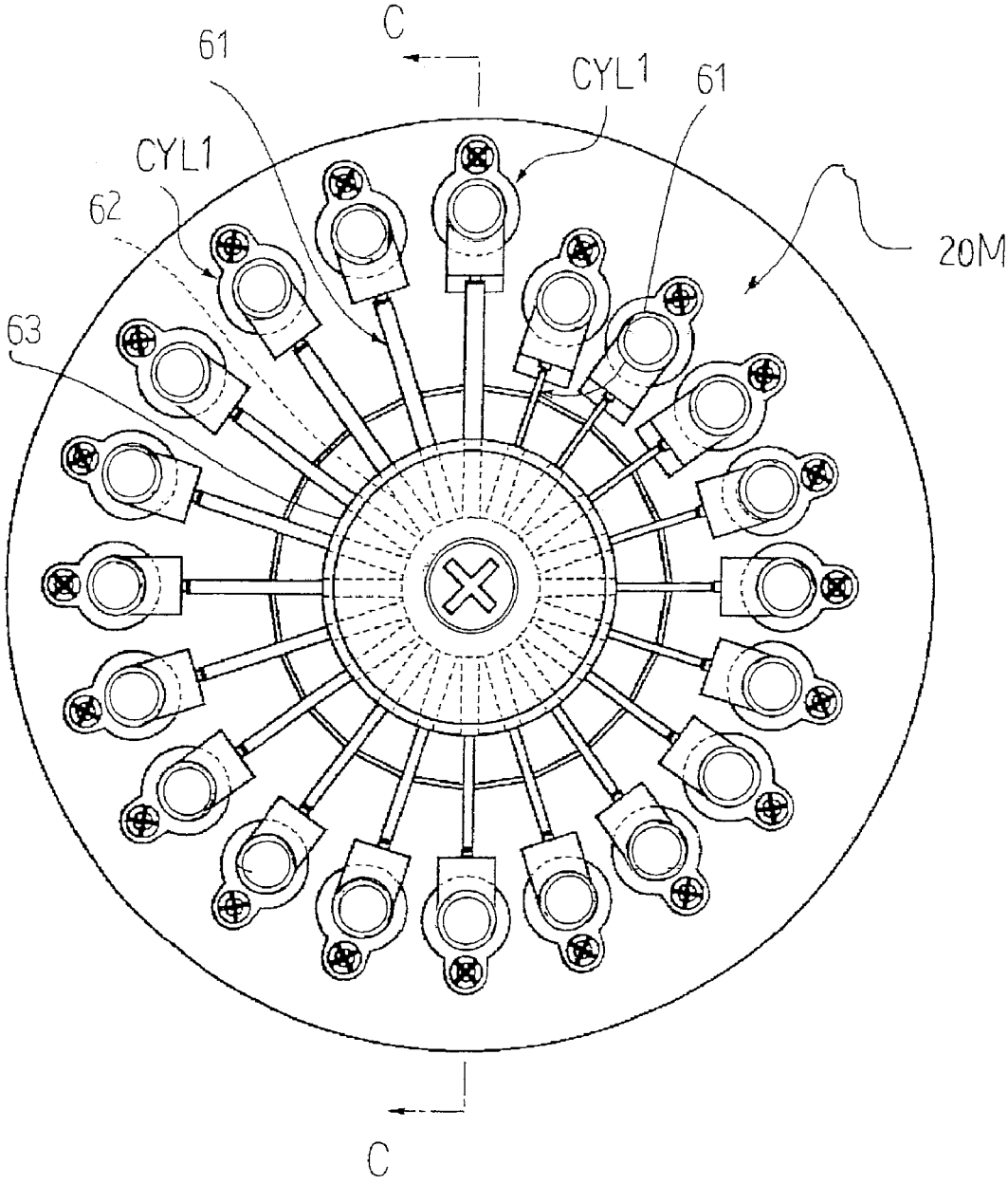
FIG. 36 is a plane view showing the layout of reeds and player's fingers incorporated in another musical instrument according to the present invention.
Figure 37C:
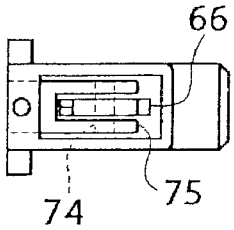
FIG. 37C is a view a rotary pick and a brake unit viewed in a direction indicated by F1 in FIG. 37B, FIGS. 38A to 38H are schematic views illustrating a plucking motion of the rotary pick.
Figure 37B:
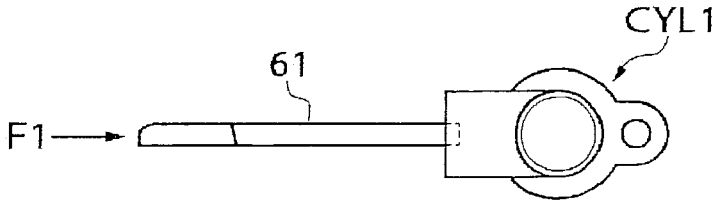
FIG. 37B is a plane view showing a standard solenoid-operated actuator.
Figure 37A:
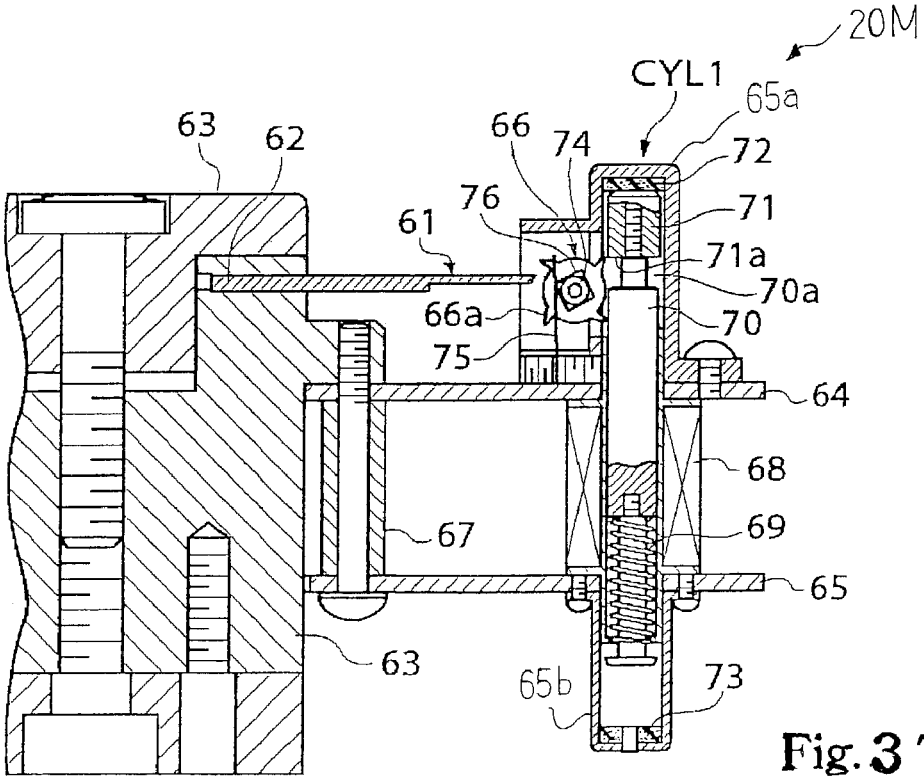
FIG. 37A is a cross sectional view taken along line C—C of FIG. 36 and showing the structure of the musical instrument.

FIGS. 36, 37A and 37B show a modification of the musical instrument. The musical instrument is broken down into a tone generator and an automatic player. The tone generator is implemented by a daisy reed wheel, and automatic player includes a controller and player's fingers 20M. The daisy reed wheel, controller and player's fingers 20M are similar to those of the musical instrument shown in FIGS. 21, 22A and 22B. For this reason, the component parts are labeled with references designating corresponding parts of the musical instrument shown in those figures.

Figures 38A, 38B, 38C, 38D:
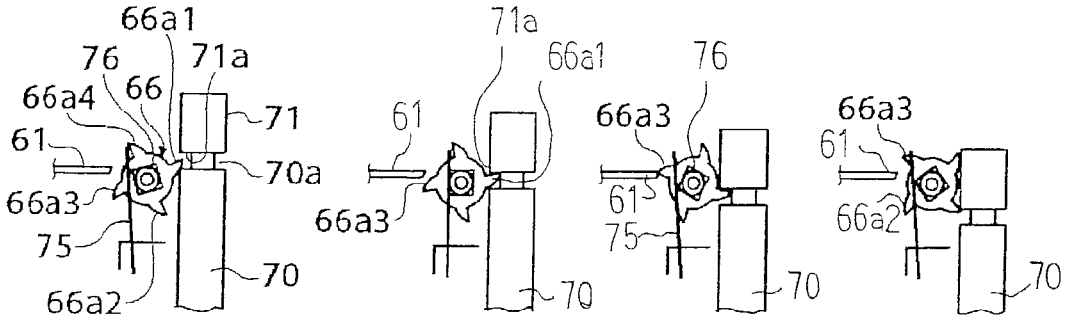

The player's finger 20M plucks the associated reed 61 as shown in FIGS. 38A to 38H. FIG. 38A shows the plunger 71 at the upper dead point, and the claw 66*a*1 is resting in the ring space 70*a*. The controller is assumed to energize the coil 68. The plunger 70 starts the downward motion against the elastic force of the spring 69. The inner portion 71*a* is brought into contact with the claw 66*a*1 as shown in FIG. 38B. However, the claw 66*a*3 is still spaced from the tip of the reed 61.

The plunger 70 is further moved downwardly, and gives rise to the rotation of the rotary pick 66 in the clockwise direction. The cam plates 76 are rotated against the elastic force of cum springs 75 exerted on the corners, and the claw 66*a*3 plucks the reed 61 as shown in FIG. 38C. The reed 61 vibrates, and generates a tone. The plunger 70 is further moved downwardly, and the rotary pick 66 is rotated in the clockwise direction. However, the next claw 66*a*2 has not reached the vibrating reed 61, and the rotary pick 66 does not interfere with the vibrating reed 61 as shown in FIG. 38D. When the plunger 70 reaches the lower dead point, the next claw 66*a*2 is still spaced from the vibrating reed 61.

The magnetic field is removed from the solenoid-operated cylindrical actuator CYL1, and the plunger spring 69 urges the plunger 70 in the upward direction. Although the head block 71 pushes the claw 66*a*4, the cam springs 75 and cam plates 76 do not permit the rotary pick 76 to be rotated in the counter clockwise direction, because the braking force is larger than the friction between the head block 71 and the claw 66*a*4 (see FIG. 38E).

Figures 38E, 38F, 38G, 38H:
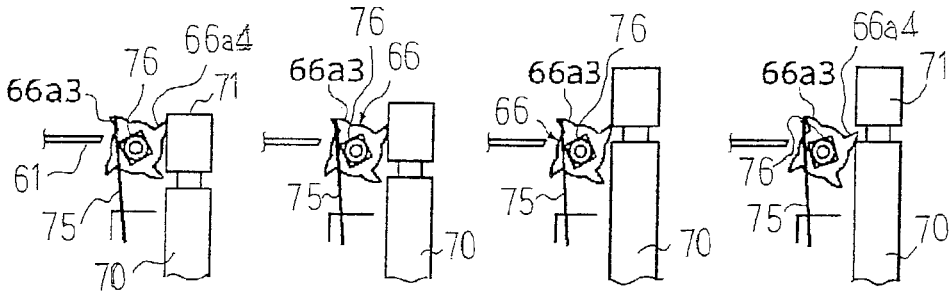
Figure 39:
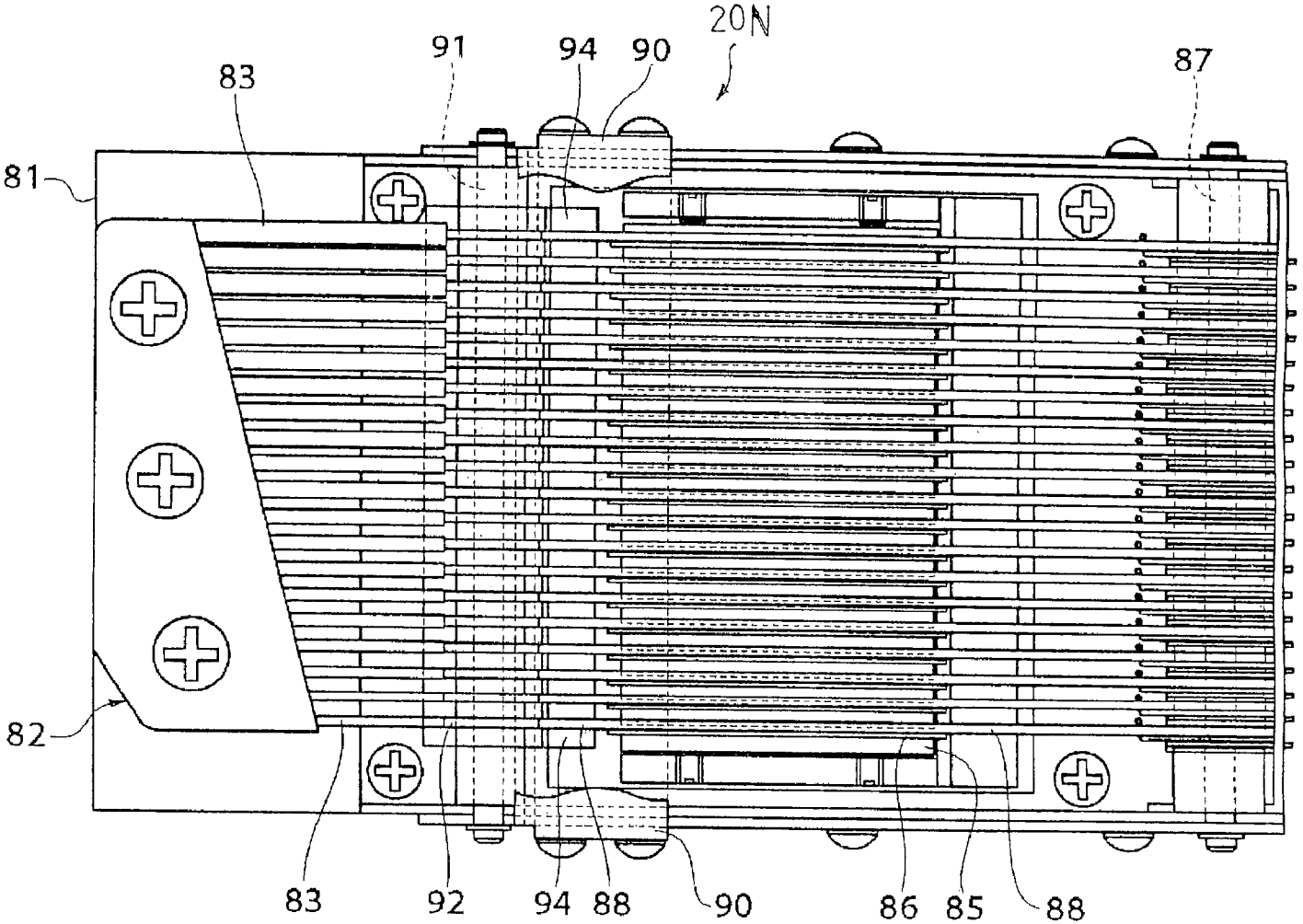
FIG. 39 is a plane view showing the layout of another musical instrument according to the present invention.

FIGS. 38F and 38G illustrate the plunger 70 on way to the upper dead point. However, the cam plates 76 and cam springs 75 prevent the rotary pick 66 from the rotation in the counter clockwise direction. When the plunger 70 reaches the upper dead point, the head block 71 is spaced from the claw 66*a*4, which is to be pushed during the next downward motion of the plunger 70, and the cam springs 75 slightly rotate the rotary pick 66 in the clockwise direction. As a result, the next claw 66*a*4 slides into the ring space as shown in FIG. 38H.

The automatic players 20M have the advantages by virtue of the rotary picks 66. Moreover, the player's fingers 20M pluck the associated reeds 61 surer than the player's fingers 20K, because the head blocks 71 faithfully reciprocate the given trajectories. The brake unit 75/76 not only prevents the rotary pick 66 from the reverse rotation but also keep the claws 66*a* at the same position in the ring space 70*a* after the spring 69 spaces the head block 71 from the claws 66*a*. The magnetic force exerted on the plunger 70 is constant, and the head block 71 exerts the constant force on the claw 66*a*. This results in the clear tones at constant loudness.

FIGS. 39, 40A, 40B and 40C show another musical instrument according to the present invention. The musical instrument largely comprises a tone generator and an automatic player. The tone generator is implemented by a comb-like reed array, and the automatic player includes a controller and player's fingers 20N. The comb-like reed array, controller and player's fingers are similar to those of the musical instrument shown in FIGS. 24, 25A, 25B and 25C. For this reason, the component parts are labeled with same references designating corresponding parts shown in those figures without detailed description.

Figure 40A:
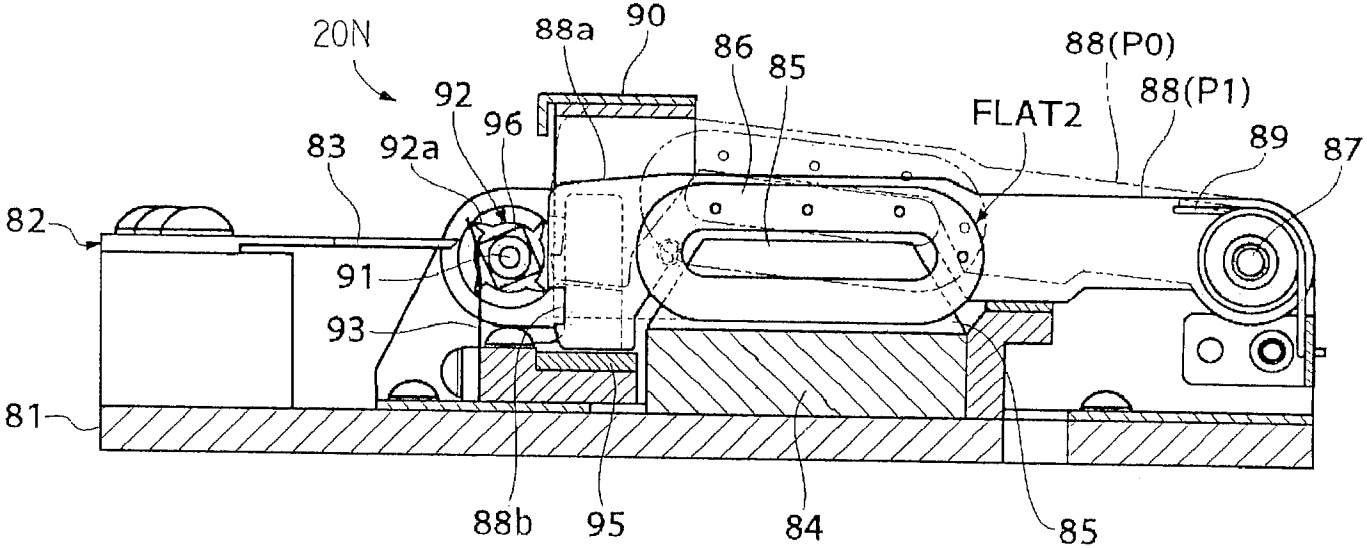
FIG. 40A is a cross sectional view showing the structure of the musical instrument.
Figure 40C:
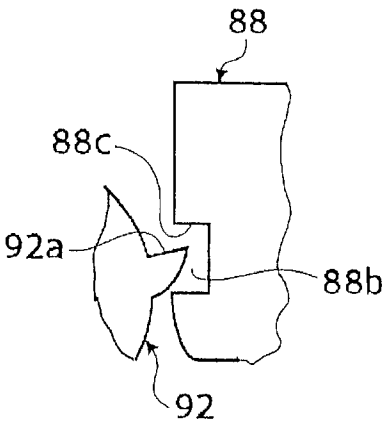
FIG. 40C is a schematic side view showing the swingable arm and an associated rotary pick.
Figure 40B:
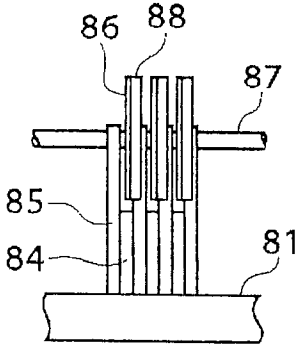
FIG. 40B is a front view showing swingable arms and solenoid-operated flat actuators.

Assuming now that the controller energizes the flat coil 86 shown in FIG. 40A, the magnetic force is exerted on the flat coil 86 and, accordingly, the swingable arm 88 so as to give rise to the rotation of the swingable arm 88 about the shaft 87 in the counter clockwise direction against the elastic force of the arm spring 89. The swingable arm 88 starts the rotation at the rest position 88(P0), and is moved on the trajectory toward the lower stopper 95.

The edge 88*c* is brought into contact with the claw 92*a*, and gives rise to the rotation of the rotary pick 92 in the clockwise direction against the elastic force of the cam springs 93. Subsequently, the claw 92*a*, which is at the opposite position 180 degrees spaced from the claw 92*a* pressed by the edge 88*c*, is brought into contact with the associated reed 83, and plucks it. The reed 83 vibrates, and generates the tone. When the swingable arm 88 reaches the lower stopper 95, the reed 83 is vibrating in the space between the claw 92*a* and the next claw 92*a* so that the rotary pick 92 does not interfere with the vibrating reed 83.

When the magnetic force is removed from the flat coil 86, the arm spring 89 rotates the swingable arm 88 in the clockwise direction. Although the friction between the claw 92*a* and the swingable arm 88 urges the rotary pick 92 in the counter clockwise direction, the brake unit 93/96 does not permit the rotary pick 92 from the reverse rotation. The swingable arm 88 reaches the upper stopper 90, and the cam springs 93 urge the rotary pick 92 in the clockwise direction so that the next claw 92*a* enters the notch 88*b*.

The musical instrument achieves the advantages by virtue of the solenoid-operated flat actuators FLAT2, rotary picks 92 and brake units 93/96. Moreover, the upper stopper 90 and lower stopper 95 exactly define the upper dead point and lower dead point for the swingable arms 88. The motion of the swingable arms 88 is constant so that a constant force is exerted on the reeds 83.

Figure 41A:
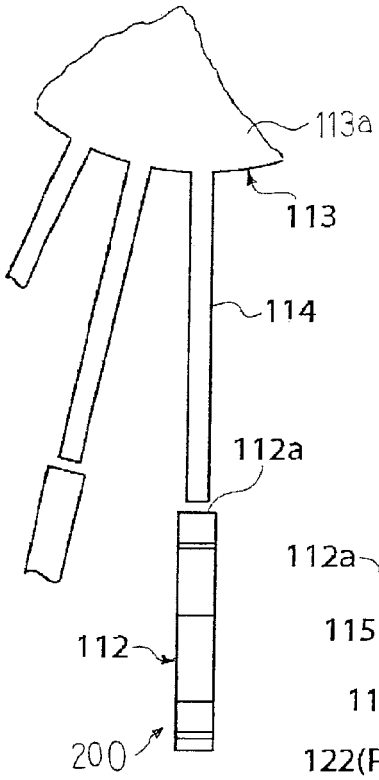
FIG. 41A is a plane view showing a musical instrument according to the present invention.
Figure 41B:
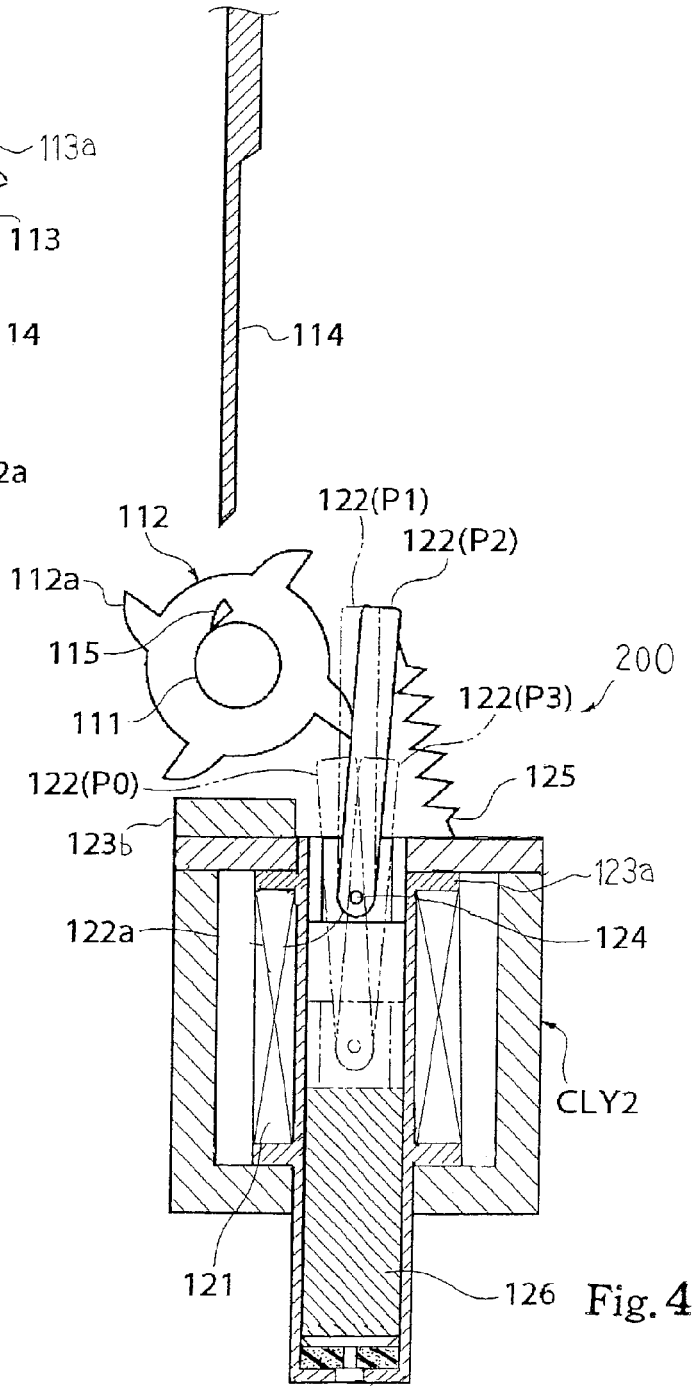
FIG. 41B is a cross sectional view showing the structure of player's fingers incorporated in the musical instrument according to the present invention.

FIGS. 41A and 41B show another player's finger 20O incorporated in a musical instrument according to the present invention. The player's finger 20O is similar in structure to the player's finger 20I so that the component parts are labeled with same references designating corresponding parts of the player's finger 20I without detailed description.

In the musical instrument, plural player's fingers 20O are disposed in the proximity of the tips of reeds 114, which radially project from a hub 113*a*. The reeds 114 and hub 113*a* form in combination a daisy reed wheel 113.

The controller is assumed to energize the solenoid-operated actuator CLY2, current flows through the coil 121, and magnetic field is created. The pusher 122 is inwardly inclined as indicated by 122(P0), and the plunger 126 starts to project upwardly. The pusher 122 is brought into contact with the claw 112*a*, and gives rise to rotation of the rotary pick 112 in the counter clockwise direction. Another claw 112*a* warps the reed 114, and escape from the reed 144. Then, the reed 114 vibrates, and generates the tone. The ratchet 115 stops the rotary pick 112. When the elastic force exceeds the magnetic force, the pusher 122 escapes from the claw 112*a*.

When the pusher 122 reaches the upper dead point 122(P1), the controller removes the magnetic field from the solenoid-operated actuator CLY2 so that any magnetic force is not exerted on the pusher 122. The spring 125 outwardly inclines the pusher 122 as indicated by 122(P2), and the plunger 126 is retracted into the bobbin 123*a*. When the plunger 126 reaches the lower dead point, the pusher 122 returns to the rest position 122(P3). Thus, the pusher 122 returns to the rest position without any interference with the claw 112*a*.

The player's fingers 20O achieve all the advantages by virtue of the rotary pick 112, solenoid-operated actuator CLY2 and the daisy reed wheel 113. The player's fingers 20I shown in FIG. 41B do not set any limit to the positions to be occupied. Other player's fingers may be provided over the rotary picks 112.

Figure 42B:
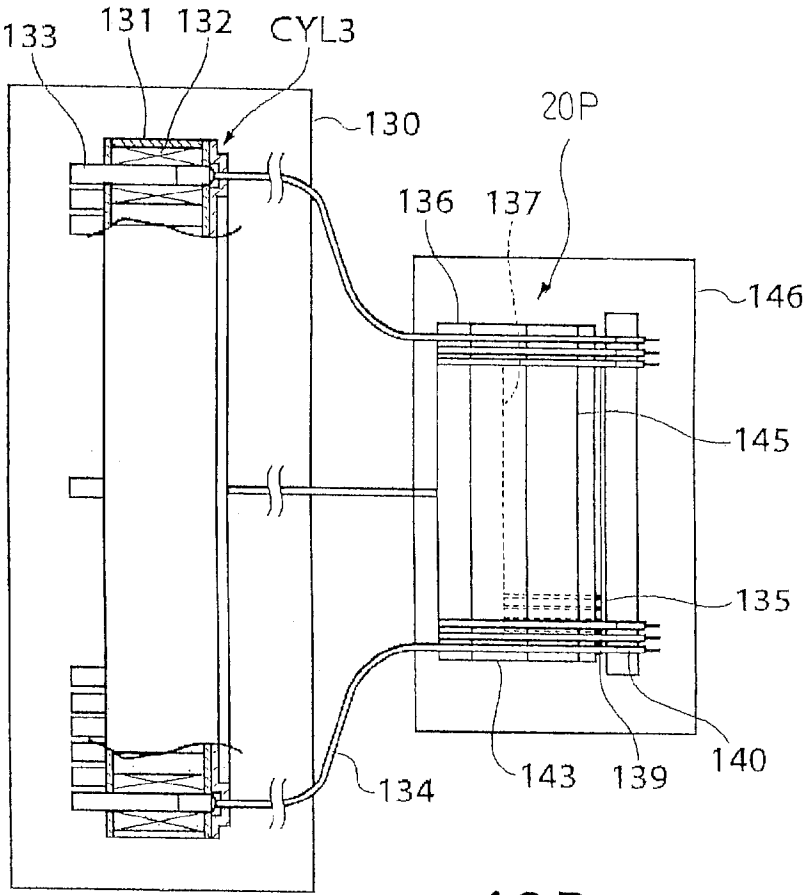
FIG. 42B is a plane view showing the layout of the musical instrument according to the present invention.
Figure 42A:
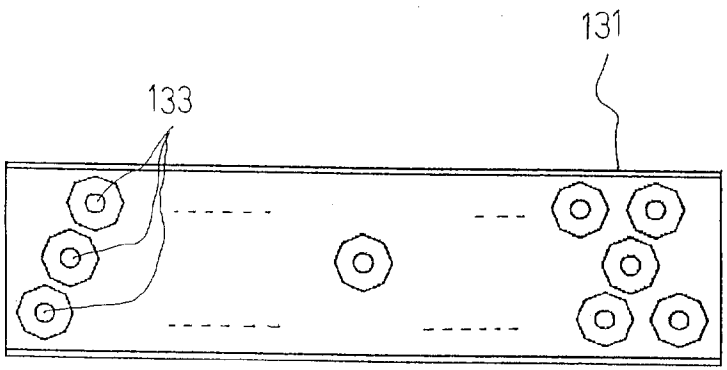
FIG. 42A is a rear view showing the structure of another musical instrument on the left side.
Figure 43:
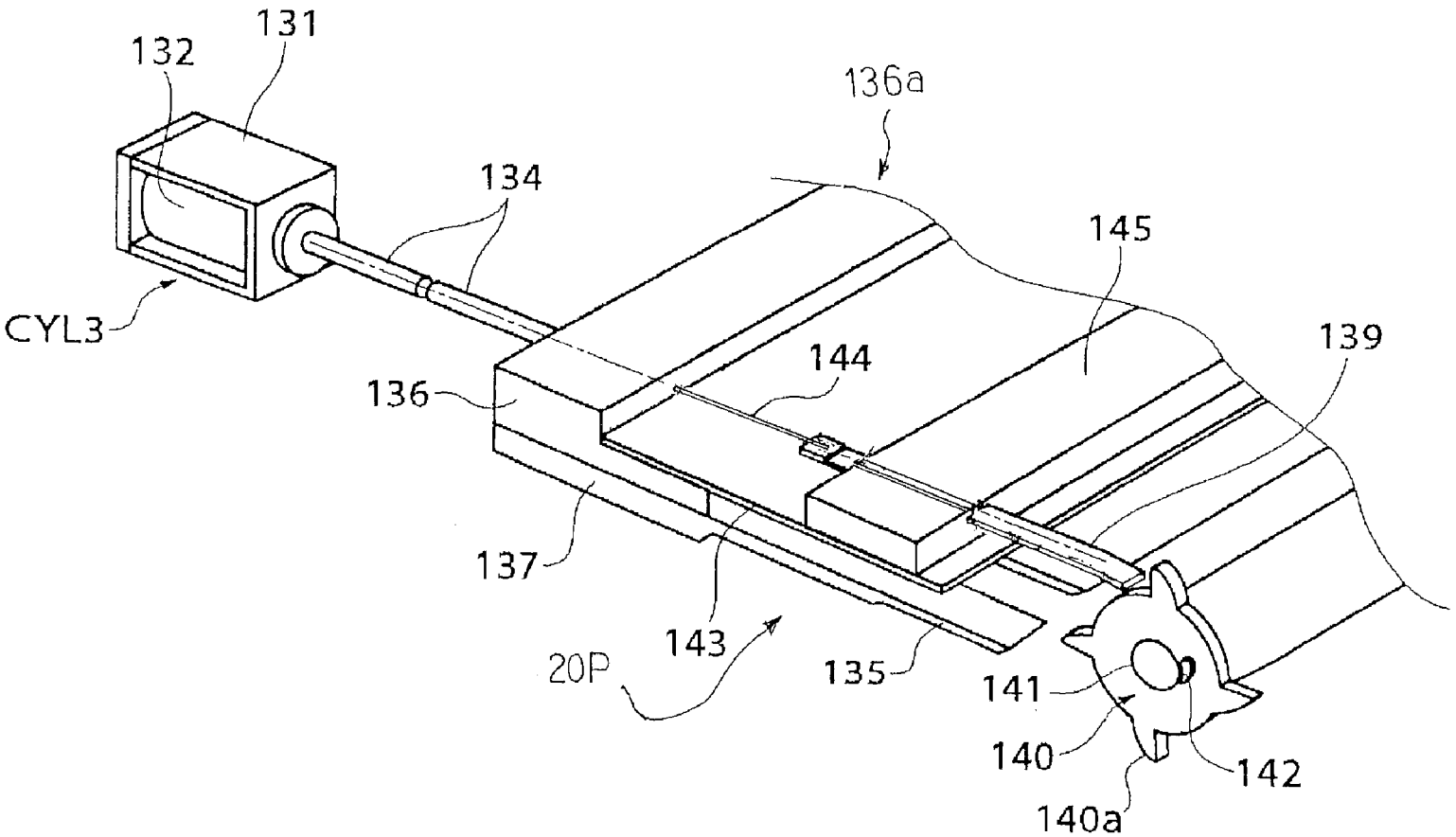
FIG. 43 is a perspective view showing a player's finger incorporated in the musical instrument.

FIGS. 42A, 42B and 43 show another musical instrument according to the present invention. The musical instrument largely comprises a tone generator and an automatic player. The tone generator is implemented by a comb-like array of reeds 137, and the automatic player includes a controller and player's fingers 20P. The comb-like array 137, controller and player's fingers 20P are similar to the comb-like array 137, controller and player's fingers 20J shown in FIGS. 27A, 27B and 28 so that component parts are labeled with same references designating corresponding parts shown in those figures without detailed description.

Figure 44A:
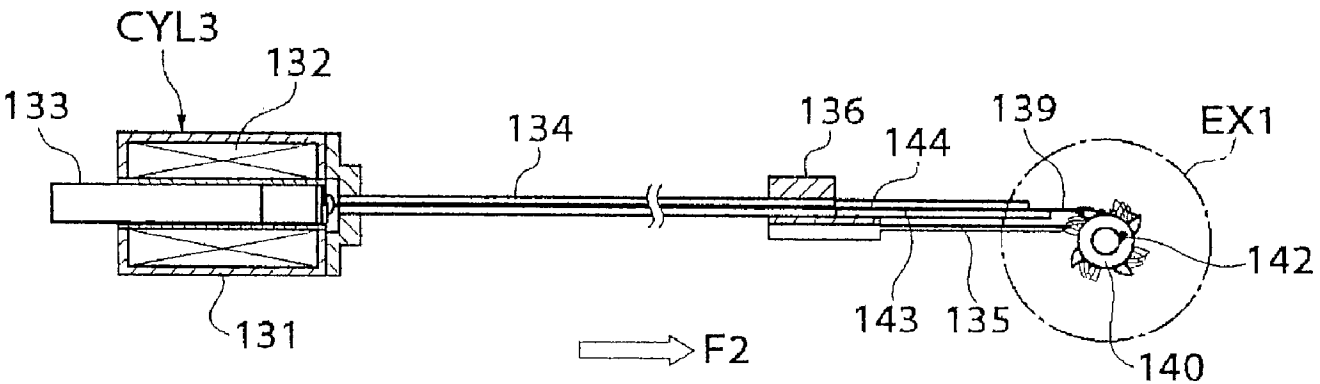
FIG. 44A is a side view showing the player's finger.
Figure 44B:
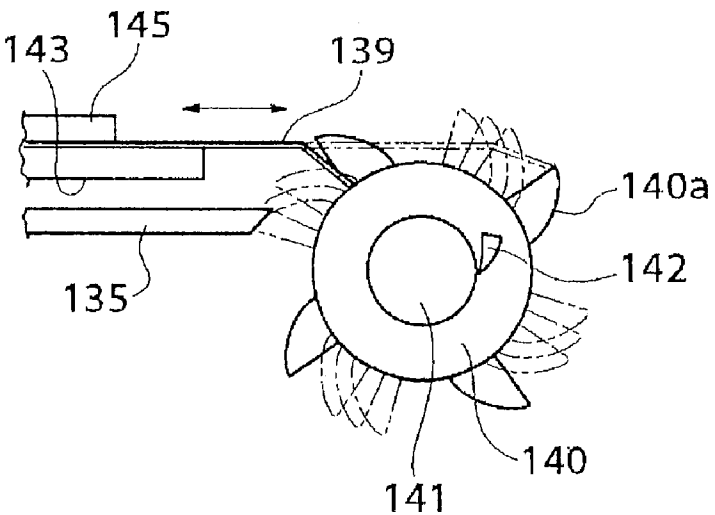
FIG. 44B is a side view showing the parts encircled in EX1 of FIG. 44A, FIGS. 45A and 45B are side views showing a modification of the player's finger shown in FIG. 43.

Assuming now that the controller energizes the solenoid-operated actuator shown in FIG. 43A, the current flows through the coil 132, and creates magnetic field. Then, the plunger 133 frontward projects from the yoke 131, and the force F2 is transmitted from the plunger 133 through the flexible wire 144 to the pusher 139. The pusher 139 frontward projects from the guide block 145, and is brought into contact with one of the claws 140*a*. Although the tip of the pusher 139 is deformed (see FIG. 44B), the force F2 gives rise to the rotation of the rotary pick 140 over 90 degrees. While the rotary pick 140 is rotating, another claw 140*a* plucks the reed 135 so that the reed 135 vibrates for generating a tone. The claw 140*a*, which has plucked the reed 135, reaches the position occupied by the claw 140*a* previously pushed by the pusher 139.

When the controller removes the magnetic field, a return spring (not shown) moves the plunger 133 backwardly, and the plunger 133 is retracted into the yoke 131. The plunger 133 pulls the flexible wire 144 and the pusher 139. The pusher 139 slides on the claw 140*a* backwardly. However, the ratchet 142 does not permit the rotary pick 140 to rotate in the counter clockwise direction. The tip of the pusher 139 is warped, and returns to the rest position.

The musical instrument achieves the advantages by virtue of the rotary wheel 140 and rotary pick 140. Moreover, the solenoid-operated actuators CYL3 are connected to the pushers 139 by means of the flexible wires 144 so that the manufacturer can locate the base plates 130 and 146 at the optimum positions. Thus, the flexible wires 144 enhance the design flexibility.

The yoke 131 may be separated into yokes, which are incorporated in the solenoid-operated actuators CYL3, respectively. The yoke may be replaced with a pair of plates. In this instance, each of the coils 132 is sandwiched between the plates.

Figure 45A:
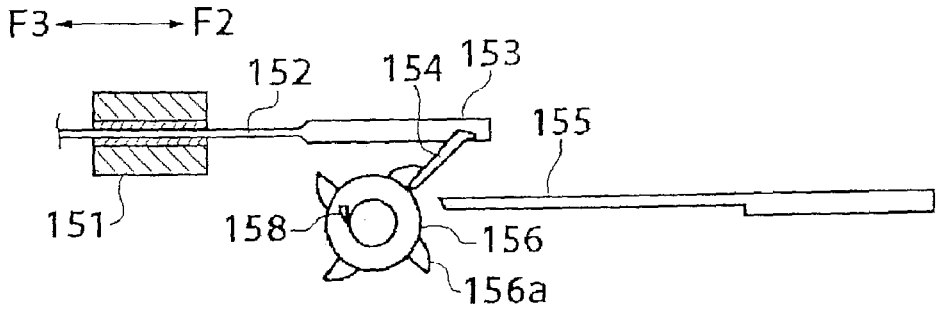
FIG. 45C is a side view showing another modification of the player's finger.
Figure 45B:
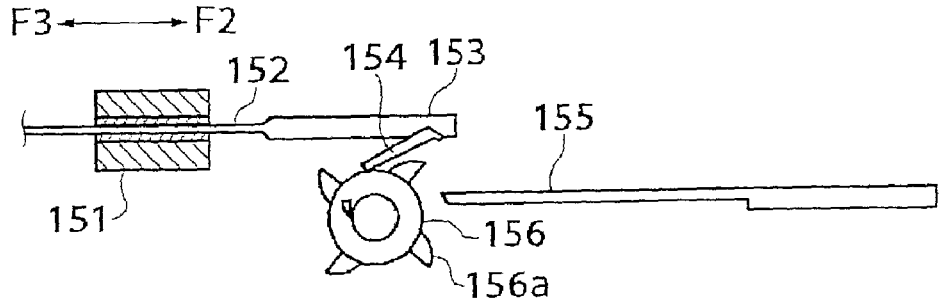
Figure 45C:
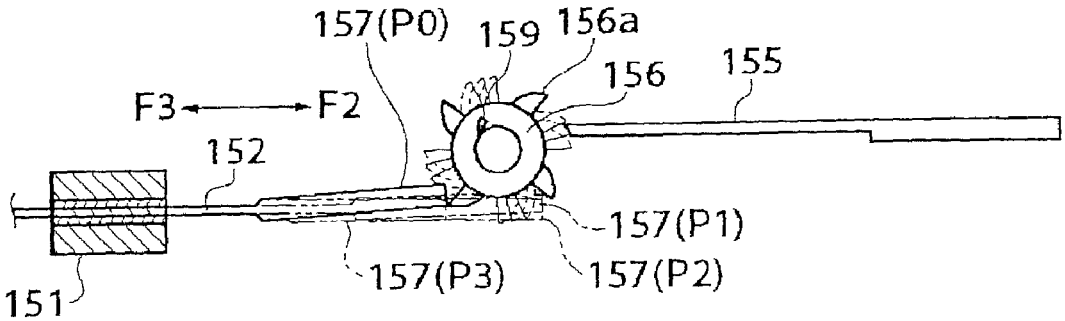
Figure 46:
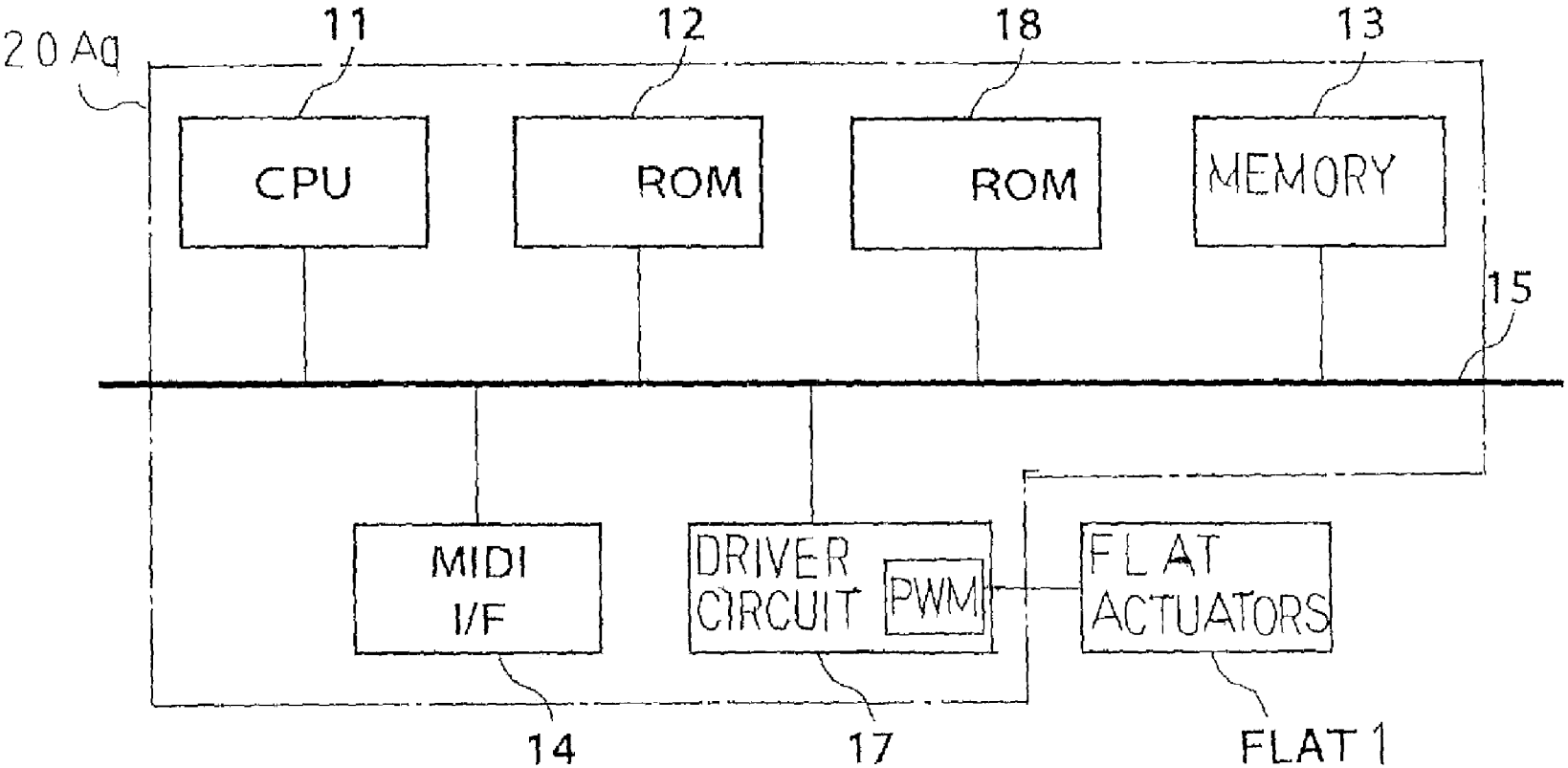
FIG. 46 is a block diagram showing the system configuration of a controller incorporated in another musical instrument according to the present invention.
Figure 47:
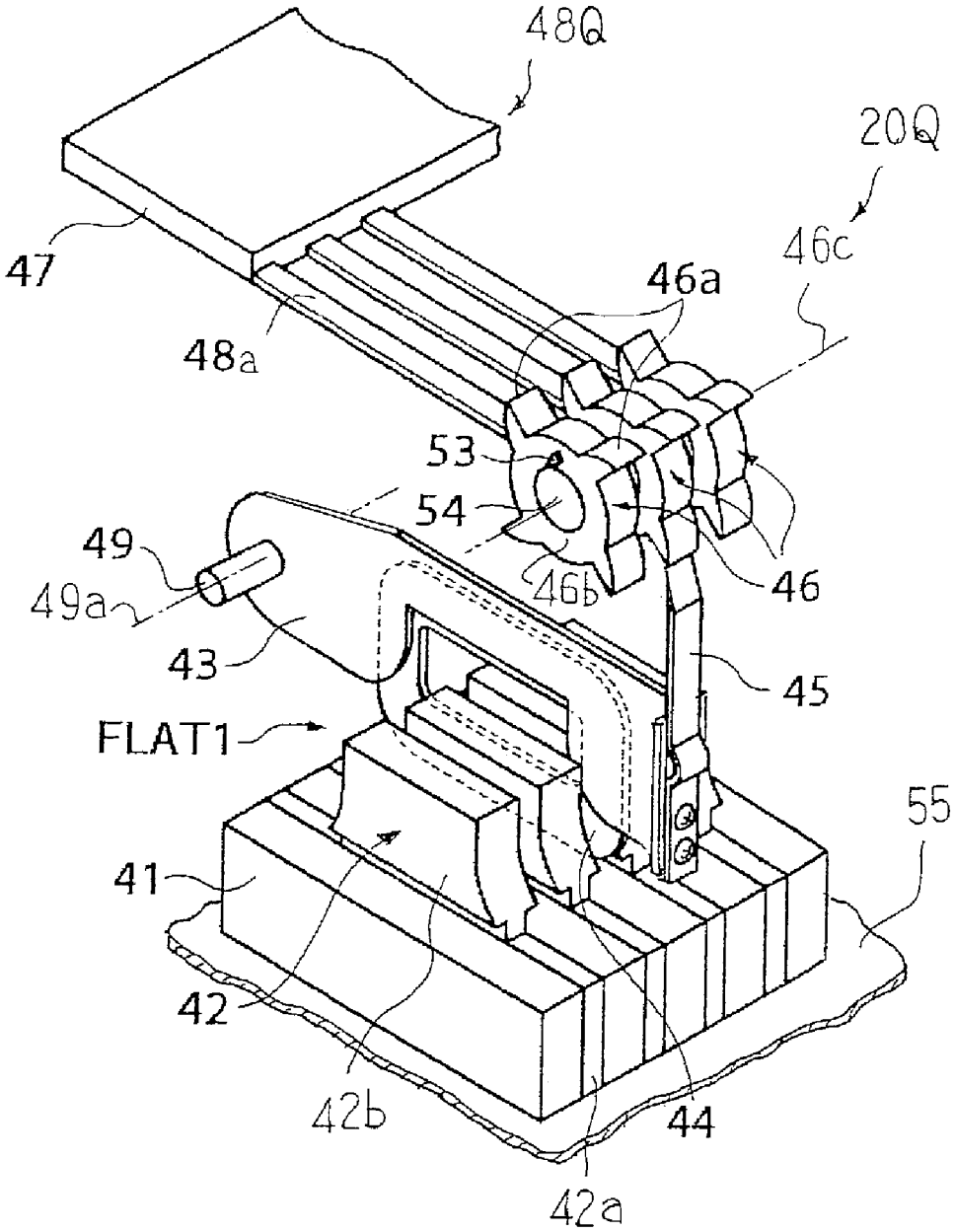
FIG. 47 is a perspective view showing the structure of a player's finger incorporated in the musical instrument.
Figure 48B:
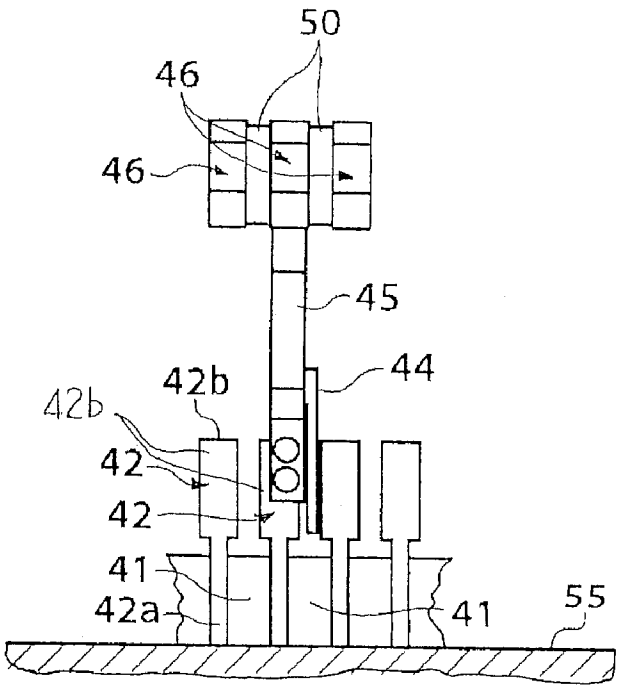
FIG. 48B is a rear view showing the player's finger.
Figure 48A:
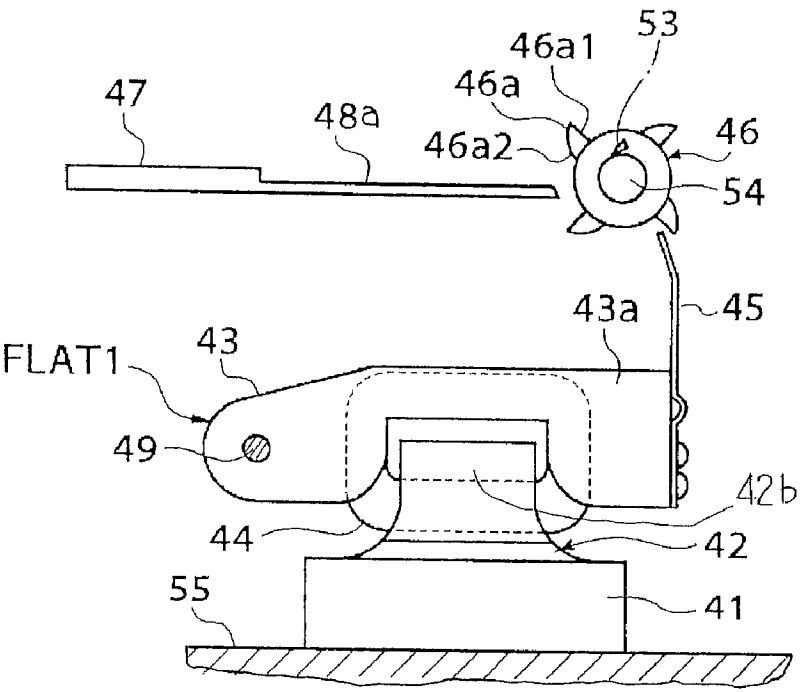
FIG. 48A is a side view showing the player's finger before plucking.

The pusher 139 may be replaced with a reciprocating rod 153 and a foldable arm 154 as shown in FIGS. 45A and 45B. The reciprocating rod 153 and foldable arm 154 are similar to those shown in FIGS. 30A and 30B. Otherwise, a foldable rod 157 may be employed in the player's finger 20P. The foldable rod 157 is similar to that shown in FIG. 30C.

As will be understood from the foregoing description, the musical instruments implementing the third embodiment generate the clear tones through the natural vibrations of the reeds. The controllers make the player's fingers pluck the reeds on the basis of the music data so that the automatic players can answer any user's requests. The structures of the musical instruments enhance the design flexibility The reeds are replaceable with another sort of vibrating members such as, for example, strings or tone bars. Although the strings are plucked, the tone bars are beaten with mallets. In this instance, the player's fingers selective beat the tone bars.

Fourth Embodiment

Prototype

FIGS. 46, 47, 48A and 48B show another musical instrument embodying the present invention. The musical instrument is categorized in the music box. The musical instrument largely comprises a tone generator and an automatic player as similar to the first, second and third embodiments. The tone generator is implemented by a comb-like array 48Q of reeds 48*a*, and the automatic player comprises a controller 20Aq and player's fingers 20Q. The comb-like array 48Q of reeds 48*a*, controller 20Aq and player's fingers 20Q are similar in structure to the array 48 of reeds 48*a*, controller 20Ab and player's fingers 20E shown in FIGS. 16 and 17. For this reason, component circuits of the controller 20Aq and component parts of the comb-like array 48Q and player's fingers 20Q are labeled with references designating corresponding circuits of the controller 20Ab and corresponding parts of the array 48 and player's finger 20E without detailed description.

Assuming now that a user requests the automatic player to perform a piece of music, the central processing unit 11 sequentially accesses music data codes stored in the memory 13, and instructs the driver circuit 17 to selectively energize the solenoid-operated flat actuators FLAT1. While the central processing unit 11 is sequentially processing the music data, the central processing unit 11 is assumed to instruct the driver circuit 17 to pluck the reed 48*a* shown in FIG. 48A. The flat coil 44 has not been energized so as to keep the swingable arm 43 horizontal. The tip of the blade 45 stands upright, and is spaced from the rotary pick 46.

Figure 49:
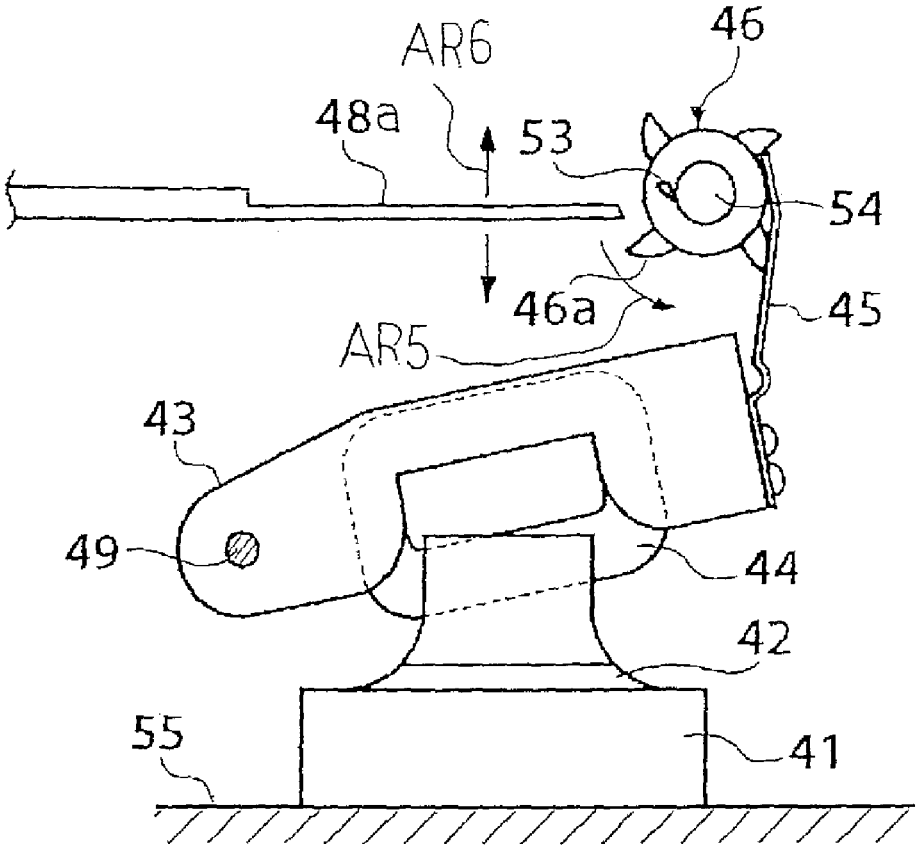
FIG. 49 is a side view showing the player's finger after the plucking.

The driver circuit 17 determines the pulse width to be required for the target loudness, and the pulse width modulator PWM supplies the driving signal with the pulse width to be required for the target loudness to the flat coil 44. When the current flows through the flat coil 44, the magnetic force is exerted on the flat coil 44, and gives rise to rotation of the swingable arm 43 in the counter clockwise direction. The blade 45 is brought into contact with the flat back surface 46*a*1 of the rotary pick 46, and pushes it. The rotary pick 46 is driven for rotation over 90 degrees as indicated by arrow AR5 (see FIG. 49), and plucks the reed 48*a* with the claw 46 spaced 180 degrees from the claw 46 pushed by the blade 45. The reed 48*a* vibrates as indicated by arrow AR6, and generates the tone. The disk 46*b* is spaced from the vibrating reed 48*a*, and the claws 46*a* are out of the trajectory of the vibrating reed 48*a*. Thus, the rotary pick 46 does not interfere with the vibrating reed 48*a*.

The driver circuit 20Aq removes the driving signal from the flat coil 44. Then, the self weight causes the swingable arm 43, flat coil 44 and blade 45 to return to the rest position shown in FIG. 33A. The ratchet 53 prevents the rotary pick 46 from the reverse rotation.

In this instance, the controller 20Aq selectively energizes the flat coils FLAT1 for plucking the reeds 48*a* with the claws 46*a*. This means that the plural rotary picks 46 can concurrently pluck the reeds 48*a* for producing a chord. The rotary pick 46 is rotated over only the predetermined angle for plucking the reed 48*a*. The rotary pick 46 is responsive to quick repetition so that the automatic player can perform any complicated passage.

The solenoid-operated flat actuators FLAT1 give rise to the rotation of the associated swingable arms 43 without any physical contact between the flat coils 44 and the yokes 42 and between the arms 43 and the yokes 42. The arms 43 and flat coils 44 are less worn out. Thus, the player's fingers 20Q are durable.

The solenoid-operated flat actuators FLAT1 occupy the space under the reeds 48*a*. In other words, the solenoid-operated flat actuators FLAT1 are overlapped with the comb-like reed array 48K. This results in the compact musical instrument.

The automatic player can perform various passages without changing the hardware. The user needs to load a piece of music data into the memory 13. Thus, the automatic player can answer all the user's requests in so far as the user prepares the pieces of music data.

The solenoid-operated flat actuators FLAT1 are desirable for the comb-like reed array 48Q, because the manufacturer can arrange them at small pitches. Even though the reeds 48*a* are extremely narrow, the solenoid-operated flat actuators FLAT1 are provided in the proximity of the tips of the reeds 48*a*.

The flat coils 44 may be alternated with the yokes 42. In this instance, the permanent magnet plates 41 are attached to the swingable arms 43. A large magnet may create a strong magnetic field for all the flat coils 44.

Modifications

Figure 50B:
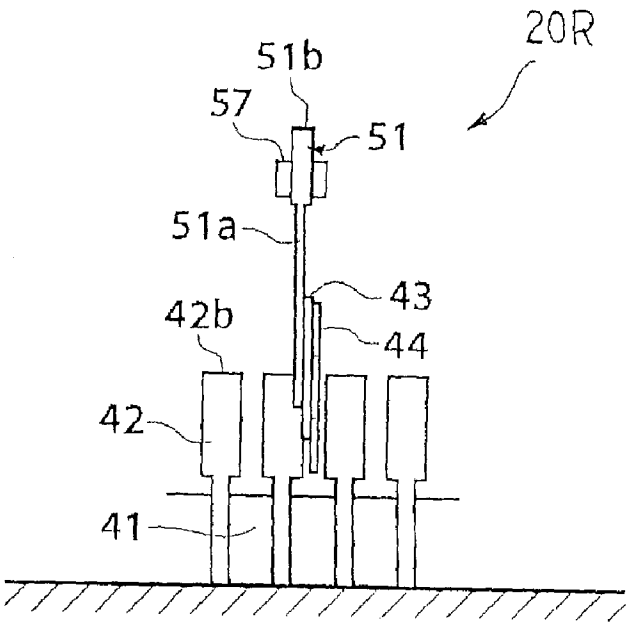
FIG. 50B is a rear view showing the player's finger.
Figure 50A:
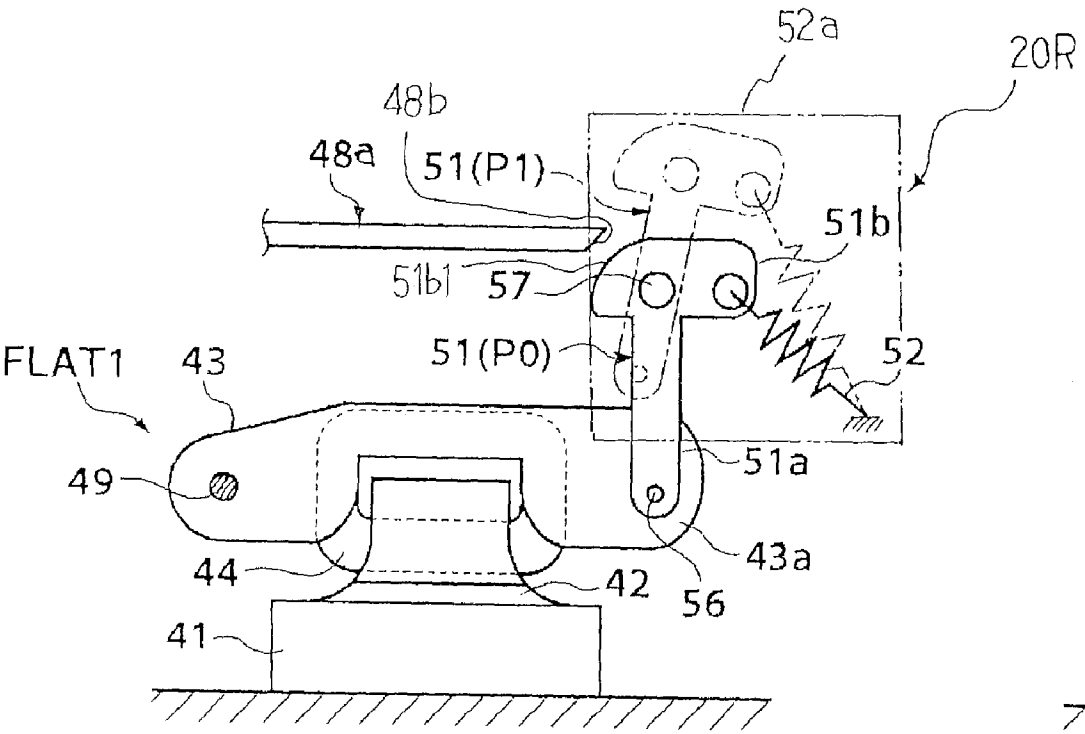
FIG. 50A is a side view showing another player's finger incorporated in a musical instrument according to the present invention.
Figure 51:
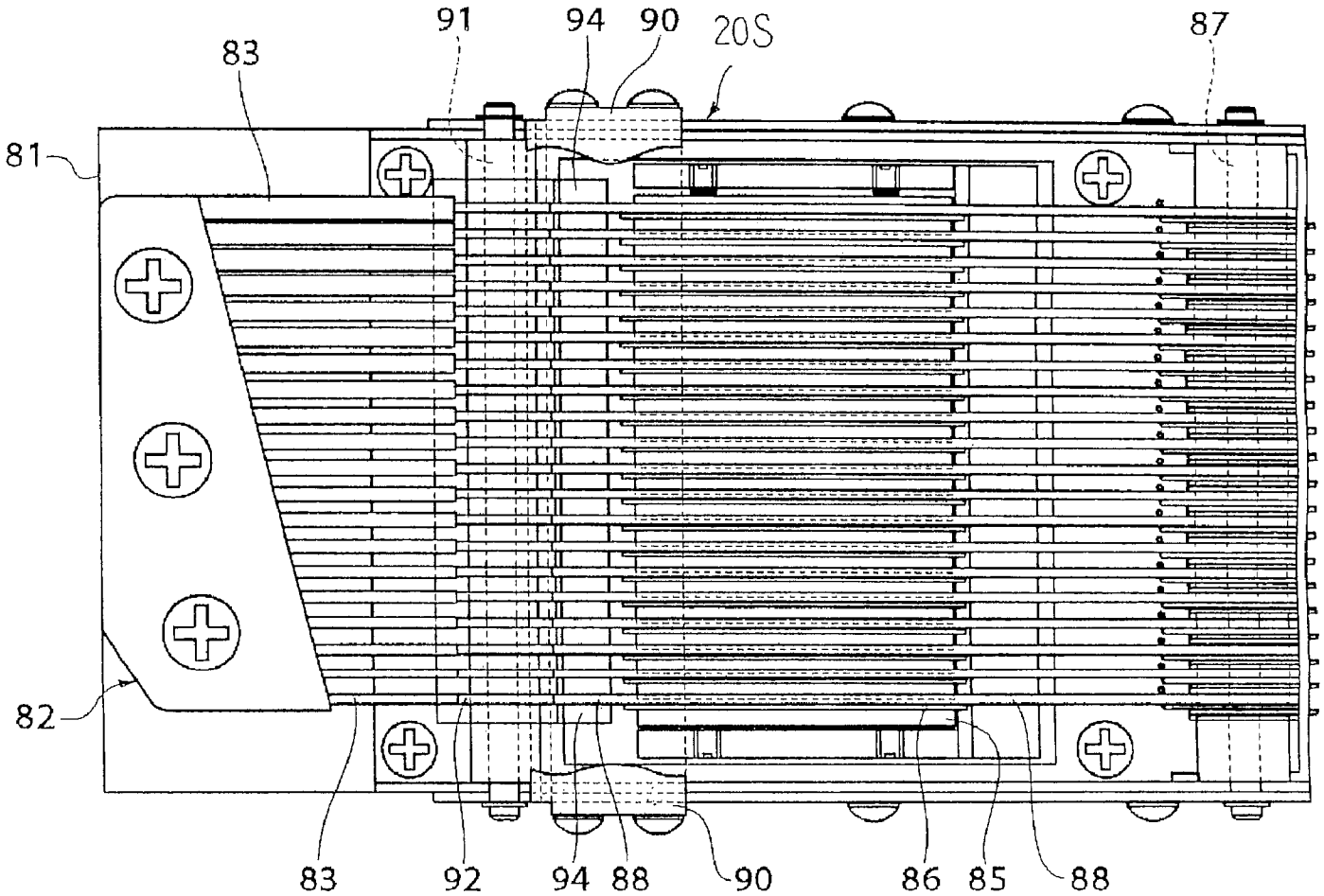
FIG. 51 is a plane view showing the layout of another musical instrument according to the present invention.

FIGS. 50A and 50B show a modification of the player's finger. The player's fingers 20R are similar to the player's fingers 20F so that the component parts of the player's finger 20R are labeled with the component parts of the player's finger 20F without detailed description.

The guide block 52*a* is formed with a pair of guide groves for upward motion and another pair of guide grooves for downward motion. While the solenoid-operated flat actuator FLAT1 gives rise to the rotation of the arm 43, the pin 57 is moved along the pair of guide grooves for the upward motion, and the head portion 51*b* plucks the reed 48*a* for vibrations.

When the pick 51 reaches the upper dead point, the driving signal is removed from the flat coil 44, and the arm 42 returns to the rest position. The spring 52 makes the pick 51 inclined as indicated by 51(P1). The pin 57 enters the pair of guide grooves for the downward motion, and the pin 57 and pair of guide grooves keep the pick 51 inclined. For this reason, the head 51*b* does not interfere with the vibrating reed 48*a*.

The guide block 52*a* and pin 57 keep the trajectory of the pusher 51 stable so that the pusher 51 does not interfere with the vibrating reed 48*a*. The player's finger 20F has the advantages by virtue of the solenoid-operated flat actuators FLAT1.

FIGS. 51, 52A, 52B and 52C show another musical instrument according to the present invention. The musical instrument largely comprises a tone generator and an automatic player. The tone generator is implemented by a comb-like reed array, and the automatic player includes a controller and player's fingers 20S. The comb-like reed array, controller and player's fingers 20S are similar to those of the musical instrument shown in FIGS. 24, 25A, 25B and 25C. For this reason, the component parts are labeled with same references designating corresponding parts shown in those figures without detailed description.

A pair of cams 96 are fixed to the side surfaces of each rotary pick 92, and the cam spring 93 is bifurcated so that twp spring leaves are pressed to the cams 96, respectively.

Figure 52A:
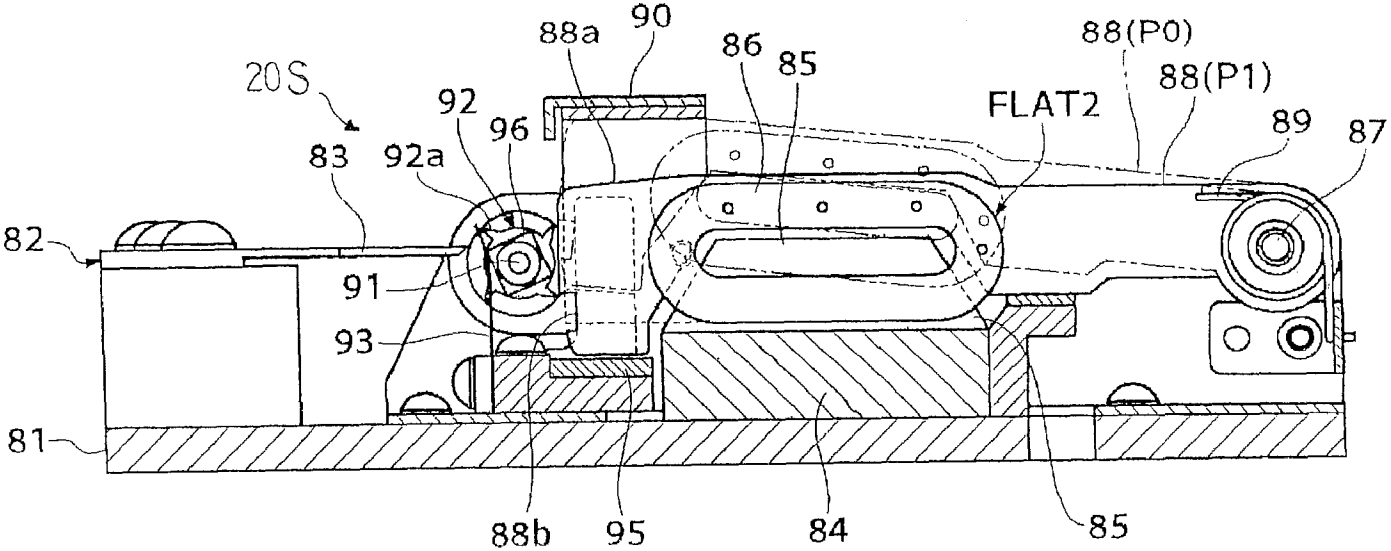
FIG. 52A is a cross sectional view showing the structure of the musical instrument.
Figure 52C:
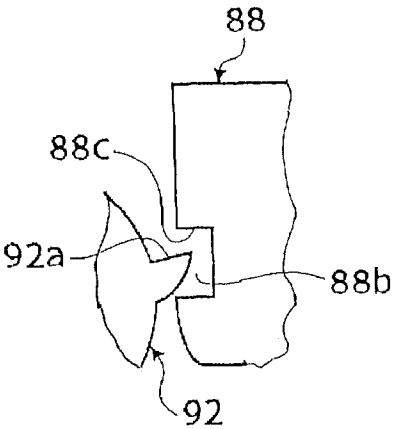
FIG. 52C is a view a rotary pick and a brake unit viewed in a direction indicated by F1 in FIG. 52B, FIGS. 53A to 53H are schematic views illustrating a plucking motion of the rotary pick.
Figure 52B:
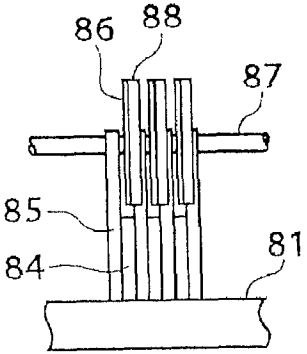
FIG. 52B is a front view showing swingable arms and solenoid-operated flat actuators.

Assuming now that the controller energizes the flat coil 86 shown in FIG. 52A, the magnetic force is exerted on the flat coil 86 and, accordingly, the swingable arm 88 so as to give rise to the rotation of the swingable arm 88 about the shaft 87 in the counter clockwise direction against the elastic force of the arm spring 89. The swingable arm 88 starts the rotation at the rest position 88(P0), and is moved on the trajectory toward the lower stopper 95.

The edge 88*c* is brought into contact with the claw 92*a*, and gives rise to the rotation of the rotary pick 92 in the clockwise direction against the elastic force of the cam springs 93. Subsequently, the claw 92*a*, which is at the opposite position 180 degrees spaced from the claw 92*a* pressed by the edge 88*c*, is brought into contact with the associated reed 83, and plucks it. The reed 83 vibrates, and generates the tone. When the swingable arm 88 reaches the lower stopper 95, the reed 83 is vibrating in the space between the claw 92*a* and the next claw 92*a* so that the rotary pick 92 does not interfere with the vibrating reed 83.

When the magnetic force is removed from the flat coil 86, the arm spring 89 rotates the swingable arm 88 in the clockwise direction. Although the friction between the claw 92*a* and the swingable arm 88 urges the rotary pick 92 in the counter clockwise direction, the brake unit 93/96 does not permit the rotary pick 92 from the reverse rotation. The swingable arm 88 reaches the upper stopper 90, and the cam springs 93 urge the rotary pick 92 in the clockwise direction so that the next claw 92*a* enters the notch 88*b*.

The player's finger 20M plucks the associated reed 61 as shown in FIGS. 38A to 38H. FIG. 38A shows the plunger 71 at the upper dead point, and the claw 66*a*1 is resting in the ring space 70*a*. The controller is assumed to energize the coil 68. The plunger 70 starts the downward motion against the elastic force of the spring 69. The inner portion 71*a* is brought into contact with the claw 66*a*1 as shown in FIG. 38B. However, the claw 66*a*3 is still spaced from the tip of the reed 61.

The plunger 70 is further moved downwardly, and gives rise to the rotation of the rotary pick 66 in the clockwise direction. The cam plates 76 are rotated against the elastic force of cum springs 75 exerted on the corners, and the claw 66*a*3 plucks the reed 61 as shown in FIG. 38C. The reed 61 vibrates, and generates a tone. The plunger 70 is further moved downwardly, and the rotary pick 66 is rotated in the clockwise direction. However, the next claw 66*a*2 has not reached the vibrating reed 61, and the rotary pick 66 does not interfere with the vibrating reed 61 as shown in FIG. 38D. When the plunger 70 reaches the lower dead point, the next claw 66*a*2 is still spaced from the vibrating reed 61.

The magnetic field is removed from the solenoid-operated cylindrical actuator CYL1, and the plunger spring 69 urges the plunger 70 in the upward direction. Although the head block 71 pushes the claw 66*a*4, the cam springs 75 and cam plates 76 do not permit the rotary pick 76 to be rotated in the counter clockwise direction, because the braking force is larger than the friction between the head block 71 and the claw 66*a*4 (see FIG. 38E).

Figure 53A:
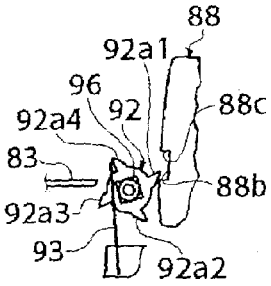
Figure 53B:
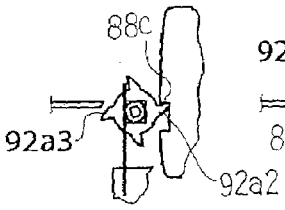
Figure 53C:
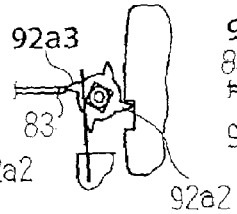
Figure 53D:
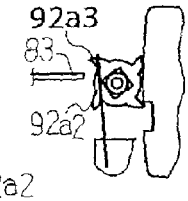
Figure 53E:
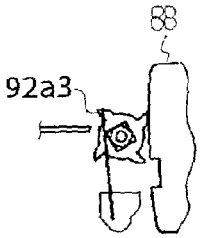
Figure 53F:
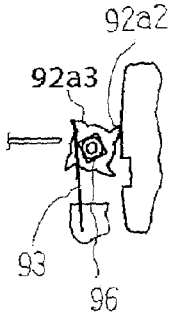
Figure 53G:
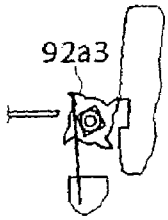

FIGS. 53F and 53G illustrate the motion of the rotary pick 92 in detail. FIG. 53A shows the arm at the rest position. The arm 88 starts to rotate in the counter clockwise direction. The edge 88*c* is brought into contact with the claw 92*a*2 as shown in FIG. 53B, and pushes the claw 92*a*2 of the rotary pick 92 as shown in FIG. 53C. The rotary pick 92 is drive for rotation over the predetermined angle against the elastic force of the cam spring 93, and plucks the reed 83 with the claw 92*a*3. The reed 83 vibrates for generating the tone. The rotary pick 92 stops the rotation, and the reed 83 freely vibrates the gap between the claws 92*a*3 and 92*a*2 as shown in FIG. 53D.

Figure 53H:
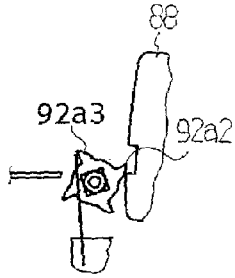

The arm 88 starts to return to the upper dead point as indicated by FIG. 53E. Although the arm 88 slides on the claw 92*a*2, the cam plates 96 and cam spring 93 do not permit the rotary pick 92 to rotate in the counter clockwise direction, and the rotary pick 92 keeps the attitude unchanged as shown in FIGS. 53F and 53G. When the arm 88 reaches the upper stopper 90, the next claw 92*a*2 is in the space as shown in FIG. 53H.

As will be understood, the musical instrument has the advantages by virtue of the solenoid-operated flat actuators FLAT2. The manufacturer can arrange the reeds at short intervals so that the musical instrument is compact. The arm 88 per se pushes the claws 92*a*, and the cam plates/cam spring 93/95 prevent the rotary pick 92 from the reverse rotation. This results in that the reeds 83 are constantly plucked with the claws 92*a*. This means that the loudness is exactly controlled.

The solenoid-operated flat actuators FLAT2 may linearly move plates in the up-and-down direction. The reeds 83 may be replaced with strings or tone bars. In case where the tone bars are employed in a musical instrument, the player's fingers strike the tone bars with mallets or sticks.

Fifth Embodiment

Figure 54:
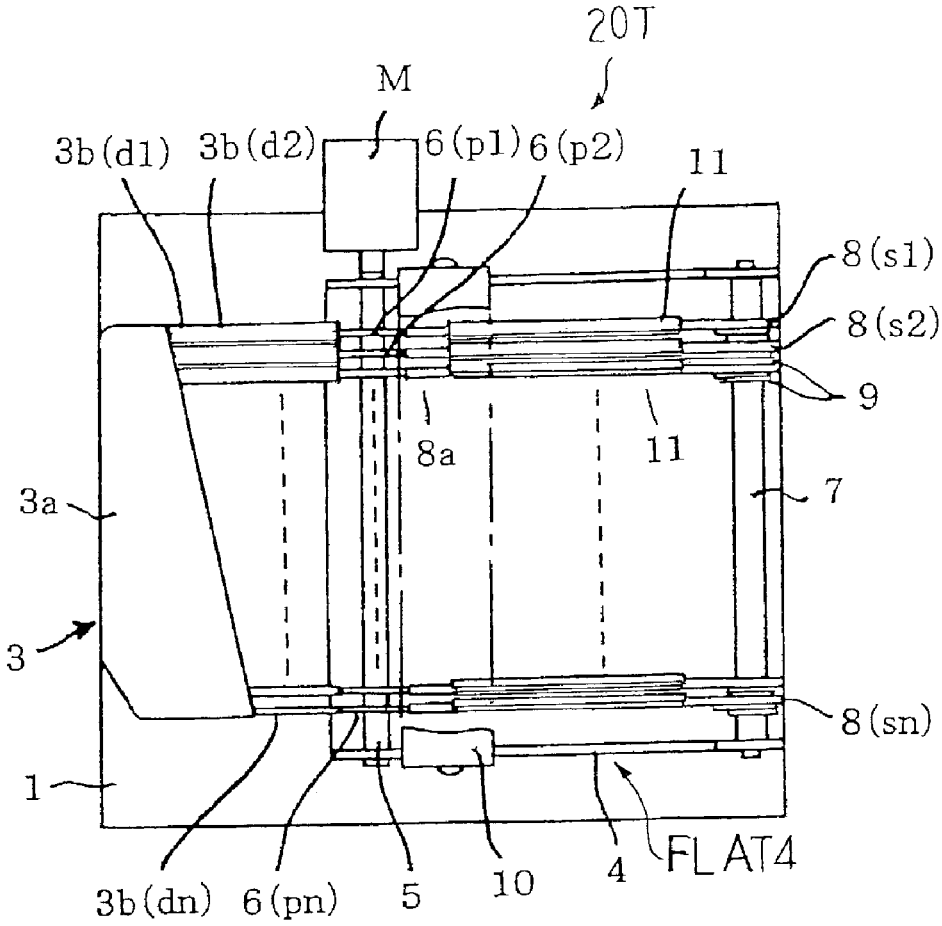
FIG. 54 is a plane view showing the layout of another musical instrument according to the present invention.
Figure 55:
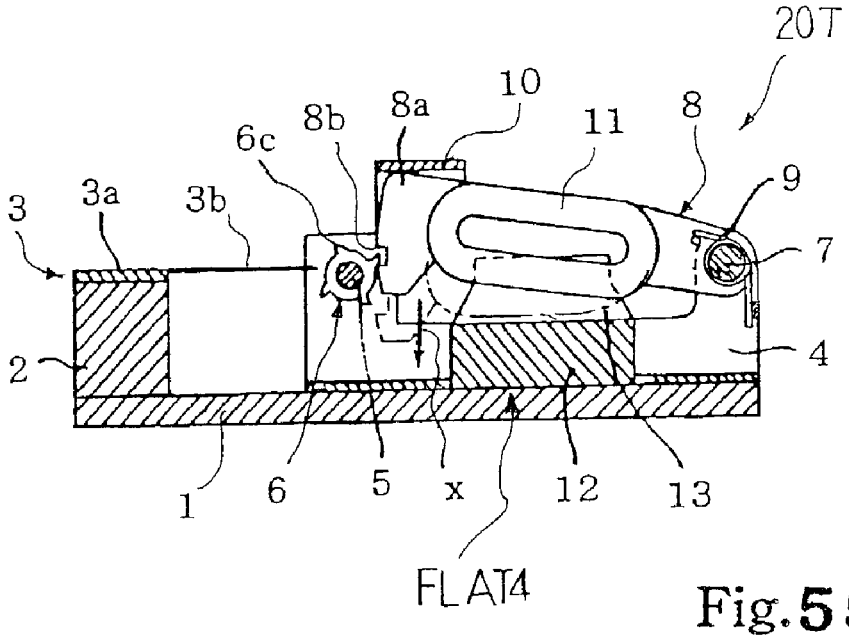
FIG. 55 is a cross sectional view showing the structure of the musical instrument.

FIGS. 54 and 55 show another musical instrument embodying the present invention. The musical instrument is categorized in the music box. The musical instrument also largely comprises a tone generator and an automatic player. The tone generator is implemented by a comb-like reed array 3. The comb-like reed array 3 has a boss portion 3*a* fixed to a block 2, which in turn is fixed to a base plate 1. Plural reeds 3*b* project from the boss portion 3*a* in parallel to one another. The reeds 3*b* are designed such that the they generate the tones at intervals of semitone. References 3*b*(d1), 3*b*(d2), . . . and 3*b*(dn) are individually assigned to the reeds 3*b*. The reed 3*b*(d1) generates the tone with the pitch name C, and the reed 3*b*(d2) generates the tone with the pitch name C#. Thus, the tones of the scale are respectively assigned to the reeds 3*b*(d1) to 3*b*(dn).

The automatic player includes a controller 20At and plural player's fingers 20T. An electric motor M is shared among the player's fingers 20T (see FIG. 56), and one of the particular features of the musical instrument is directed to the electric motor M, with which the cams and cam springs are replaced. The particular feature will be described in detail in conjunction with the structure of the player's fingers 20T.

Figure 57:
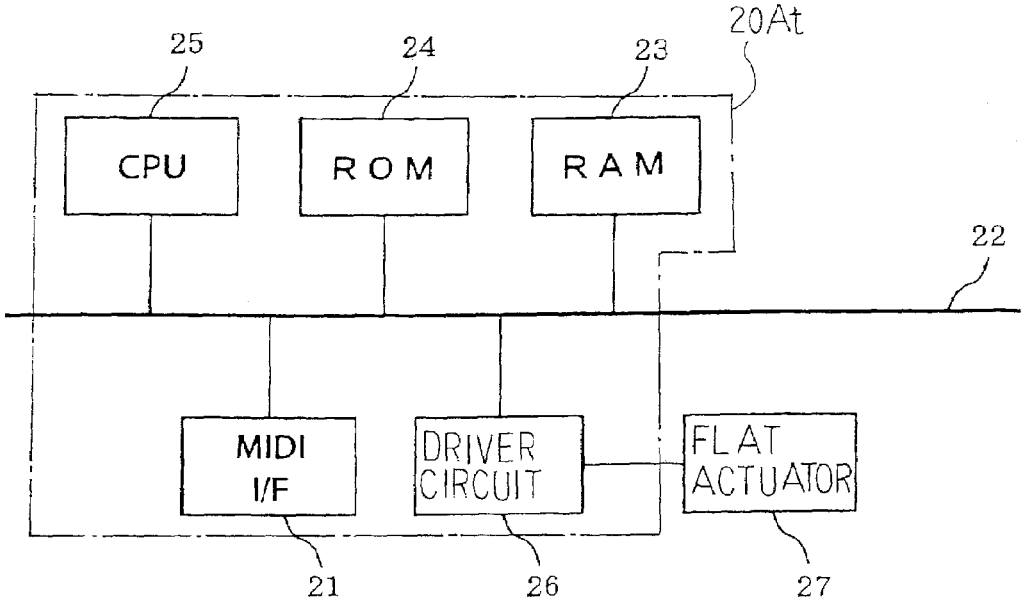
FIG. 57 is a block diagram showing the system configuration of a controller.

The controller 20At includes a MIDI interface 21, a bus system 22, a random access memory 23, a read only memory 24, a central processing unit 25 and a driver circuit 26 as shown in FIG. 57. The MIDI interface 21, random access memory 23, read only memory 24, central processing unit 25 and driver circuit 26 are connected to the bus system 22 so that digital codes are transferred through the bus system 22 between those system components 21/23/24/25/26.

The random access memory 23 has a capacity large enough to store plural sets of music data codes representative of several pieces of music. Computer programs are stored in the read only memory 24 together with data codes representative of data required for plucking the reeds 3*b*. Other sets of music data codes, with which the automatic player performs pieces of music, may be stored in the read only memory 24. The automatic player may require several minutes for performing a piece of music represented by a set of music data codes. The music data codes specify the pitch of a tone to be generated, touch and timing at which the tone is to be generated, and are called as "note event data".

The central processing unit 25 is responsive to user's instructions given through a manipulating panel (not shown). When a user specifies a piece of music through the manipulating panel, the central processing unit 25 starts to sequentially execute instruction codes of the computer program, and successively fetches the music data codes stored in the random access memory 23 or read only memory 24 in order to the timing. The central processing unit 25 specifies the player's finger 20T to be actuated on the basis of the piece of music data representative of the pitch and note-on event. The central processing unit 25 informs the driver circuit 26 of the player's finger 20T to be actuated at the timing at which the tone is to be generated. Another task to be achieved through the sequential execution of the computer program relates to the MIDI interface 21, and will be hereinafter described.

The MIDI interface 21 is connected to an external MIDI data source (not shown), and receives data codes of a standard MIDI file, by way of example. A detachable memory device such as, for example, a memory card is also connectable to the MIDI interface 21, and the data codes are supplied from the detachable memory to the MIDI interface 21. The data codes are transferred through the bus system 22 to the random access memory 23, and are stored therein. The central processing unit 25 converts the data codes in the standard MIDI file to other data codes in another format for the musical instrument according to the present invention. The central processing unit 25 stores the data codes in the other format in the random access memory 23, again.

Turning back to FIGS. 54 and 55, each of the player's fingers 20T includes a solenoid-operated flat actuator FLAT4, a swingable arm 8, a spring 9 and a rotary pick 6. Shafts 5/7, a stopper 10 and a base chassis 4 are shared among the player's fingers 20T. The base chassis 4 is spaced from the block 2, and is fixed to the base plate 1. The shaft 5 is rotatably supported by the base chassis 4, and the other shaft 7 is fixedly supported by the base chassis 4. The shafts 5 and 7 extend in parallel to one another in a direction parallel to the virtual line on which the tips of the reeds 3*b* are rowed up, and the shaft 5 is closer to the tips of the reeds 3*b* than the other shaft 7. The solenoid-operated flat actuators FLAT4 are disposed between the shafts 5 and 7. The stopper 10 is spaced from the base plate 1 in a direction normal to the upper surface of the base plate 1, and extends in parallel to the shafts 5 and 7 and over the player's fingers 20T.

Figure 56:
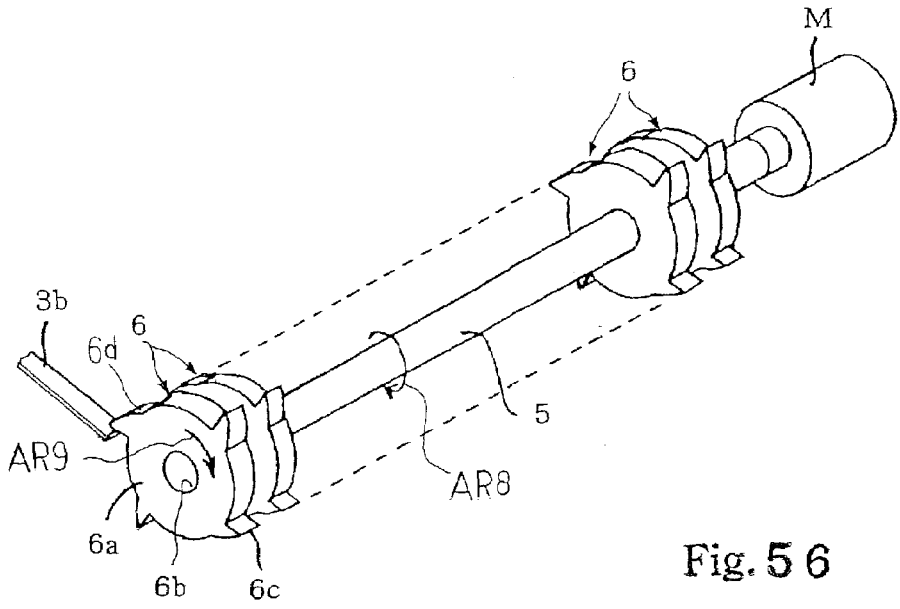
FIG. 56 is a perspective view showing an array of rotary picks.

The rotary picks 6 are arranged on the shaft 5 at short intervals, and the electric motor M has an output shaft coupled to one end of the shaft 5 as will be better seen in FIG. 56. The rotary picks have respective boss portions 6*a*, which are formed with center holes 6*b*, respectively, and claws 6*c*. In this instance, four claws 6*c* project from each boss portion 6*a*, and are 90 degrees spaced from one another. The shaft 5 passes through the center holes 6*b*, and the rotary picks 6 keep themselves spaced from the adjacent rotary picks 6 at the short intervals. However, the rotary picks 6 are never fixed to the shaft 5. While the electric motor M drives the output shaft for rotation, the shaft 5 is rotated together with the output shaft in a direction indicated by arrow AR8 (see FIG. 56), which is corresponding to the clockwise direction in FIG. 55, and urges the rotary picks 6 to rotate together due to the friction between the output surface of the shaft 5 and the inner surfaces of the boss portions 6*a*. In this instance, the rotary picks 6 and the shaft 5 are made of synthetic resin. However, the rotary picks 6 and shaft 5 may be made of metal or alloy in another musical instrument.

Although the base portion 6*a* is spaced from the tip of the associated reed 3*b*, the claws 6*c* reach the tip of the associated reed 3*b* so that the rotary pick 3 plucks the reed 3*b* with the claws 6*c*. As described hereinlater in detail, the swingable arms 8 give rise to rotation of the associated rotary picks 6 in a direction indicated by arrow AR9, and the rotary picks 6 make the tips of the associated reeds 3*b* on the rounded surfaces 6*d* of the claws 6*c*. The individual rotary picks 6 are labeled with 6(p1), 6(p2), . . . and 6(pn), and the rotary picks 6(p1), 6(p2), . . . and 6(pn) are respectively associated with the reeds 3*b*(d1), 3*b*(d2), . . . and 3*b*(dn).

The swingable arms 8 are rotatably supported by the shaft 7 at the short intervals, and the springs 9 always urge the associated swingable arms 8 in the clockwise direction in FIG. 55. The stopper 10 receives the swingable arms 8, and defines the upper dead points for the swingable arms 8. The elastic force exerted on each swingable arm 8 is larger than the force exerted on the swingable arm 8 due to the friction between the outer surface of the shaft 5 and the inner surface of the associated rotary pick 6. For this reason, even though the shaft 5 is driven for rotation, the springs 9 keep the associated swingable arms 8 at the rest position beneath the stopper 10.

Each of the swingable arm 8 has a head portion 8*a*, and a notch 8*b* is formed in the head portion 8*a*. The notch 8*b* is so wide that one of the claws 6*c* of the associated rotary pick 6 can enter the notch 8*b*. The individual swingable arms 8 are labeled with 8(s1), 8(s2), . . . and 8(sn). The swingable arms 8(s1), 8(s2), . . . and 8(sn) are respectively associated with the rotary picks 6(p1), 6(p2), . . . and 6(pn) and, accordingly, with the reeds 3*b*(d1), 3*d*(b2), . . . and 3*b*(dn).

The solenoid-operated flat actuators FLAT4 include permanent magnet plates 12, yokes 13 and respective flat coils 11. The yokes 13 are taller than the permanent magnet plates 12, and the yokes 13 and permanent magnet plates 12 are alternated with one another. For this reason, a gap takes place between the adjacent two yokes 13, and the swingable arms 8 are respectively assigned to the gaps. The flat coils 11 are fixed to the side surfaces of the associated swingable arms 8, and are moved together with the associated swingable arms 8. The coil 11 is so short that the flat coil 11 is thin enough to be resting in the gap together with the swingable arm without any physical contact with the yokes 13.

Assuming now that the user requests the automatic player to perform a piece of music, the central processing unit 25 accesses the random access memory 23 or read only memory 24, and sequentially fetches the music data codes representative of the tones to be generated. The central processing unit 25 specifies the player's fingers 20T to be actuated, and instructs the driver circuit 26 to energizes the solenoid-operated flat actuators FLAT4 at the appropriate times. The note-on events are defined on the lapse of time from the initiation of the performance, and the controller 20At increments the tempo clocks. When the lapse of time reaches the time at which the note-on event is to occur, the central processing unit 25 instructs the driver circuit 26 to supply the driving signal to the player's finger.

Figure 58A:
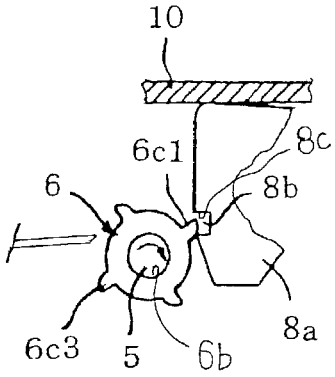
FIGS. 58A to 58C are schematic views showing the rotary pick plucking an associated reed.

While the automatic player is performing the piece of music, the controller 20At is assumed to energize the solenoid-operated flat actuator FLAT4 shown in FIG. 55. Before the controller 20At energizes the solenoid-operated flat actuator FLAT4, the head portion 8*a* was in contact with the stopper 10, and the claw 6*c*1 was rest in the notch 8*b* as shown in FIG. 58A. The claw 6*c*1 was held in contact with the lower edge of the head portion 8*a*. Although the shaft 5 was rotating in the center hole 6*b* in the rotary pick 6, the moment exerted on the head portion 8*a* due to the friction was smaller than the moment due to the elastic force of the string, and the shaft 5 was rotating in the center hole 6*b* of the rotary pick 6.

Figure 58B:
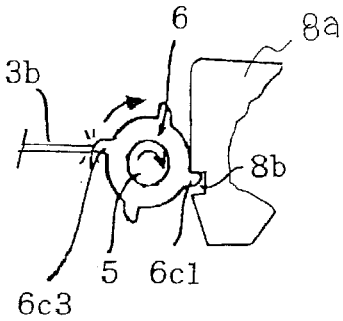

When the current flows through the flat coil 11, the magnetic force is exerted on the flat coil 11, and the associated swingable arm 8 starts the rotation as indicated by arrow x against the elastic force of the spring 9. The head portion 8*a* is spaced from the stopper 10, and the edge 8*c* is brought into contact with the claw 6*c*1. The head portion 8*a* pushes the claw 6*c*1 downwardly, and gives rise to the rotation of the rotary pick 6 in the clockwise direction against the friction between the outer surface of the shaft 5 and the inner surface of the boss portion 6*a*. The claw 6*c*3 is brought into contact with the tip of the associated reed 3*b*, and makes the tip slide on the rounded surface 6*d*. When the claw 6*c*3 escapes from the tip of the reed 3*b*, the reed 3*b* vibrates for generating the tone as shown in FIG. 58B. The reed 3*b* is vibrating in the gap between the claw 6*c*3 and the next claw 6*c*2 so that the rotary pick 6 does not interfere with the vibrating reed 3*b*.

Figure 58C:
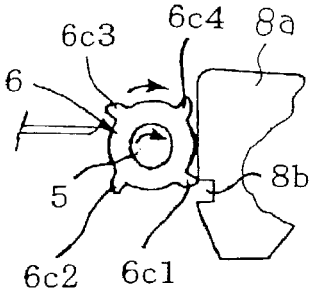

When the head portion 8*a* reaches the lower dead point, the controller 20At removes the magnetic force from the flat coil 11, and the head portion 8*a* starts to return toward the rest position. Although the front end surface of the head portion 8*a* slides on the rotary pick 6, the rotating shaft 5 urges the rotary pick 6 in the clockwise direction so that the rotary pick 6 keeps the attitude thereof unchanged as shown in FIG. 58C.

When the head portion 8*a* reaches the rest position, the shaft 5 slightly rotates the rotary pick 6, and the next claw 6*c*4 enters the notch 8*b*.

As will be understood from the foregoing description, the musical instrument has the advantages by virtue of the solenoid-operated flat coils FLAT4. The rotary picks 6 are urged by the rotating shaft 5, and neither ratchet nor combination of cams and cam springs are required for the rotary picks 6. This results in the simple structure of the player's fingers 20T.

Figure 59:
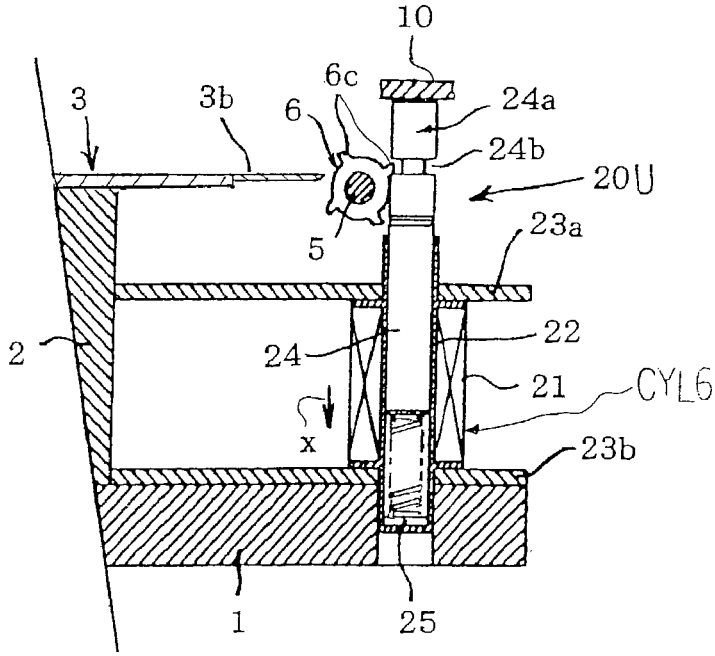
FIG. 59 is a cross sectional view showing a modification of the musical instrument.

The player's fingers 20T may be replaced with player's fingers 20U. In the player's finger 20U, the solenoid-operated flat actuator FLAT and swingable arm 8 are replaced with a solenoid-operated cylindrical actuator CYL6 and a plunger head 24*a* as shown in FIG. 59. The solenoid-operated cylindrical actuator CYL6 includes yoke plates 23*a* spaced from each other in an up-and-down direction, a cylindrical coil 22 sandwiched between the yoke plates 23*a* and 23*b*, a plunger 24 projectable from and retractable into the space defined by the cylindrical coil 22 and a spring 25 urging the plunger 24 upwardly. The plunger head 24*a* is connected to the upper end of the plunger 24, and a ring space 24*b* takes place between the plunger 24 and the plunger head 24*a*. The spring 26 urges the plunger upwardly so that the plunger head 24*a* is held in contact with the stopper 10 in the absence of the magnetic field, and the friction between the outer surface of the shaft 5 and the inner surface of the rotary pick 6 causes the claw 6*c* to be in contact with the upper edge of the plunger 24.

Assuming now that the controller energizes the solenoid operated cylindrical actuator CYL6, the plunger 24 is moved downwardly as indicated by x, and the plunger head 24*a* is brought into contact with the claw 6*c*. The plunger head 24*a* pushes down the claw 6*c*, and gives rise to rotation of the rotary pick 6 in the clockwise direction. Another claw 6*c* plucks the reed 3*b* so that the reed 3*b* vibrates for generating the tone.

When the plunger 24 reaches the lower dead point, the controller removes the magnetic field from the solenoid-operated cylindrical actuator CYL6, and the spring 25 makes the plunger 24 project upwardly. Since the rotating shaft 5 exerts the moment on the rotary pick 6, the rotary pick 6 is never rotated in the counter clockwise direction. Thus, the rotary pick 6 permits the reed 3*b* to freely vibrate in the gap between the claws 6*c*. When the plunger head 24*a* is brought into contact with the stopper 10, the next claw 6*c* enters the ring space for the next plucking.

The solenoid-operated cylindrical actuators CLY6 may be arranged in two or three stages stacked with one another for preventing the coils 21 from interference. In this instance, the plunger heads 24*a* are thinned so that the player's fingers are arranged like the player's fingers 20T.

The solenoid-operated cylindrical actuators CYL6 may be arranged in parallel to the base plate 1. In this instance, the plungers 24 and plunger heads 24*a* horizontally project from and are retracted into the yokes for driving the rotary picks 6 for rotation.

The electric motor M may intermittently rotate the shaft 5 for keeping the rotary picks 6 stable during the plunger's motion from the lower dead points to the upper dead points.

The solenoid-operated cylindrical actuators CYL6 may rotate the associated rotary picks 6 during the straight motion from the lower dead points to the upper dead points. The shaft 5 prevents the rotary picks 6 from the reverse rotation in the straight motion from the upper head points to the lower head points. The plucking with the swingable arms 8 are similarly changed from the counter clockwise direction to the clockwise direction.

The rotary picks 6 may be driven for rotation by the shaft 5 so as to pluck the reeds 3*b*. In this instance, the swingable arms 8 stop the rotation of the rotary picks 6 while the reeds 3*b* are to be silent.

Although particular embodiments of the present invention have been shown and described, it will be apparent to those skilled in the art that various changes and modifications may be made without departing from the spirit and scope of the present invention.

For example, the boss portion 33*a* may have a circular periphery. In this instance, the tips 33*c* are arranged on a certain curved line such as an involute line.

The resonator box 43 or both of the resonator box 43 and bell 45 may be attached to one of the music boxes shown in FIGS. 1 to 6D.

In a multiple music box according to the present invention, all the daisy reed wheels 32 may be assigned a register. The performing boxes 41/141 may play only one part of a piece of music. In this instance, the tones are richer than those of the other music boxes.

The tone generator and automatic player may form parts of a toy, electrical goods or a new sort of musical instrument. The automatic players described hereinbefore may be provided for a harp or another plucking instrument. Tone bars may be used for a musical instrument according to the present invention. In this instance, the automatic player does not pluck the tone bars, but strikes the tone bars.

The music data codes may be supplied from a musical instrument, on which a human player plays a piece of music, to the controller in real time fashion. In this instance, the musical instrument according to the present invention performs a part of the piece of music in ensemble with the other musical instrument.

Figure 19:
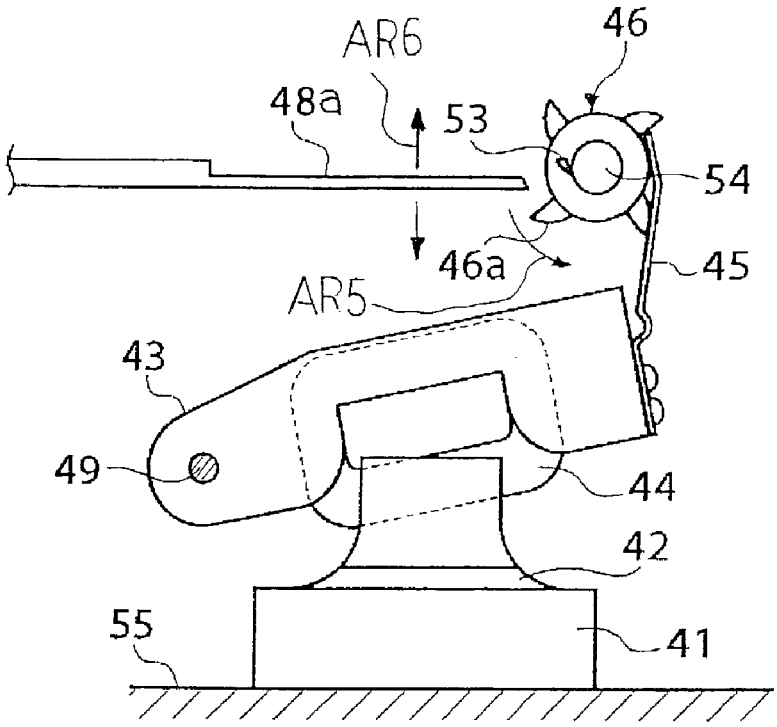
FIG. 19 is a side view showing the player's finger after the plucking.

In the modification shown in FIGS. 17 to 19, the solenoid-operated flat actuators FLAT1 may occupy the space over the array 48 of reeds or space in front of the array 48 of reeds. Thus, the manufacturer freely designs the musical instrument. The permanent magnet plates 41 may be fixed to the swingable arms 43. In this instance, the flat coils 44 are placed between the yokes 42. Namely, the permanent magnet plates 41 and flat coils 44 are exchangeable. Moreover, plural swingable arms 43 may be assigned to one of the gap between the yokes 43. In this instance, the permanent magnet plates 41 or flat coils 44 are expected to create strong magnetic field in the gap.

Although the solenoid-operated flat actuators FLAT1/FLAT2 give rise to rotations of the swingable arms 43/88 in the musical instruments, other solenoid-operated flat actuators may move plates linearly.

What is claimed is:

1. A musical instrument comprising:

a tone generator having vibratory members radially arranged with respect to a center of said tone generator; and an automatic player selectively generating vibrations of said vibratory members for producing tones different in pitch from one another through said vibrations, and including:

player's fingers arranged in the proximity of outer ends of said vibratory members and responsive to an instruction so as to convert energy to said vibrations of said vibratory members, and a controller giving said instruction selectively to said player's fingers so as to make the player's fingers start to convert said energy to said vibrations of the associated vibratory members on the basis of pieces of music data that are changeable without changing a physical structure of said controller.

2. The musical instrument as set forth in claim 1, in which said controller concurrently activates more than one player's finger for generating the tones.

3. The musical instrument as set forth in claim 1, in which each of said player's fingers includes a pick for plucking associated one of said vibratory members, an actuator connected to said controller so as to be energized by said controller for plucking said associated one of said vibratory members with said pick and an attitude controller connected to said pick and changing said pick between a plucking attitude for plucking said associated one of said vibratory members and a shunt position for passing beside said associated one of said vibratory members without any interference with said vibrations.

4. The musical instrument as set forth in claim 3, in which said attitude controller includes an offset yoke of a solenoid-operated actuator serving as said actuator so that said pick is inclined toward said associated one of said vibratory members while a plunger of said solenoid-operated actuator is moving said pick to said associated one of said vibratory members for plucking, said attitude controller further includes an elastic member connected to said pick so that said pick is oppositely inclined while said plunger is making said pick spaced from the vibrating vibratory member.

5. The musical instrument as set forth in claim 1, in which said vibratory members are reeds.

6. The musical instrument as set forth in claim 1, in which said vibratory members are strings.

7. The musical instrument as set forth in claim 1, in which said tone generator and said player's fingers form a playing unit, and more than one playing unit is combined together for producing the tones under the control of said controller.

8. The musical instrument as set forth in claim 7, further comprising a resonator connected to said more than one playing unit for enlarging the loudness of said tones.

9. The musical instrument as set forth in claim 1, further comprising holders each having a portion at which one of said vibratory members is fixed and a space where one of said player's fingers is accommodated for generating said one of said vibratory members.

10. The musical instrument as set forth in claim 3, each of said player's fingers further includes a guide for spacing said pick from associated one of said vibratory members after generating said vibrations therein.

11. The musical instrument as set forth in claim 10, in which said guide has a pin fixed to said pick and a guide block formed with a first passage for guiding said pin during a first motion of said pick for generating said vibrations and a second passage for guiding said pin during a second motion of said pick for returning to a rest position.

12. The musical instrument as set forth in claim 3, in which said pick has a boss rotatably supported by a member stationary with respect to said actuator and claws radially projecting from said boss at intervals, and in which said actuator gives rise to rotation over a predetermined angle for plucking said associated one of said vibratory members with one of said claws.

13. The musical instrument as set forth in claim 1, further comprising a housing accommodating said tone generator and said automatic player so that said tone generator, said automatic player and said housing form in combination a music box.

14. A musical instrument comprising:

a tone generator having an array of vibratory members for generating tones different in pitch from one another through vibrations; and an automatic player including:

player's fingers responsive to an instruction so as to convert energy to said vibrations of said vibratory members, and a controller giving said instruction selectively to said player's fingers so as to make the player's fingers start to convert said energy to said vibrations of the associated vibratory members on the basis of pieces of music data that are changeable without changing a physical structure of said controller, each of said player's fingers having a rotary vibration generator rotatably supported by a stationary member in the proximity of associated one of said vibratory members for generating said vibrations through rotation thereof and an actuator connected to said controller and selectively energized by said controller for rotating said rotary vibration generator.

15. The musical instrument as set forth in claim 14, in which said controller concurrently activates more than one player's finger for generating the tones.

16. The musical instrument as set forth in claim 14, in which said rotary vibration generator has a boss portion rotatably supported by said stationary member and plural claws radially projecting from said boss at intervals.

17. The musical instrument as set forth in claim 16, in which said vibratory members project from a boss portion of said array in parallel to one another, and said rotary vibration generators are respectively provided in the proximity of tips of said vibratory members.

18. The musical instrument as set forth in claim 17, in which the actuators and said array of vibratory members are overlapped with one another, and said actuators selectively rotate the associated rotary vibration generators over a predetermined angle for plucking said tips of said vibratory members under the control of said controller.

19. The musical instrument as set forth in claim 16, in which said actuators have array of magnetic plates and yokes alternated with one another for forming gaps between said yokes, respective arms having first end portions rotatably connected to a stationary member, respective flat coils respectively attached to said arms and connected in parallel to said controller, and respective blades connected at second ends of said arm opposite to said first ends and projecting toward said rotary vibration generators for selectively pushing said claws while said arms are rotating about said stationary member.

20. The musical instrument as set forth in claim 15, in which said actuator includes a movable member for rotating said rotary vibration generator, a flexible wire connected at one end thereof to said movable member and a power generating unit connected to the other end of said flexible wire for exerting a force on said movable member through said flexible wire.

21. The musical instrument as set forth in claim 14, in which said array of vibratory members is formed in a daisy reed wheel having vibratory reeds radially projecting from a boss portion, and said player's fingers are arranged outside of said daisy reed wheel.

22. The musical instrument as set forth in claim 21, in which said rotary vibration generator has a boss portion and plural claws radially projecting from said boss portion at intervals, and the rotary vibration generators are provided around said daisy reed wheel for plucking said reeds with the claws.

23. The musical instrument as set forth in claim 14, further comprising a housing accommodating said tone generator and said automatic player so that said tone generator, said automatic player and said housing form in combination a music box.

24. The musical instrument as set forth in claim 14, in which said each of said player's fingers further has a back stop so as to permit said rotary vibration generator to unidirectionally rotate.

25. The musical instrument as set forth in claim 24, in which said back stop is formed by a ratchet.

26. The musical instrument as set forth in claim 24, in which said back stop is formed by a cam plate fixed to said rotary vibration generator and a cam spring pressed to said cam.

27. The musical instrument as set forth in claim 24, in which said back stop includes a shaft loosely passing through the rotary vibration generators and a motor connected to said shaft and unidirectionally rotating for urging said vibration generators.

28. A musical instrument comprising:

a tone generator having an array of vibratory members for generating tones different in pitch from one another through vibrations; and an automatic player including player's fingers for selectively generating said vibrations in said vibratory members and a controller connected to said player's fingers for selectively actuating said player's fingers on the basis of pieces of music data variable without changing a physical structure of said controller, each of said player's fingers including a vibration generator moved from a rest position along a first path for generating said vibrations in associated one of said vibratory members and a second path for returning to said rest position, an actuator connected to said controller and moving said vibration generator along said first path and said second path, and a route changer connected to said vibration generator for guiding said vibration generator to said second path after generating said vibrations so as to permit the associated vibratory member to freely vibrate without any interference due to said vibration generator passing beside said associated vibratory member along said second path.

29. The musical instrument as set forth in claim 28, in which said route changer includes a magnetic field generator for forcing said vibration generator to said first path and an elastic member for forcing said vibration generator to said second path.

30. The musical instrument as set forth in claim 29, in which said magnetic field generator exerts a magnetic force larger than an elastic force of said elastic member on said vibration generator from a rest position to a certain position in said first path, and makes said magnetic force smaller than said elastic force after the generation of said vibration in said first path.

31. The musical instrument as set forth in claim 28, in which said route changer further includes a guide block having a hollow space partially serving as said first path and partially serving as said second path.

32. The musical instrument as set forth in claim 31, in which said route changer further includes a guide pin fixed to said vibration generator, and said guide block is formed with a first groove slidably receiving said guide pin for guiding said vibration generator along said first path and a second groove slidably receiving said guide pin for guiding said vibration generator along said second path.

33. The musical instrument as set forth in claim 32, in which said first groove is connected to a certain portion of said second groove, and said second groove is connected to another certain portion of said first groove, said certain portion and said another certain portion respectively preventing said vibration generator from entering into said first path and said second path so that said vibration generator is moved along said first path, enters said second path over said certain portion, moved along said second path and enters said first path over said another certain portion.

34. The musical instrument as set forth in claim 28, in which said route changer includes a rotatable disc, and said vibration generator includes claws radially projecting from said rotatable disc at intervals, said rotatable disc causes one of said claws to enter said first path through a rotation over a certain angle and said second path through a further rotation over another certain angle.

35. A musical instrument comprising:

a tone generator having vibratory members radially arranged with respect to a center of said tone generator; and an automatic player selectively generating vibrations of said vibratory members for producing tones different in pitch from one another through said vibrations, said automatic player comprising:

player's fingers arranged in the proximity of outer ends of said vibratory members and respectively associated with said vibratory members, and a controller connected to said player's fingers for selectively and electrically actuating said player's fingers on the basis of pieces of music data that are changeable without changing a physical structure of said controller.

36. A musical instrument comprising:

a tone generator having an array of vibratory members for generating tones different in pitch from one another through vibrations; and an automatic player comprising:

player's fingers respectively associated with said vibratory members for selectively generating said vibrations in said vibratory members, and a controller connected to said player's fingers for selectively and electrically actuating said player's fingers on the basis of pieces of music data that are changeable without changing a physical structure of said controller, each of said player's fingers having a rotary vibration generator rotatably supported by a stationary member in the proximity of associated one of said vibratory members for generating said vibrations through rotation thereof and an actuator connected to said controller and selectively and electrically energized by said controller for rotating said rotary vibration generator.

* * * * *